US011503924B2

(12) United States Patent
Mithal et al.

(10) Patent No.: US 11,503,924 B2
(45) **Date of Patent: *Nov. 22, 2022**

(54) CUTLERY DISPENSING SYSTEM AND METHOD

(71) Applicant: Waddington North America, Inc., Chelmsford, MA (US)

(72) Inventors: Ashish K Mithal, Chelmsford, MA (US); William A Gallop, Westminster, MA (US)

(73) Assignee: Waddington North America, Inc., Chelmsford, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/461,376

(22) Filed: Aug. 30, 2021

(65) Prior Publication Data

US 2021/0386217 A1 Dec. 16, 2021

Related U.S. Application Data

(63) Continuation of application No. 16/831,510, filed on Mar. 26, 2020, now Pat. No. 11,134,796.

(Continued)

(51) Int. Cl.
*A47F 1/10* (2006.01)
*A47F 10/06* (2006.01)

(52) U.S. Cl.
CPC ..... *A47F 1/10* (2013.01); *A47F 10/06* (2013.01); *A47F 2001/103* (2013.01)

(58) Field of Classification Search
CPC .... A47F 1/10; A47F 1/08; A47F 10/06; A47F 2001/103; A47G 21/00
See application file for complete search history.

(56) References Cited

U.S. PATENT DOCUMENTS 512,162 A 1/1894 Cuddy
2,141,684 A 12/1938 Diemer
(Continued)

FOREIGN PATENT DOCUMENTS

CN 101066183 A 11/2007
JP 2002211633 A 7/2002
(Continued)

OTHER PUBLICATIONS

International Report on Patentability for Appl. No. PCT/US2020/025001, dated Oct. 7, 2021, 9 Pages.
(Continued)

*Primary Examiner* — Ko H Chan
(74) *Attorney, Agent, or Firm* — Maine Cernota & Rardin

(57) ABSTRACT

An escapement mechanism of a cutlery dispenser causes a cutlery article to fall from a vertical stack onto a slide track that guides it to a dispensing position. A slide channel and head channel of the slide track can laterally confine the cutlery article. A dampening surface can reduce cutlery bouncing and skewing. The escapement mechanism can include at least three pivots and/or a coil return spring. Dispensers can be installed in a base in any desired combination and retained therein by compatible features such as flanges and slots that prevent dispenser tipping. In embodiments, individual dispensers can be horizontally slid partway out of the base to access side features that would otherwise be obscured by a neighboring dispenser. A cutlery quantity indicator can laterally contact the cutlery stack and can pivot to display a low-cutlery signal when the cutlery stack falls below an indicator height.

20 Claims, 58 Drawing Sheets

Related U.S. Application Data

(60) Provisional application No. 62/824,002, filed on Mar. 26, 2019.

(56) References Cited

U.S. PATENT DOCUMENTS

| | | | | |
|---|---|---|---|---|
| 2,149,099 | A | 2/1939 | Phinney et al. | |
| 2,216,005 | A | 9/1940 | Goldstein | |
| 2,752,678 | A | 7/1956 | Welch | |
| 2,911,127 | A | 11/1959 | Driss et al. | |
| 3,635,350 | A | 1/1972 | Wolf | |
| 3,664,020 | A | 5/1972 | Hammond | |
| 3,987,901 | A | 10/1976 | Dullinger | |
| 4,134,519 | A | 1/1979 | Barnett et al. | |
| 4,426,056 | A | 1/1984 | Gelardi et al. | |
| D275,167 | S | 8/1984 | Laslo | |
| 4,524,512 | A | 6/1985 | Formo et al. | |
| 4,539,749 | A | 9/1985 | Hyeong-Woon | |
| 4,610,087 | A | 9/1986 | Mickelson et al. | |
| 4,995,154 | A | 2/1991 | Bamber | |
| 5,131,562 | A | 7/1992 | Brown | |
| 5,295,592 | A | 3/1994 | Thorne | |
| 5,388,600 | A | 2/1995 | Hart | |
| 5,855,285 | A | 1/1999 | Laird et al. | |
| 5,855,422 | A | 1/1999 | Naef | |
| 5,904,250 | A | 5/1999 | De Schutter | |
| 5,921,408 | A | 7/1999 | Gronewold et al. | |
| 6,250,498 | B1 | 6/2001 | Lovejoy | |
| 6,336,568 | B1 | 1/2002 | Tucker et al. | |
| 6,662,967 | B2 | 12/2003 | Roy | |
| 6,832,694 | B2 | 12/2004 | Goeking et al. | |
| 7,013,568 | B2 | 3/2006 | Schmidt | |
| D584,084 | S | 1/2009 | Tucker et al. | |
| 7,669,732 | B2 | 3/2010 | Njaastad | |
| 7,900,797 | B1 | 3/2011 | Witcraft | |
| 8,272,533 | B1 * | 9/2012 | □Amelia | A47F 1/10 221/172 |
| 8,296,957 | B2 | 10/2012 | Muehlemann | |
| 8,297,473 | B2 | 10/2012 | Smith | |
| D675,869 | S | 2/2013 | Gallop | |
| 8,839,522 | B2 | 9/2014 | Walters | |
| 9,049,948 | B2 | 6/2015 | Jongen | |
| 9,226,598 | B1 | 1/2016 | Knope et al. | |
| 9,332,861 | B2 * | 5/2016 | Borke | A47G 21/06 |
| 9,924,816 | B2 | 3/2018 | Oakes | |
| 10,051,976 | B2 | 8/2018 | Smith | |
| 10,188,226 | B2 | 1/2019 | Babcock et al. | |
| 10,390,631 | B2 | 8/2019 | Smith | |
| 10,779,661 | B2 | 9/2020 | Schoening et al. | |
| 10,881,221 | B2 | 1/2021 | Kennedy et al. | |
| 2002/0112445 | A1 | 8/2002 | Scaduto | |
| 2005/0155229 | A1 | 7/2005 | Lee | |
| 2007/0000136 | A1 | 1/2007 | Allen et al. | |
| 2007/0108141 | A1 | 5/2007 | Smith et al. | |
| 2008/0128445 | A1 | 6/2008 | Huang et al. | |
| 2010/0170915 | A1 | 7/2010 | Reinsel et al. | |
| 2011/0138632 | A1 | 6/2011 | Wong | |
| 2011/0219631 | A1 | 9/2011 | Hou | |
| 2011/0226797 | A1 | 9/2011 | Reinsel et al. | |
| 2011/0296693 | A1 | 12/2011 | Oakes | |
| 2013/0193157 | A1 | 8/2013 | Jongen et al. | |
| 2015/0041484 | A1 | 2/2015 | Oakes | |
| 2015/0048108 | A1 | 2/2015 | Borke | |
| 2015/0257561 | A1 | 9/2015 | Miksovsky | |
| 2015/0289679 | A1 | 10/2015 | Oakes | |
| 2017/0095100 | A1 | 4/2017 | White | |
| 2019/0075940 | A1 | 3/2019 | Pierson | |
| 2019/0223621 | A1 | 7/2019 | Loucks | |

FOREIGN PATENT DOCUMENTS

| | | | |
|---|---|---|---|
| WO | 0105281 | A1 | 1/2001 |
| WO | 2001005281 | A1 | 1/2001 |

OTHER PUBLICATIONS

Summons to Attend Oral Proceedings for EP Appl. No. 17779770.1-1005 dated Oct. 26, 2021, 5 Pages.
Office Action dated Jan. 8, 2019 for U.S. Appl. No. 13/161,767, 8 pages.
Office Action dated Jun. 28, 2019 for U.S. Appl. No. 13/161,767, 8 pages.
Office Action dated Mar. 23, 2020 for U.S. Appl. No. 16/182,185, 24 pages.
PCT International Search Report and Written Opinion for Appl No. PCT/US2017/026202 dated Jul. 11, 2017, 14 pages.
Office Action dated May 18, 2020 for European Appl. No. 17779770.1, 3 pages.
International Search Report and Written Opinion for PCT Appl. No. PCT/US2020/025001, dated Jul. 14, 2020, 12 Pages.
Office Action for U.S. Appl. No. 16/091,835, dated Aug. 3, 2020, 27 Pages.
English Translation of Office Action for Chinese Patent Appl. No. 201780027881.8, dated Jul. 14, 2020, 15 Pages.
Notice of Allowance for U.S. Appl. No. 16/182,185, dated Sep. 4, 2020, 18 Pages.
Office Action for U.S. Appl. No. 13/161,767, dated Sep. 23, 2020, 39 Page.
Office Action for European Patent Appl. No. 17779770.1, dated Nov. 3, 2020, 3 Pages.
Office Action for U.S. Appl. No. 16/091,835, dated Jan. 11, 2021, 20 Pages.
Office Action for U.S. Appl. No. 16/091,835, dated Mar. 17, 2021, 5 Pages.
Office Action for U.S. Appl. No. 16/831,510, dated Mar. 23, 2021, 23 Pages.
Chinese Office Action and English Translation for Chinese Patent Appl. No. 201780027881.8, dated Mar. 3, 2021, 25 Pages.
Notice of Allowance for U.S. Appl. No. 16/091,835, dated Apr. 29, 2021, 17 Pages.
Notice of Allowance for U.S. Appl. No. 13/161,767, dated Jun. 1, 2021, 37 pages.
Notice of Allowance for U.S. Appl. No. 16/831,510, dated Aug. 10, 2021, 23 Pages.
Office Action for U.S. Appl. No. 17/358,750 dated Jul. 21, 2022, 28 pages.
Office Action for U.S. Appl. No. 17/461,129 dated Jul. 22, 2022, 24 pages.

* cited by examiner

CUTLERY DISPENSING SYSTEM AND METHOD

REFERENCE TO RELATED APPLICATIONS

This application is a continuation of U.S. patent application Ser. No. 16/831,510, filed Mar. 26, 2020. Application Ser. No. 16/831,510 claims the benefit of U.S. Provisional Patent Application Ser. No. 62/824,002, filed Mar. 26, 2019. This application is also related to U.S. Pat. No. 8,272,533, issued on Sep. 25, 2012, to U.S. Pat. No. 11,083,316, issued on Aug. 10, 2021, and to U.S. Pat. No. 10,820,722, issued Nov. 3, 2020. Each of these patents and applications is incorporated herein in its entirety by reference for all purposes.

FIELD OF THE INVENTION

This invention relates to cutlery dispensers and methods of dispensing cutlery, and more specifically to mechanical, gravity fed cutlery dispensers that dispense cutlery in a sanitary manner.

BACKGROUND OF THE INVENTION

Many food service providers, such as restaurants and cafeterias, provide cutlery and related items to be utilized by patrons for consuming food. Typically, when food is served in a "buffet" style, the required cutlery is presented either directly on the buffet table or set up on a side table in appropriate containers, dispensers, or caddies, from which each of the consumers can select the cutlery items they need according to their preferences and/or individual food choices. Similarly, when consumers order food at a quick-service restaurant, the cutlery items and other condiments are generally set-up for self-service and retrieved by a consumer from a bin or a dispenser. The cutlery may be permanent ware or disposable. One of the advantages of having cutlery available for self-service is the reduced workload imposed on the restaurant or catering staff. Having the cutlery items available for self-service, allows the restaurant employees to focus on filling food orders, while diverting only a small amount of their time to periodically refilling the cutlery bins or dispensers when they run low.

One simple approach to self-service cutlery distribution is to provide open containers or canisters in which common supplies of cutlery are placed for easy selection and grasping by a user. This approach has the advantages of being inexpensive, requiring virtually no maintenance, and enabling employees to easily see from a distance whether or not the containers need to be replenished. However, this approach tends to be unsanitary, because it can be quite difficult for a consumer to grasp and remove a single item of cutlery without touching other cutlery items that remain afterward for others to select and use. Thus, the process of retrieving cutlery from a container or bin itself creates an unsanitary condition.

Furthermore, if the cutlery items are inserted in the bins with their heads down, then a user may also have difficulty in quickly identifying which cutlery items are in which bin. On the other hand, if the cutlery items are placed in the bins with their heads exposed, it is almost impossible for a user to select a cutlery item without touching the heads of other cutlery items in the bin. As a result, a key concern of many consumers when selecting their own cutlery from a commonly available supply is sanitation. Many consumers want to be certain their cutlery is clean, sanitary, and new or freshly washed, and they wish to feel confident that the cutlery has not been previously used and has not been handled in an unsanitary manner by others. Cross-contamination on food implements due to handling and contact by multiple users may also contribute to spread of infectious diseases, and is of significant concern from a public health perspective. In addition, this "open bin" approach typically requires that a large amount of space be dedicated to the cutlery containers, such that the cutlery station has a large "footprint," which can be inconvenient.

Another approach for ensuring sanitary, self-service distribution of disposable cutlery is to provide pre-packaged cutlery items or "cutlery kits," which are typically either individual cutlery items or grouped sets of items (such as a kit comprising a fork, a spoon, a knife and a napkin) wrapped inside a plastic overwrap film or placed inside a bag. However, separately wrapping cutlery or cutlery kits adds cost and gives rise to excess waste, at least in the form of discarded overwraps. This approach is also inconvenient for the customer, who is required to remove the overwrap so as to access the cutlery. In addition, pre-wrapped cutlery kits with multiple cutlery items prevent the consumer from selecting only the needed cutlery items, and can thereby lead to wasted, unused cutlery, which further increases cost and excess waste disposal.

Another approach for self-service distribution of disposable cutlery is to provide for delivery of cutlery from a dispenser. A common type of dispenser in commercial use requires a user to press a lever or similar element to activate the dispenser and initiate delivery of a single cutlery article into a retrieval location such as a tray or compartment. Unfortunately, in practice this approach requires that the operating lever or knob is touched by each and every consumer prior to retrieving cutlery from the dispenser tray, such that these dispenser components may themselves become carriers of contamination, and can actually lead to cross-contamination between users by transferring viruses, bacteria, and/or other micro-organisms from the lever, knob, or tray to consumers during the process of actuating the cutlery dispenser and retrieving the cutlery therefrom.

In addition, such dispensers typically store and dispense cutlery laterally, i.e. sideways, whereby the head and handle of the cutlery are often equidistant from the user. This "broadside" delivery of cutlery, however, can cause the user to inadvertently grasp the head rather than the handle of the cutlery, thereby contaminating the food contacting end and reducing sanitation. Furthermore, this lateral storage and dispensing approach requires that the dispenser must be somewhat wider than the length of the dispensed cutlery, causing the dispenser to consume valuable space that may be needed for other devices and supplies, such as condiments, napkins, etc. As a result, such cutlery dispensers are typically provided in a separate area and are often positioned in different locations within a crowded serving area according to available space, thereby requiring users to seek them out separately.

Other cutlery dispensing solutions include electrically actuated mechanisms that physically transport cutlery from an inaccessible storage area to a receiving area that is accessible to the user. Such electrical dispensers tend to be more intricately constructed than mechanical dispensers, and they require an electrical source, thereby restricting the installation location if an AC outlet is required, or requiring periodic replacement of batteries if batteries are required. Also, electrical dispensers tend to be bulky and prone to jamming and/or miss-feeding.

An additional problem with prior-art dispensers is that it is difficult for restaurant or cafeteria employees to visually discern when a dispenser is in need of refilling, especially from a distance. As a result, users are often frustrated by empty dispensers, and are required to seek out restaurant staff and request that the dispensers be refilled.

What is needed, therefore, is a cutlery dispensing system and method of delivering cutlery on demand to a user that assures sanitation, has reduced footprint, is intuitive and easy for both the consumer and operator to use, is easily adapted to meet specific cutlery requirements, is inexpensive to manufacture and operate, and is easy to maintain. These and other needs as shall hereafter appear are met by the apparatus and method of the present invention.

SUMMARY OF THE INVENTION

The present invention is a gravity-fed cutlery dispensing system and method of delivering cutlery on demand to a user that inter alia assures sanitation, has a reduced footprint, and is easily adapted to meet specific cutlery requirements, while being intuitive and easy for both the consumer and operator to use, refill, and maintain, and that overcomes other shortcomings of prior art dispensers.

Recently, a gravity fed cutlery dispenser was disclosed that presents cutlery to a user "end-on" or longitudinally rather than laterally, i.e. with a narrow width facing the user and an extended depth. This longitudinal cutlery dispenser is disclosed in U.S. Pat. No. 8,272,533, which is incorporated herein by reference in its entirety for all purposes. According to this approach, cutlery is presented to a user "handle-first." While this "end-on" approach has many advantages over the lateral dispenser approach, the end-on design can exhibit some shortcomings. One issue is orientation stability, in that the narrow footprint relative to the height of the dispenser creates a tendency for the dispenser to tip over if it is bumped or jostled. While this tip-over tendency can be addressed by providing a relatively wide dispenser base or bottom, doing so negates the footprint advantage gained by utilizing an end-on dispenser. On the other hand, if the dispenser is made shorter for providing increased stability, the cutlery capacity is reduced, which necessitates frequent refilling of the dispenser.

In addition, if a group of similar end-on dispensers are positioned or affixed side-by-side, then for the dispensers in the middle of the group only the fronts and tops of the dispensers are accessible. Generally, for ease of loading, a plurality of cutlery articles are bundled in a "pack" and top-loaded into the dispenser, after which any packaging associated with the pack must be removed. Restricted access to only the top and front of the dispenser can significantly complicate refilling of the cutlery dispenser with fresh cutlery and preparing it for dispensing, for example by hampering removal of the packaging after installation of a cutlery pack. Lack of side access can also make it more difficult to maintain the dispensers and clear any debris that may fall into the dispenser, and/or to remove cutlery articles that become jammed.

Yet another issue that can be exhibited by longitudinal or end-on dispensers is a potential of mechanical failure under conditions of heavy usage. This problem can arise due to repeated flexing of a return spring, such as a leaf spring, which can lead to deformation of the spring, metal fatigue, and eventual failure of the mechanism.

Furthermore, as discussed above, and as is generally the case for most cutlery dispensers that are in current use, it can be very difficult for operational staff to easily discern the level of cutlery remaining in a dispenser, such that the dispensers must be opened and inspected frequently to ensure that users are not inconvenienced by empty dispensers.

The present invention solves these and other problems that are present in the prior art. In particular, the present invention presents a novel dispensing system that provides lateral access in embodiments to the end-on dispenser(s) for loading and maintenance purposes while maintaining a compact dispenser footprint. It should be noted that the present invention is described herein with exemplary reference to dispensing of cutlery articles such as forks, spoons, knives and sporks that are commonly used for consuming food. Nevertheless, it should be understood that the scope of the present invention is not limited only to dispensing of such cutlery, and that persons of ordinary skill can instantiate and utilize the system and method disclosed herein for dispensing other elongate objects that include a proximal handle portion for grasping and a distal head.

The dispenser system of the present invention includes at least one end-on cutlery dispenser configured to contain a generally vertical stack of identical, co-aligned cutlery articles having their longitudinal axes aligned substantially horizontally, as well as a first cutlery article that is tipped downward and maintained in a dispensing position. The dispenser system further includes a dispensing escapement mechanism that is activated automatically as the first cutlery article is withdrawn by a user.

More specifically, a handle portion of the first cutlery article protrudes from an opening in the front panel of the dispenser facing the user, so that the handle portion can be grasped by the user for removing the first cutlery article from the dispenser. As the user manually grips the handle portion and removes the first cutlery article from the dispensing position, the head portion of the first cutlery article actuates an escapement member, which causes the escapement mechanism to separate and release a "bottommost" cutlery article from the bottom of the stack, allowing the bottommost cutlery article to be gravitationally directed downward into the dispensing position along an inclined surface or track, whereby it replaces the dispensed first cutlery article.

In addition to the escapement member, the escapement mechanism includes lower and upper retaining surfaces that are interconnected by multiple pivots and a pair of durable coil springs for actuating or cycling the escapement mechanism, so as to provide consistent and reliable singulation and dispensing of cutlery articles from the stack. In embodiments, this improved escapement mechanism is much less susceptible to mechanical fatigue and deformation than traditional dispensing mechanisms, even under conditions where the cutlery dispenser is subjected to heavy usage at a busy location.

The end-on, "handle-first" construction of the disclosed dispenser system enables the housing to be only slightly wider than the width of the dispensed cutlery, thereby enabling significant space savings and other advantages over a lateral "broadside" dispenser. Certain embodiments of the present invention further provide a base unit with multiple compartments for installing and accommodating a plurality of dispensers, wherein any of the compartments can receive any of the cutlery dispensers in an interchangeable fashion. According to these embodiments, the base unit can accommodate a plurality of dispensers that are placed side-by-side, thereby presenting a stable dispenser system that is difficult to tip over, while enabling users to select their required cutlery from a single location or station within a serving area, so that a user does not need to search for multiple dispensers, and is not required to navigate through a traffic of other users as they search for dispensers that provide their desired cutlery.

In embodiments, the bottom of each dispenser is inserted endwise into a compatible slot provided in the base unit. In some of these embodiments, the bottom of each dispenser includes an engagement feature, such as a flange or protrusion that cooperates with a compatible slot in the base unit to prevent lateral tipping of the dispenser even when it is slid partway out of the base. This approach enables an operator to easily access a side panel of a dispenser, for refilling and/or for clearing the dispenser of debris and cutlery jams, even if the dispenser is located between adjacent dispensers, simply by temporarily pulling that dispenser forward partway out of the base, and then returning it fully into the base after it has been refilled and/or cleared. In other embodiments, the base unit includes one or more flanges or protrusions that engage with corresponding slots provided at the bottom of the dispenser.

According to an exemplary embodiment, a base can hold three dispensing units, which can be selected from among a variety of different available dispenser types, where the selected group of dispensers can be easily changed as needed. For example, a cafeteria operator may choose to populate the base with a fork dispenser, a knife dispenser, and a spoon dispenser, to provide users with their choice of all of the major cutlery items. Or the operator may choose to populate the cutlery base with any selection of dispensers depending on the event, and may even choose to vary the selection of dispensers during the event. For example, two fork dispensers and one knife dispenser may be installed in the base for service during a main course, and then two spoon dispensers and a fork dispenser may be installed in the base for a dessert course.

Installation of multiple vertical dispensers on a single base thereby provides a customizable, compact cutlery dispensing system with an equivalent or smaller footprint than traditional "broadside" dispenser units that dispense only a single type of cutlery, as are currently available in the marketplace. The narrow widths provided by the dispensers of the present invention thereby leave more space available in which the operator can locate additional dispensing systems and/or other consumer-directed items as needed. Alternately, the base unit may be configured with just two compartments, or even a single compartment, depending on the type of cutlery needed, particularly for use in situations where space is at a premium. It will be apparent to a person of ordinary skill in the art that the dispenser base can also be constructed with more than three compartments to accommodate additional dispensers for high-traffic situations, and/or for offering additional cutlery options.

In embodiments, the dispenser base is modular, and comprises a plurality of compartmental base units that can be interconnected by an interconnection feature that allows compartmental base units to be ganged together to derive base configurations having a plurality of compartments. For example, two compartmental base units can be connected side-by-side with one interconnection feature therebetween to provide a two-compartment dispenser base. Similarly, three or more compartmental base units can be ganged together using a plurality of interconnection features, thereby enabling any desired number of compartment base units to be ganged together as building blocks to form a base having an arbitrarily large number of compartments.

Accordingly, in various embodiments, compartmental base units are serially connected as building blocks by at least one interconnection feature located therebetween to derive a two-compartment base, a three-compartment base, a four-compartment base, a five-compartment base, a six-compartment base, or more.

In some embodiments, each compartmental base unit can be configured for operation as a stand-alone dispenser base, and can also be assembled with one or more additional compartmental base units in a serial fashion to form a chain or gang of compartmental base units via universal interconnection features that are installed between each pair of adjacent compartmental base units. It will be further realized by those skilled in the art that any two adjacent compartmental base units that are utilized as building blocks in the ganged construction of a multi-compartment base may or may not be identical to each other. For example, the first building block unit may comprise a single compartment and the second building block unit may comprise a plurality of compartments.

Embodiments of the present invention include a low-cutlery indicator that provides to an operator or user a visible indication or signal that the cutlery level in a dispenser is running low. The low-cutlery indicator includes an indicator arm and a contact arm mounted on an indicator pivot, and is positioned such that the contact arm contacts the stack of stored cutlery. Once the stack of stored cutlery falls below a certain quantity, the contact arm loses contact with the cutlery stack, thereby allowing the low-cutlery indicator to rotate about the indicator pivot so that a low-cutlery signal provided on the indicator arm becomes visible through an indicator window provided in the housing of the dispenser that informs an operator or user that the dispenser should be refilled. In similar embodiments, instead of being visible through an indicator window opening in the dispenser housing, the low-cutlery signal is visible through the housing or a section of the housing that is transparent or semi-transparent. The disclosed low-cutlery indicator is a non-electronic, purely mechanical solution that may be applied to any dispenser or dispenser system that dispenses cutlery from a vertical or inclined stack.

While reference is made herein to a single "low-cutlery" indicator, it will be understood that a plurality of such indicators is included in other embodiments, and that each indicator can provide a separate cutlery level signal to visibly show that the cutlery stack has fallen below a certain level, whether or not this fact indicates that there is a need to refill the dispenser.

The dispenser of the present invention further includes a slide track that guides each cutlery article as it transitions from the stack of stored cutlery to the dispensing position, thereby minimizing cutlery jams. The slide track includes a slide channel for guiding the handle of the bottommost cutlery article therein as it drops and slides from the stack to the dispensing position. In embodiments, for at least some of the dispensers included in the present invention, the entire cutlery article is retained in the slide channel during transit to the dispensing position. In other embodiments of the present invention, in addition to the slide channel for guiding the cutlery handles, the slide track further includes a slide surface disposed on either side of the side channel that supports the head of the cutlery article in an elevated position above the handle portion as the bottommost cutlery article slides to the dispensing position. In embodiments, the slide track further includes guide skirts that laterally confine each cutlery article after it has been released from the vertical stack, so that it falls gravitationally in a desired manner onto the slide track and arrives at the dispensing position with the required orientation.

In embodiments, other features such as handle deflectors and/or vertically hanging arms that transition down from the cutlery storage cavity into the slide track region are provided that further assist in guiding the falling cutlery item onto the slide track and/or preventing unwanted contact between the cutlery articles and other dispenser parts. In addition, the slide track is oriented at an angle that provides an optimal slope for each cutlery article to gravitationally slide downward to the dispensing position in a controlled manner, without gathering excessive momentum to cause turning, twisting, jamming, or inadvertent activation of the escapement member when the cutlery article reaches the dispensing position.

The dispenser of the present invention can be configured to dispense a specific cutlery article with or without rotation or twisting of the cutlery article, depending on the shape of the cutlery articles to be dispensed. Some of the dispensers of the present invention maintain the orientation of each cutlery article as it is delivered to the dispensing position, except that the handle is deflected downward in comparison to the head. For certain cutlery shapes, however, it is necessary to reorient each cutlery article as it is delivered to the dispensing position, so that it can be retained by the escapement member.

In particular, some dispenser embodiments that are configured to dispense knives include features that reorient each knife from a stacked, horizontal orientation into a semi-vertical or vertical orientation in the dispensing position, whereby a raised portion of the knife blade is directed upward so that it contacts the escapement member and retains the knife in the dispensing position.

More specifically, some knife dispenser embodiments include one or more alignment guides that assist in guiding and maintaining the heads of the stack of knives in a specific arrangement, whereby the head of the bottommost knife is laterally offset by a small amount from the remainder of the stack, thereby improving the singulation and rotation of the bottommost knife as it is transferred to the dispensing position. In some of these embodiments, a ramp is provided near the bottom of the alignment guide or guides that extends laterally and pushes the head of the bottommost knife away from beneath the remainder of the stack.

Embodiments further provide one or more rollers that assist in rotating and delivering a knife from its horizontal stacked position into a vertical orientation. In some of these embodiments, the bottommost knife or a portion thereof rests on or is suspended over the one or more rollers. Once the bottommost knife is released for dispensing, the end of its handle begins to fall downward, and the remainder of the knife handle and the head follow. The roller (or each roller) is supported by a pivot that is configured to rotate as the full weight of the bottommost knife is applied to the roller, which causes the knife to turn along its longitudinal axis as it falls under gravity onto the slide track.

For each of the one or more rollers, the roller pivot is configured to return the roller back to its initial position once the bottommost knife has slid beyond it and its weight has been removed from the roller. The rollers can be included separately, or together with one or more platforms or alignment guides that are configured to contact the falling knife and align it into a full 90 degree rotation or other desired tilt angle as it falls onto the slide track. In similar embodiments, one or more such platforms are utilized without a roller.

In embodiments, the slide track further includes at least one dampening surface made of a specifically chosen material that is less rigid than the remainder of the slide track and reduces bouncing and skewing of a cutlery article as it falls under gravity and impacts the slide track. In embodiments, the dampening surface is an area of reduced rigidity on the slide channel floor that diminishes bouncing when the handle of the falling cutlery strikes the slide channel. In some embodiments the dampening surface is located in an area of the slide channel floor directly underneath the proximal end of the bottommost cutlery handle. Dampening surfaces can also be configured on the slide surface so as to cushion the initial fall of the head of each bottommost cutlery article as it is dropped from the vertical stack, and/or to reduce bouncing of any or all portions of the bottommost cutlery article when it strikes the slide track.

In some embodiments, the dampening surface is configured as a thin, semi-rigid metal substrate or foil that is suspended above an open area or cavity, thereby allowing for a brief and minor deformation of the dampening surface that reduces excessive bouncing or skewing of the falling cutlery, while maintaining a low friction surface for sliding of the cutlery along the slide track to the dispensing position.

In various embodiments, the slide track mounting includes a pivot at its distal end and a latch at its proximal end that is accessible to an operator to allow the entire slide track to swing downward for cleaning, unjamming, and/or other maintenance.

A first general aspect of the present invention is a cutlery dispenser configured to serially dispense a plurality of cutlery articles, each of the cutlery articles having a handle and a head arranged at opposite ends of a long axis of the cutlery article, the head being at least one of wider and taller than the handle. The cutlery dispenser includes a housing having a front, a rear, two sides, a top, and a bottom, a front-facing width thereof being smaller than a side facing depth thereof, a dispenser cavity located in an upper region of the dispenser within the housing, the dispenser cavity being configured to contain a vertical stack of the cutlery articles, the vertical stack being terminated at its bottom end by a bottommost cutlery article of the vertical stack, an escapement mechanism configured to retain a first cutlery article of the plurality of cutlery articles in a dispensing position whereby the handle of the first cutlery article extends beyond the front of the dispenser housing, the escapement mechanism being configured such that removal by a user of the first cutlery article from the dispenser by grasping and pulling of the handle thereof actuates the escapement mechanism, causing the bottommost cutlery article to be singulated from the stack and gravitationally transitioned to the dispensing position, while a remainder of the stack is retained in the dispenser cavity, whereby the bottommost cutlery article becomes a replacement first cutlery article, and a next cutlery article in the stack becomes a replacement bottommost cutlery article, and a downward sloping slide track, wherein the dispenser is configured to rotate the bottommost cutlery article about its long axis from a horizontal to a vertical orientation as it falls from the stack onto the slide track, so that the head of the bottommost cutlery article extends upward above the slide track and is retained by the escapement mechanism in the dispensing position.

In embodiments, the escapement mechanism comprises at least three pivoting members interconnected by at least three distinct pivots. In some of these embodiments the escapement mechanism comprises an escapement member configured to retain the first cutlery in the dispensing position by contact between the head of the first cutlery article and a bottom end of the escapement member, a lower retaining surface cooperative with the escapement member and configured to support a proximal end of the bottommost cutlery while a distal end of the bottommost cutlery is supported by a supporting surface proximate a distal end of the track, a swing member pivotally cooperative with the escapement member, and an upper retaining surface cooperative with the swing member and positioned at an elevation between the proximal ends of the handles of the bottommost cutlery article and the next cutlery article in the vertical stack, the escapement mechanism being configured such that when the handle of the first cutlery article is grasped by the user and the first cutlery article is removed from the dispenser, the bottom end of the escapement member is pulled forward by the head of the first cutlery article as the first cutlery article passes beneath the escapement member, the first retaining surface is withdrawn from beneath the proximal end of the bottommost cutlery article, the swing arm is actuated by the escapement member, causing the second retaining member to pivot and be inserted beneath the proximal end of the handle of the next cutlery article, the bottommost cutlery article falls downward from the vertical stack onto the slide track and is guided by the slide track as it slides gravitationally to the dispensing position, the escapement member recovers from actuation, thereby retaining the bottommost cutlery article as a replacement first cutlery article in the dispensing position, and upon recovery of the escapement member, the lower retaining surface is reasserted beneath the proximal end of the handle of the next cutlery article, and the upper retaining surface is withdrawn from beneath the proximal end of the handle of the next cutlery article, whereby the proximal end of the next cutlery article falls onto the lower retaining surface, the next cutlery article thereby becoming a replacement bottommost cutlery article.

In any of the above embodiments, the escapement mechanism can further comprise a coil return spring configured to return the escapement mechanism to a rest configuration after actuation thereof. In some of these embodiments, the escapement mechanism comprises a plurality of coil return springs.

In any of the above embodiments, upon being singulated, the bottommost cutlery article can be gravitationally guided by the downward sloping slide track to the dispensing position, while a remainder of the vertical stack is retained in the dispenser cavity, and the slide track can include a slide channel configured to laterally confine the handle and head of the bottommost cutlery article as the bottommost cutlery article gravitationally slides to the dispensing position. In some of these embodiments the slide channel further includes a dampening surface configured to reduce bouncing and skewing of the bottommost cutlery article as the proximal end of the bottommost cutlery article falls onto the dampening surface. And in some of these embodiments the cutlery dispenser further comprises a damping space provided beneath the dampening surface that enables the dampening surface to elastically expand into the damping space when the proximal end of the bottommost cutlery article falls onto the dampening surface.

Any of the above embodiments can further include at least one pivoting support that is vertically impacted by the bottommost cutlery article when the bottommost cutlery article is released from the stack, the pivoting support being configured to pivot in response to a gravitational force applied thereto by the bottommost cutlery article, thereby inducing a rotation of the bottommost cutlery article about its long axis.

In any of the above embodiments, the slide track can further comprise at least one inwardly sloped surface configured to guide the bottommost cutlery article from a partially rotated configuration to a fully rotated configuration as it falls into the slide channel.

In any of the above embodiments, before the bottommost cutlery article is singulated and released from the stack, a distal end of the head thereof can be supported by a head-supporting surface that extends only partway beneath the distal end, such that when a proximal end of the handle of the bottommost cutlery article is released by the escapement mechanism, the head-supporting surface imparts a rotational torque to the bottommost cutlery article about its long axis as the bottommost cutlery article falls toward the slide track.

Any of the above embodiments can further include a cutlery article quantity indicator that includes an indicator arm pivotal about an indicator pivot between an engaged position and an unengaged position, a contact arm cooperative with the indicator arm and configured to laterally contact the cutlery article stack at an indicator height of the cutlery article stack, the contact arm when in contact with the cutlery article stack maintaining the indicator arm in the engaged position, and an indicator signal cooperative with the indicator arm and configured to be externally visible when the indicator arm is in the unengaged position, and to be externally not-visible when the indicator arm is in the engaged position, the cutlery article quantity indicator being operable such that when the cutlery article stack is reduced in height to below the indicator height, the contact arm is released from contact with the cutlery article stack, causing the indicator arm to pivot to the unengaged position, thereby causing the indicator signal to become externally visible.

In some of these embodiments the dispenser front includes an indicator window through which the indicator signal is visible when the indicator arm is in the unengaged position.

In any of these embodiments, the contact arm can be configured to laterally contact a proximal end of at least one cutlery article included in the cutlery article stack when the indicator arm is in the engaged position.

In any of these embodiments, said indicator height can be set at a sufficient level from said bottommost cutlery article in said cutlery article stack to provide at least one cutlery article remaining in said cutlery article stack after the indicator signal is activated to be visible.

Any of these embodiments can include a plurality of cutlery article quantity indicators having contact arms that are configured to be released at a corresponding plurality of different indicator heights of the cutlery article stack.

A second general aspect of the present invention is a cutlery dispensing system comprising a base, said base comprising a base front, a base rear, left and right base sides, and at least one base compartment, wherein each of the base compartments comprises a first retaining feature, and a cutlery dispenser according to any embodiment of the first general aspect, said cutlery dispenser including a second retaining feature proximate said dispenser bottom, said cutlery dispenser being configured for installation in said base by a mutual engagement of said first and second retaining features as said dispenser is inserted into one of said at least one base compartment in said base, wherein said mutual engagement of said first and second retaining features prevents tipping of the cutlery dispenser after said installation of the cutlery dispenser in said base.

In embodiments, the first and second retaining features are configured to allow said cutlery dispenser to be slidingly inserted into the base horizontally during said installation, and to be slid partway out from the base to provide access to at least said dispenser first side for refilling the cutlery dispenser after said plurality of cutlery articles has been at least partially depleted.

In any of the above embodiments, the base can comprise a first compartment base unit that includes the at least one base compartment, said first compartment base unit comprising a unit attachment feature that enables a side of the first compartment base unit to be attached to a side of a second compartment base unit. And in some of these embodiments the first and second compartment base units include different numbers of compartments.

It should be noted that the dispenser of any of the embodiments of the first general aspect can be compatible for installation in any of the bases of the second general aspect.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is a novel system and method for dispensing cutlery that provides improved assurance of sanitation, ease of retrieval of a plurality of different cutlery types such as forks, spoons, and knives from a single station without requiring a user to move or walk from dispenser to dispenser, a compact footprint and space savings, a low-cutlery signal that can be seen from a distance, ease of refilling, purely mechanical auto-actuation of next cutlery items via gravity without requiring an electrical connection or periodic replenishment of batteries, ease of maintenance, easy adaptability to meet specific cutlery requirements, and many other improvements over prior art dispensers.

While the present invention is described herein with reference to only a few specific embodiments detailing dispensing of disposable forks, knives, and spoons, it should be understood that the description herein is illustrative of the invention and is not to be considered as limiting the invention to the specific embodiments or features that are shown or described. The invention and representative embodiments are capable of various modifications and variations that can be conceived by one of skill in the art without undue experimentation for dispensing other types of cutlery, such as sporks, stirrers, or chopsticks, and all such modifications and variations are deemed to be included within the scope of the invention.

Furthermore, both disposable and permanent ware cutlery items can be dispensed by the system and method of the current invention. In general, it should be understood that the present invention can be adapted for dispensing substantially any elongate object that includes a handle portion and a head portion. Accordingly, the dispenser of the present invention is also applicable to dispensing of items of elongate shape such as various medical and dental tools, as well as other objects that are not directed to the consumption of food.

It will also be realized by those skilled in the art that the disclosed dispenser can be of a size and shape in accordance with the size and shape of the cutlery to be dispensed, and that the cutlery storage capacity can be easily adjusted according to the needs of specific applications. The following description and accompanying drawings provide further details and examples of the invention and its embodiments, wherein like numerals represent like parts.

Figure 1A:
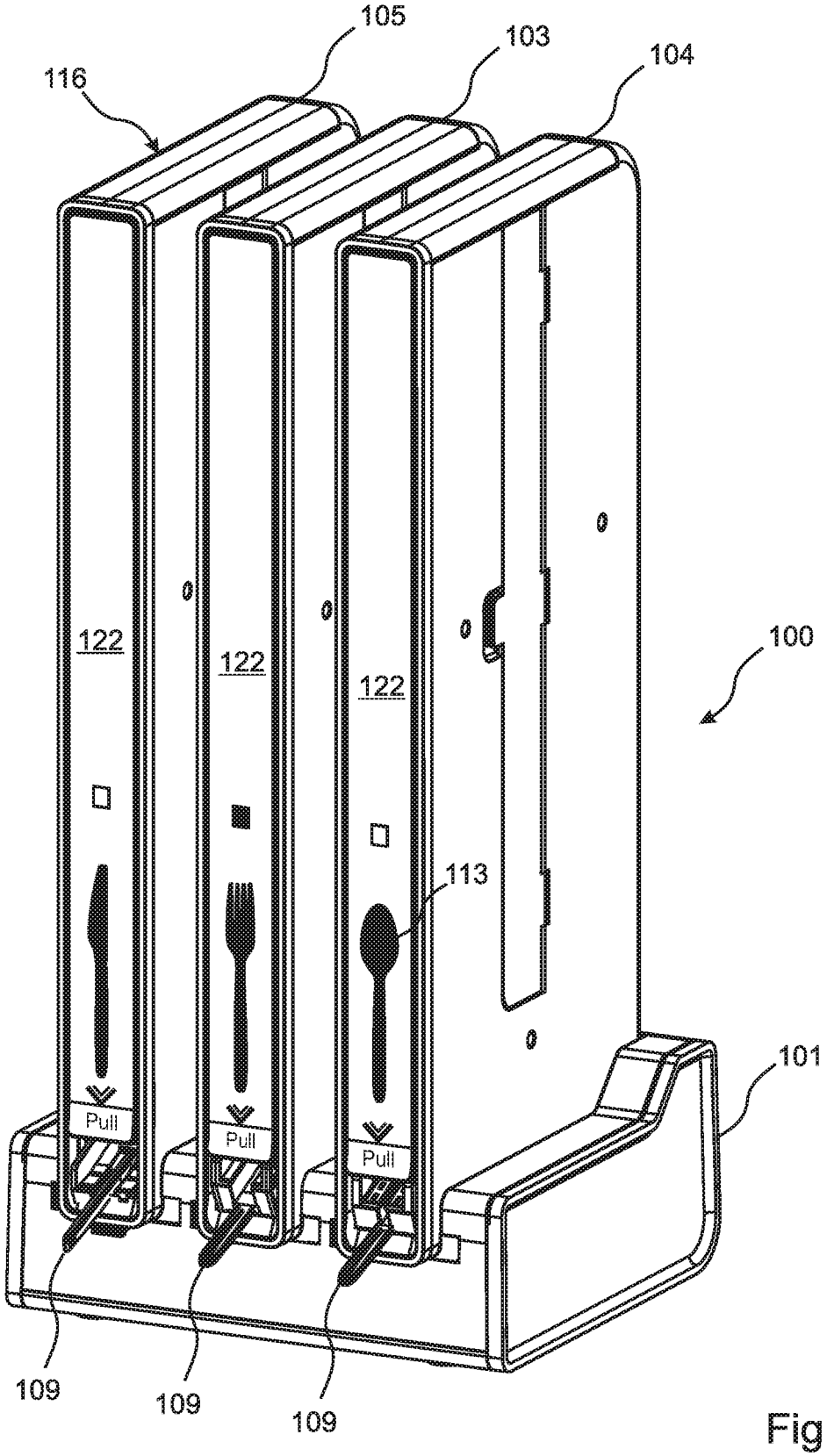
FIG. 1A is a perspective view of a dispenser assembly according to an embodiment of the present invention that comprises three cutlery dispensers attached to a base.
Figure 10A:
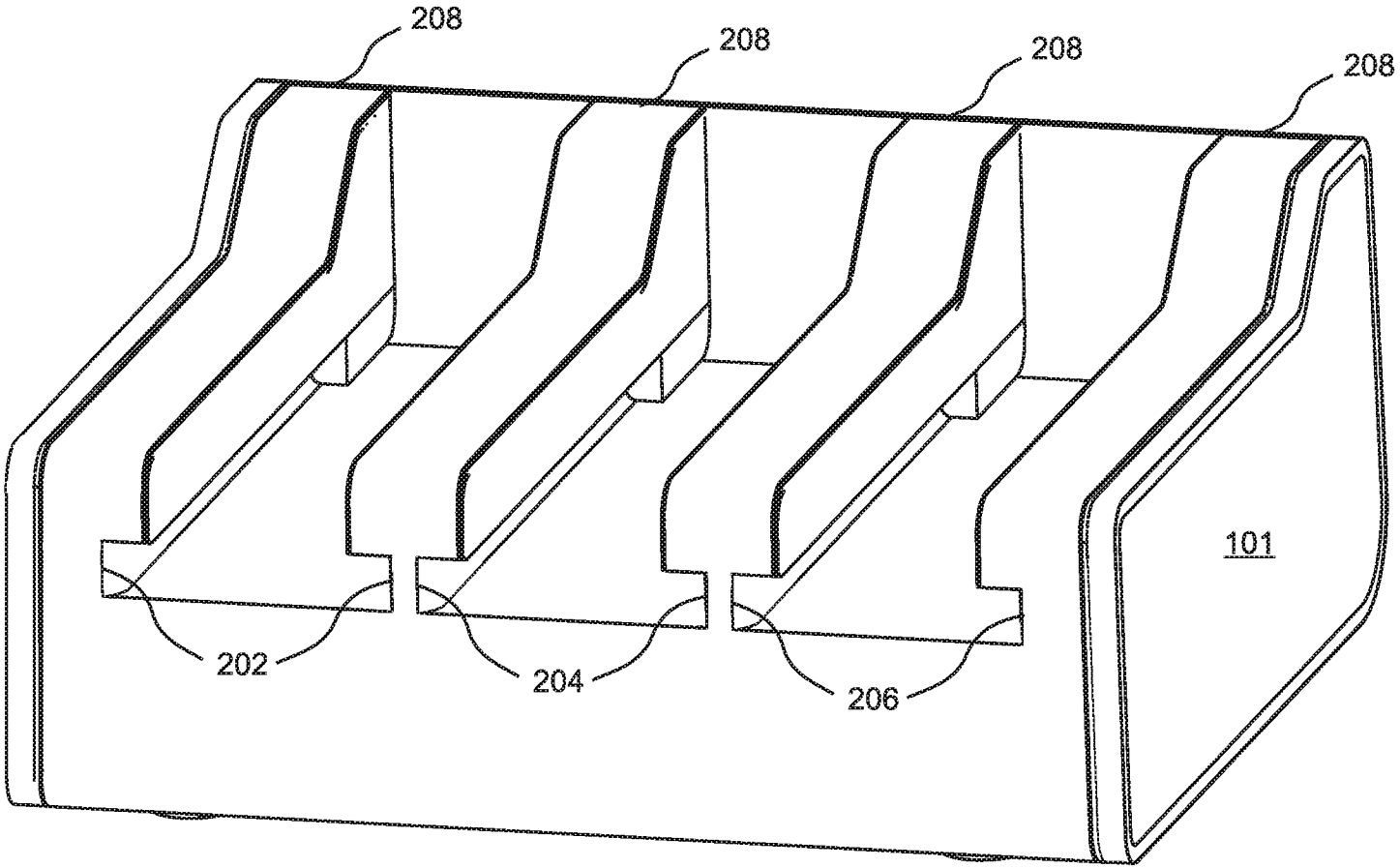
FIG. 10A is a perspective view of a 3 compartment base that can accommodate three dispensers.

FIGS. 1A through 1D present external views of an embodiment of the disclosed dispenser system 100. FIGS. 10A through 10G present views of separate components of dispenser system 100. With reference to FIG. 1A, the illustrated dispenser system 100 embodiment includes a common base 101 with three compartments for accommodating three cutlery dispensers. In the illustrated embodiment, the installed dispensers are a fork dispenser 103, a spoon dispenser 104, and a knife dispenser 105. The base 101 without the installed dispensers is shown in FIG. 10A. The base 101 features side rails 208 extending from the front to the back of the base 101 on either side of each of the three compartments. Each compartment in the base 101 shown in FIG. 10A includes a pair of channels or slots, namely slots 202, 204 and 206. Each slot in the base 101 is configured for receiving a corresponding engagement feature provided in the dispenser as discussed below. FIGS. 10B-10G are perspective and front views of the fork, spoon and knife dispensers respectively prior to their installation in the base 101.

The cutlery dispensers 103, 104 and 105 and base 101 have a modular construction to allow interchangeability of cutlery dispensers and their relative positions within the base 101. For instance, the dispensers 103, 104, 105 can be arranged in three compartments as shown in FIG. 1A from left to right as knife, fork, and spoon (designated in abbreviated form as KFS), or in any other arrangement sequence such as KSF, FKS, FSK, SFK, and SKF. In addition, depending on the type of food being served at an event, base 101 can be equipped with any combinations of dispensers, such as fork dispensers only (FFF), spoon dispensers only (SSS), knife dispensers only (KKK), fork and knife dispensers (FFK or FKK), fork and spoon dispensers (FFS or FSS) or any other permutation or combination of dispensers.

Due to the narrow widths of the three dispensers 103, 104 and 105, the entire dispensing system in FIG. 1A is approximately equal in width to a single lateral or "broadside" dispenser of the prior art, thus offering a nearly 3-fold space advantage over a broadside dispenser. It will also be realized by those skilled in the art that the base 101 can be expanded to include additional compartments for accommodating more than three dispensers. Alternately, the base 101 can be constructed with a single compartment for accommodating a single dispenser, or with two compartments for accommodating two dispensers.

Figure 10B:
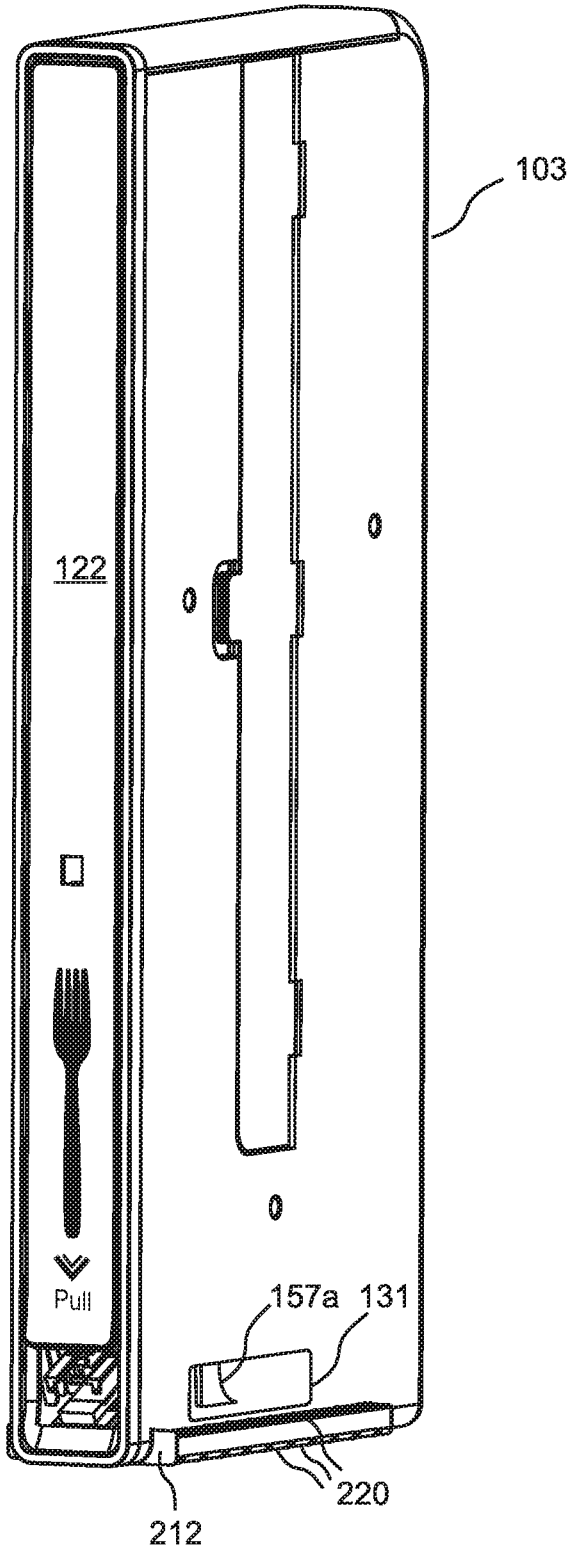
FIG. 10B is a perspective view of a fork dispenser compatible with but shown outside of the base of FIG. 10A.
Figure 10C:
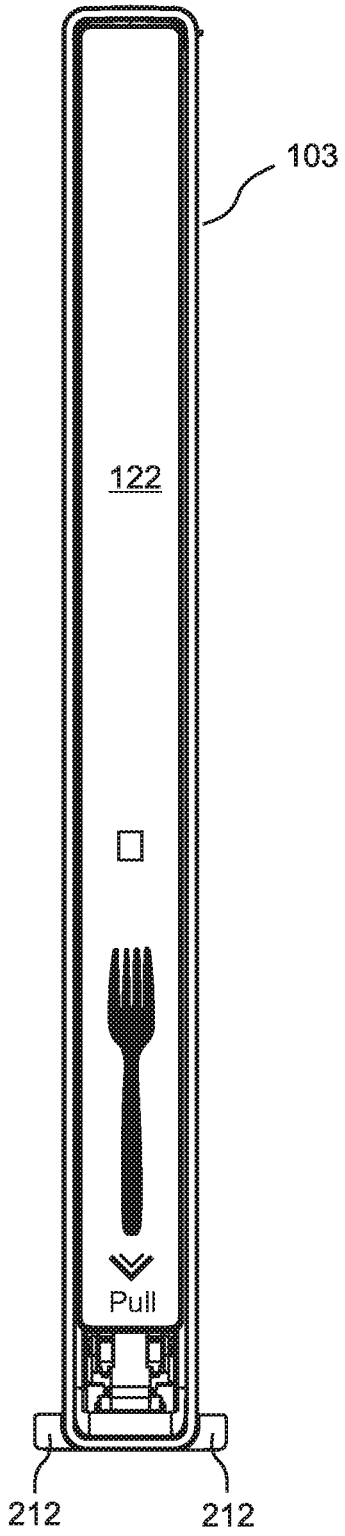
FIG. 10C is a front view of the fork dispenser of FIG. 10B.
Figure 10D:
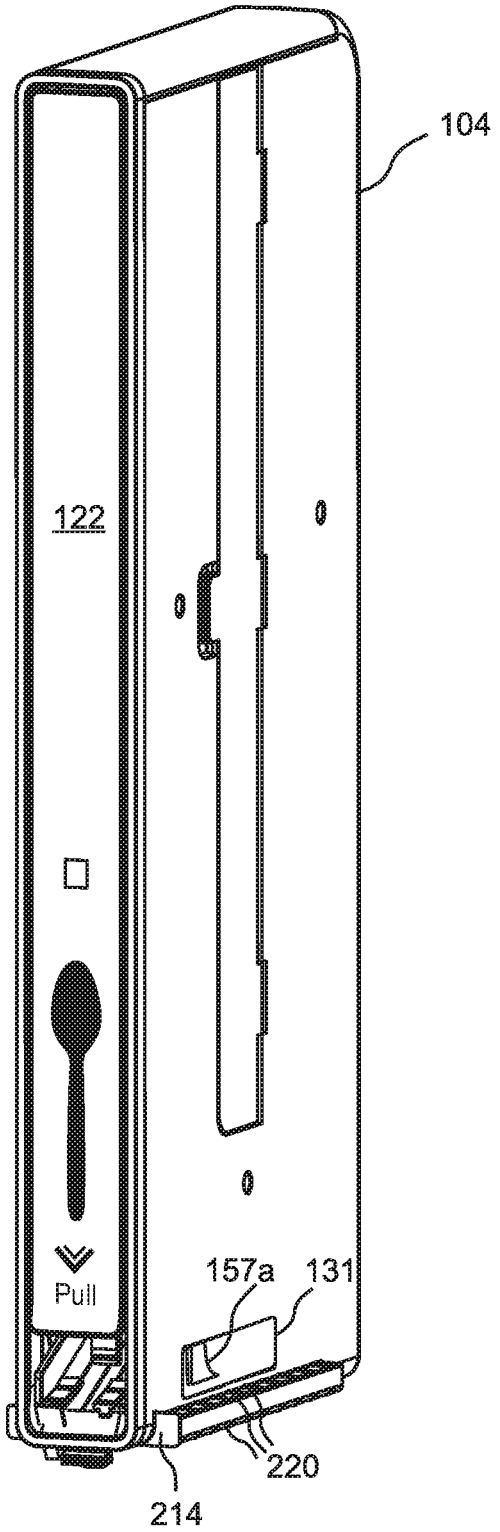
FIG. 10D is a perspective view of a spoon dispenser compatible with but shown outside of the base of FIG. 10A.
Figure 10E:
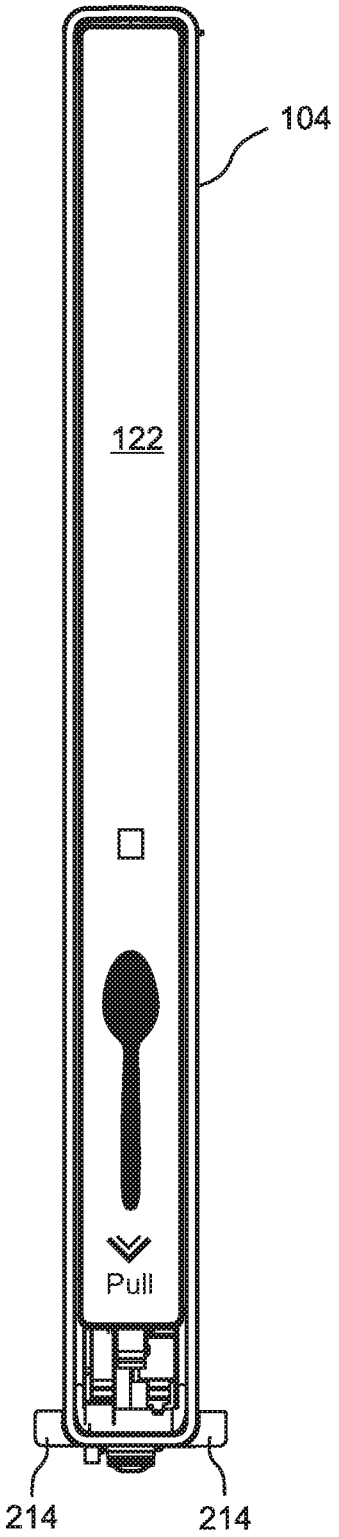
FIG. 10E is a front view of the spoon dispenser of FIG. 10D.
Figure 10F:
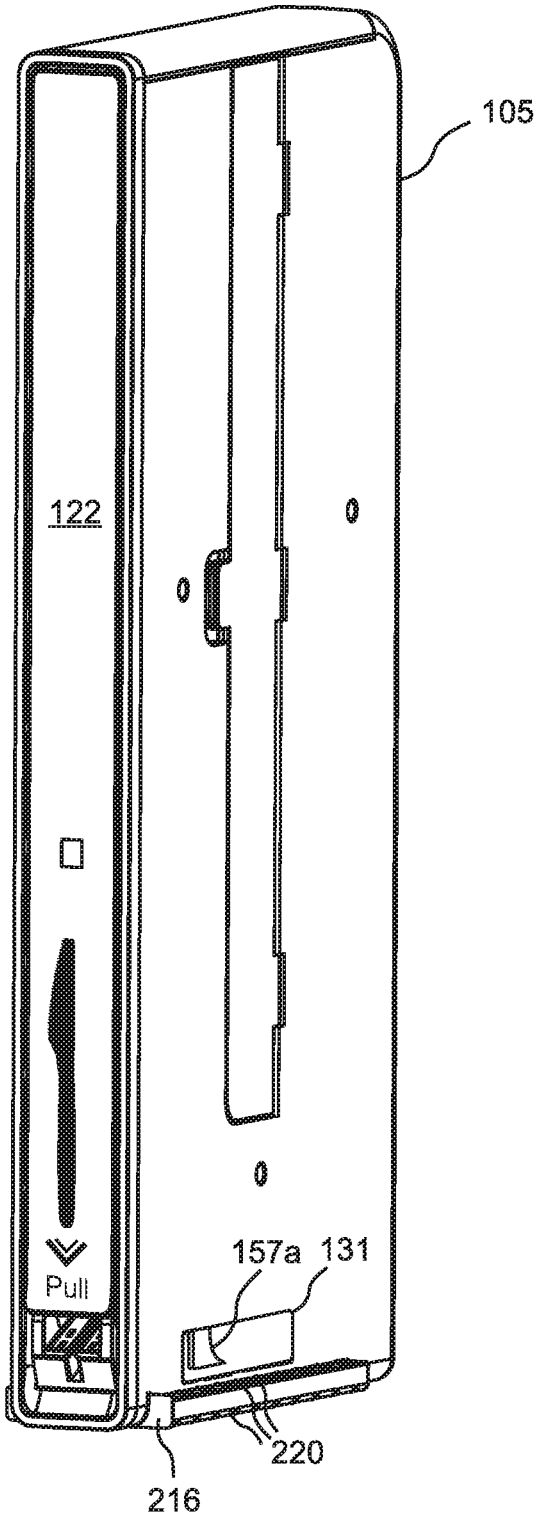
FIG. 10F is a perspective view of a knife dispenser compatible with but shown outside of the base of FIG. 10A.
Figure 10G:
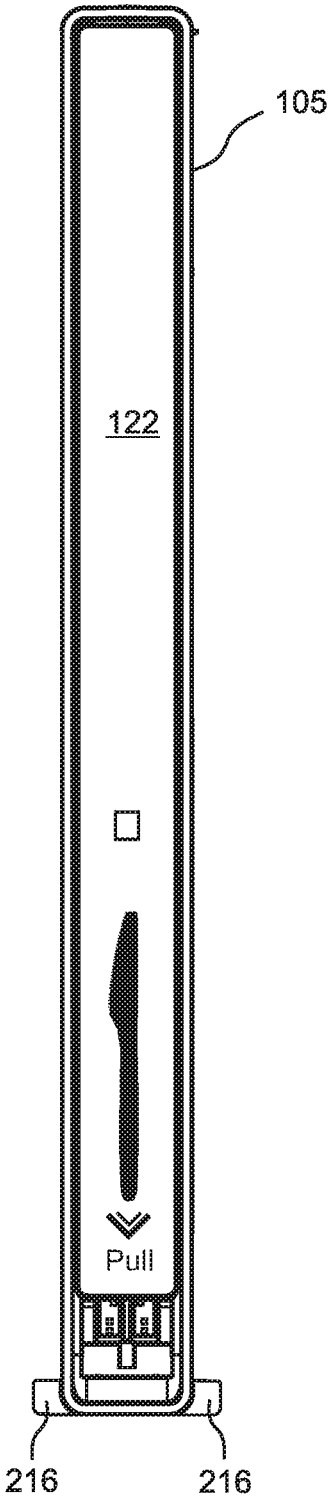
FIG. 10G is a front view of the knife dispenser of FIG. 10F.

In the illustrated embodiment, each of the dispensers 103, 104, and 105 includes an engagement feature at the bottom thereof, which cooperatively engages with corresponding channels or slots provided in each compartment of the base 101, for sliding the dispensers into and out of the base in a stable manner and keeping them upright within base 101. As shown in FIGS. 10B and 10C, the fork dispenser 103 includes an engagement feature or flange 212 on either side of its bottom for inserting and aligning it into one of the slots 202, 204 or 206 of the base 101. Similarly, spoon dispenser 104 and knife dispenser 105 have respective engagement features or flanges 214 and 216 that are configured to engage with any of the slots 202, 204 or 206 of the base 101 (see FIGS. 10C to 10F). Accordingly, any one of these dispensers 103, 104, 105 can be fully installed within the base 101 by inserting and aligning the dispenser engagement features within the channels or slots provided in any of the compartments of the base 101.

Once installed in the dispenser base 101, any one of the installed dispensers 103, 104, 105 can be partially slid out of its compartment for the purpose of providing access for refilling cutlery into the dispenser. Any of the dispensers 103, 104, 105 can also be completely removed from the base 101 by sliding it fully out from its channel or slot, as may be necessary, for example, when replacing or swapping a dispenser. It will be appreciated by those skilled in the art that each of the dispensers 103, 104 and 105 can be partially pulled out of base 101 for cutlery refilling purposes, clearing jams and debris, etc., and then reinstalled within the base 101, without unduly disturbing the cutlery stacks held within the dispensers and while retaining the longitudinal axes of the stacked cutlery articles in a mutually parallel relationship, thus facilitating trouble-free dispensing and maintenance.

The engagement features 212, 214, 216 included on the bottoms of the respective dispensers may further include a series of raised ribs or ridges 220 that ensure proper guidance and alignment of the engagement features 212, 214, 216 within the channels slots 202, 204, 206 in the base 101. The engagement features 212, 214, 216 may be constructed of materials that reduce friction between the engagement features 212, 214, 216 and the cooperative channels provided in the base 101.

Similarly, in various embodiments other engagement means are provided for cooperatively installing the dispenser in the base in a secure and stable manner that avoids inadvertent tipping of the dispenser during use or loading. It will be realized that the engagement features can be reversed such that the channels or slots are provided on the dispenser for cooperative engagement with protrusions provided in the base. In some embodiments, other locking features or mechanisms are included for retaining the dispenser in the base, such as a snap lock, a screw lock, a latch, or a toggle on the dispenser and/or on the base. In various embodiments, any of a variety of guiding features are provided, such as free-wheeling rollers or bearings provided on the dispenser and/or on the base, for facilitating alignment and reducing friction.

With continued reference to FIG. 1A, the dispensers 103, 104, and 105 of the dispenser system 100, are shown with respective "first" cutlery articles indicated by numeral 109 in "dispensing positions," such that the respective handles of the first cutlery articles 109 extend outward from the dispenser front panels, wherefrom they can be easily grasped by a consumer and removed from the respective dispensers. When in the dispensing position, the first cutlery article 109 in each dispenser is oriented with its handle extending outward from the dispenser exit area, so that it is readily apparent and accessible to the user for grasping and removal. The act of grasping and removing the first cutlery article from one of the dispensers 103, 104 and 105, mechanically activates an escapement mechanism 150 (see FIG. 2B) that releases a replacement "bottommost" cutlery article from the stack for transfer to the dispensing position, where it can be grasped and removed by a next user or consumer.

Since a consumer grasps and removes the cutlery directly from the dispenser exit area, there is no external lever to operate or receiving tray or bin, thus eliminating the possibility of cross contamination due to cutlery falling into a previously contaminated bin or tray, or by contacting a lever that has been touched by a plurality of users. Furthermore, once a user retrieves a cutlery article directly from the dispenser, the user is unlikely to actuate the dispenser again by mistake, as typically happens with lever-actuated dispensers.

The front plates 122 of each of the dispensers 103, 104, and 105 can include identifying indicia 113 that indicate the type of cutlery articles residing in each dispenser, and can further include brand names, logos, images, graphics, and/or directions (see FIGS. 1A-1B, 1F-1K, and 10B to 10G). The front plates 122 can be removably attached to the dispenser with standard attachment features, such as snap fits, friction fit posts, screws, hook-and-loop, etc. as are known in the art. Removable front plates 122 can also facilitate customization of the front plate and updating its appearance and messaging for various customers, restaurants, cafeterias, events, and commercial settings, and/or for replacing a worn or damaged front plate. In other embodiments, the front plate includes a feature such as a slot or transparent pocket into which graphics can be inserted and removed, so as to flexibly change the displayed colors, logos, and/or other indicia.

The top assemblies 116 of the dispensers 103, 104, 105 are also visible in FIG. 1A. As is discussed in more detail below with reference to FIG. 1E, the top assemblies 116 comprise a top loading door 134 mounted to the dispenser by a hinge 138 and fastened shut by a latch 136.

Figure 1B:
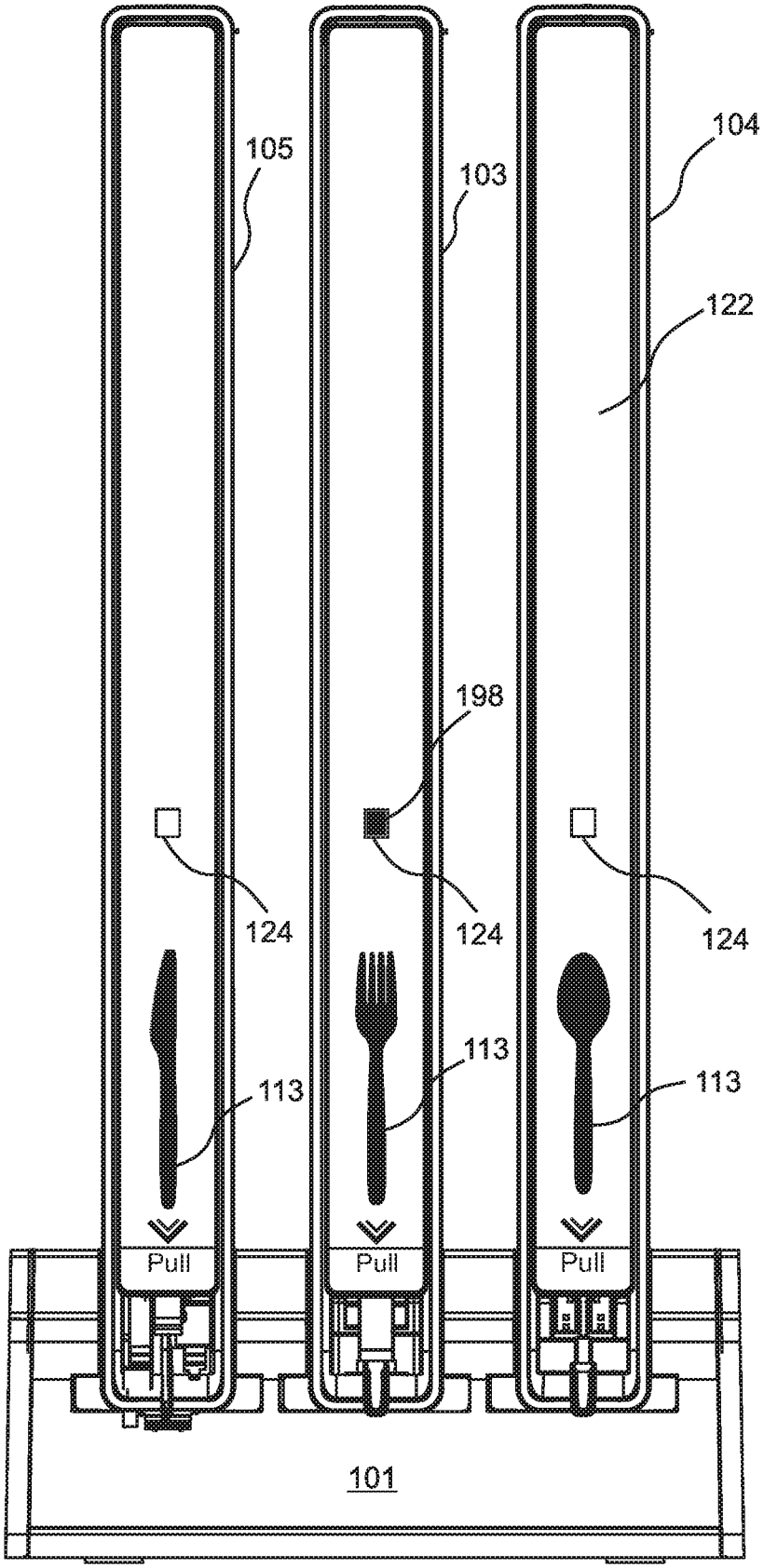
FIG. 1B is a front view of the dispenser assembly of FIG. 1A, with each dispenser having a piece of cutlery loaded into the dispensing position.

In the embodiment of FIGS. 1A through 1D, the dispensers 103, 104 and 105 also include cutlery level indicators that function as "low-cutlery" or refill prompters. As shown in FIG. 1B, a low-cutlery indicator window 124 is located on the front plate 122 of each dispenser 103, 104, and 105, to provide a visible indication that allows an operator or user to easily determine from a distance if the supply of cutlery held within the dispenser is nearly exhausted and the dispenser needs to be refilled. Specifically, if a low-cutlery signal 198 (shown only on dispenser 103 in the figure) is visible through the cutlery indicator window 124, an observer is able to quickly ascertain that the quantity of cutlery remaining in a dispenser is below a certain level, and thereby quickly determine if the dispenser needs to be refilled.

The embodiment of FIG. 1B includes only a single cutlery indicator window 124 on each dispenser 103, 104, or 105. As shown in FIG. 1B, the low-cutlery signal 198 of the fork dispenser 103 is visible within the indicator window 124 as a dark colored portion. In other embodiments, the low-cutlery signal 198 is provided as a bright colored portion that is readily conspicuous from a distance, so that a restaurant employee or cafeteria attendee can promptly refill the dispenser. Alternately, the low cutlery signal can be configured to display a written message, such as "LOW" or "REFILL," or a pictorial image that informs an operator that the quantity of cutlery remaining in the dispenser is below a certain level and the dispenser needs to be refilled.

Other embodiments provide more than one cutlery indicator window arranged at various levels or heights on the front of each dispenser, for example having different colored indicators, so as to provide a series of visual signals of remaining quantities as the cutlery articles are consumed from the dispenser, such as GREEN indicating a full dispenser, YELLOW indicating a medium level, and RED indicating a low level whereat the dispenser should be refilled. Still other embodiments may include a transparent or translucent strip or window through which the cutlery level can be viewed as cutlery is depleted or removed from the dispenser.

Figure 1C:
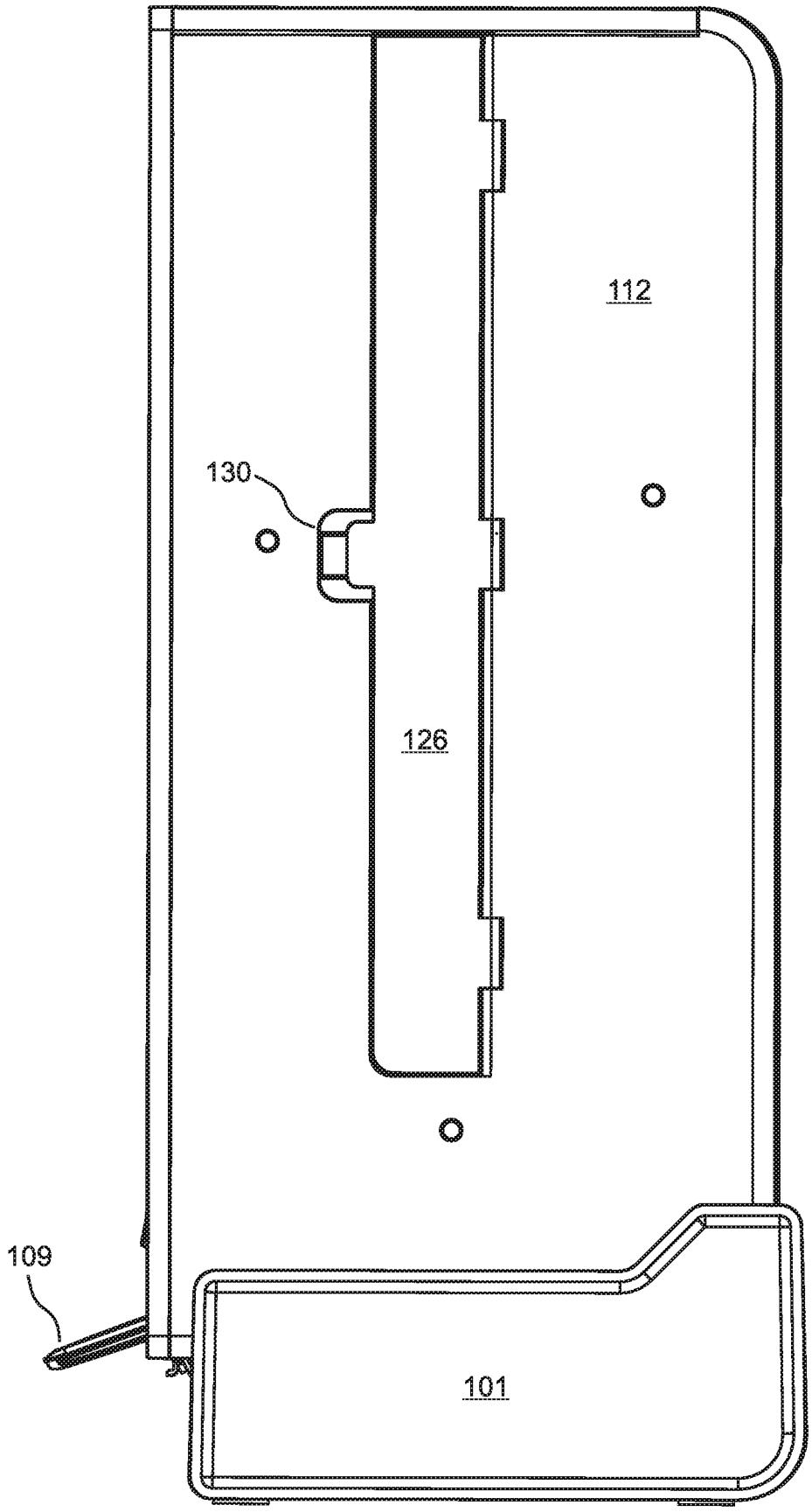
FIG. 1C is a right side view of the dispenser assembly of FIG. 1A, showing an access door.

FIG. 1C is a side view of a first side 112 of a dispenser from the dispenser assembly 100 as viewed from the right of FIG. 1A, which in the illustrated embodiment includes an access door 126 and an access door latch 130. The access door 126 may be opened so as to allow access to an internal dispenser cavity 140, and is preferably translucent or fully transparent, thereby enabling an operator to visually assess the quantity of cutlery within a dispenser. The access door 126 spans the vertical length of the internal dispenser cavity 140 (visible in FIG. 2A), thereby allowing an operator physical access to the dispenser cavity 140 so as to assist in loading of replenishment cutlery and/or for clearing any items that may accidentally have become lodged therein.

Figure 1D:
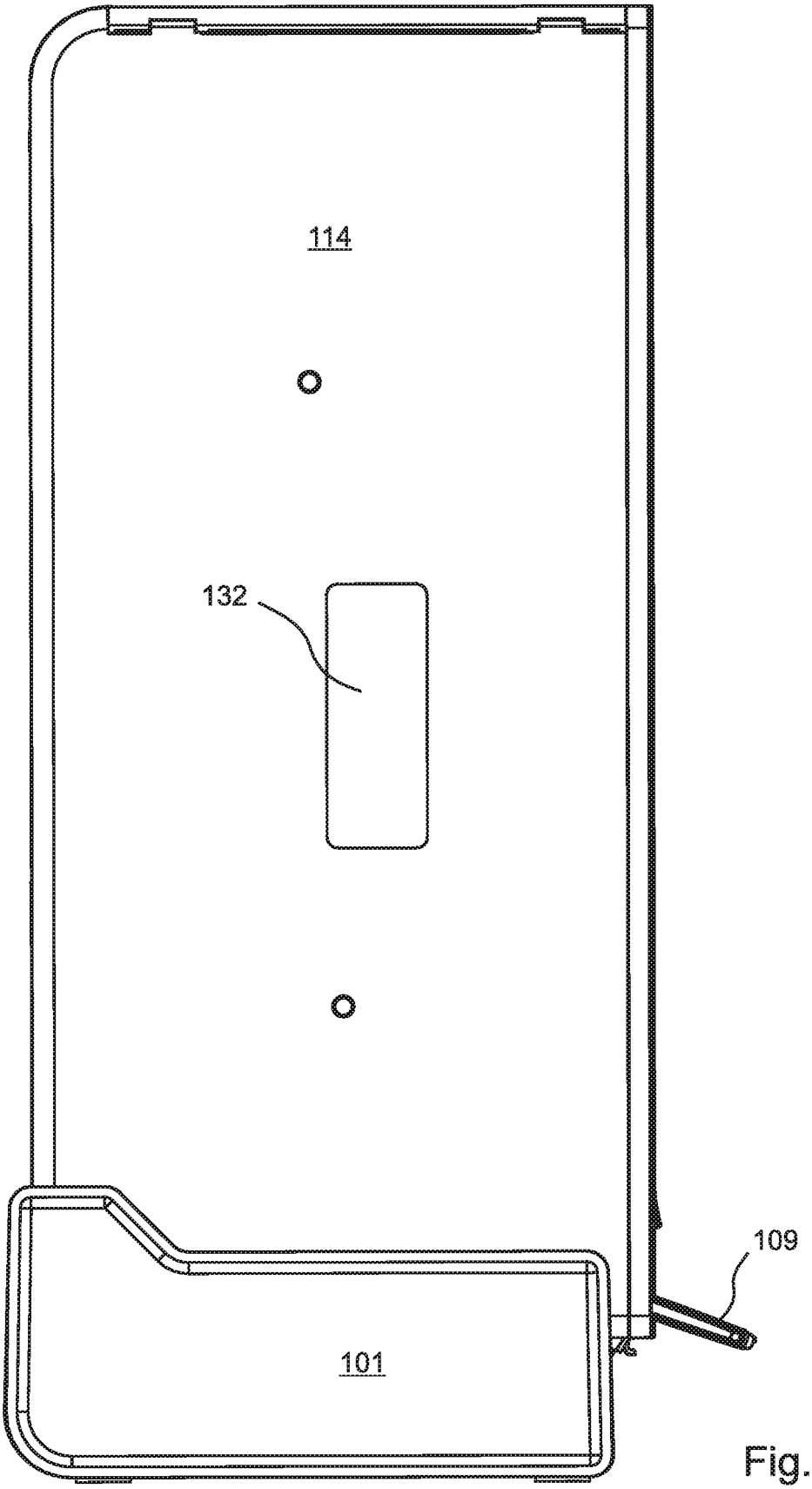
FIG. 1D is a left side view of the dispenser assembly of FIG. 1A, showing a viewing window.

FIG. 1D illustrates a side view of a second side 114 of a dispenser from the dispenser assembly 100 as viewed from the left of FIG. 1A, which in the illustrated embodiment includes a view window 132 near the bottom region of the dispenser. The view window 132 provides visual access to the internal dispenser cavity 140, thereby allowing the operator to ascertain the general quantity of cutlery remaining in the dispenser and whether the dispenser needs to be refilled. It will be realized that one or more windows of any desired size and location can be provided on the second side 114 of the dispenser. Alternately, view window 132 on second side 114 can be in the form of an access door similar to the access door 126 on first side 112. Thus, the first side 112 and second side 114 of any of the dispensers shown in FIG. 1A, may include any combination of access door(s) and/or window(s), provided however that at least one of the sides enables physical access to the internal dispenser cavity 140 for cutlery loading, refilling, and general maintenance.

Figure 1E:
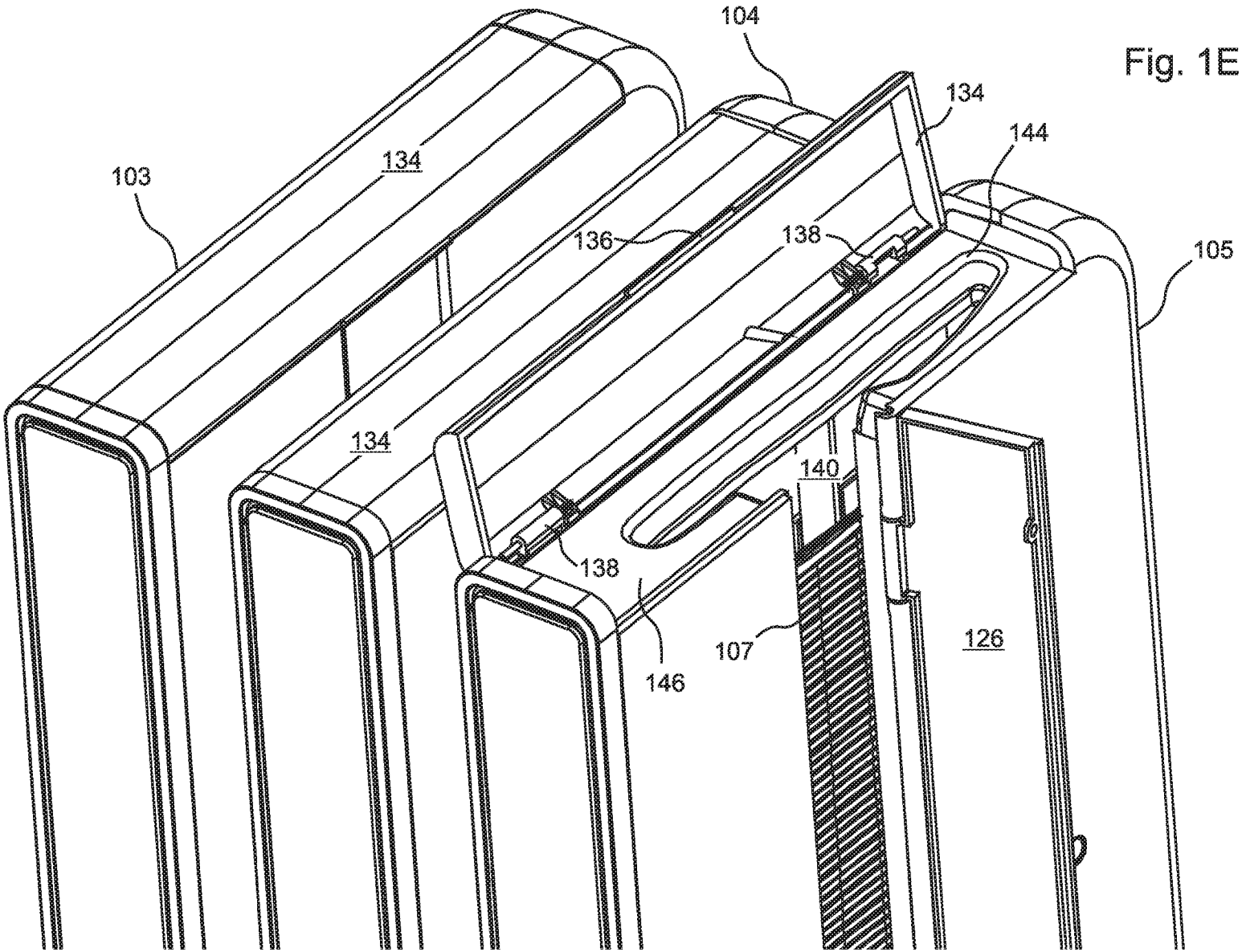
FIG. 1E is a top view of the dispenser assembly, showing the cutlery loading doors of each dispenser.

FIG. 1E presents a partial top perspective view of the dispenser assembly 100, wherein each of the dispensers 103, 104, and 105 includes a top loading door 134 that allows loading of cutlery, and the knife dispenser 105 has been installed at the right of the base 100 and is shown with its top loading door 134 and side access door 126 open. The top loading door 134 and side access door 126 may be opened by a user to uncover a loading guide opening 144 provided in a loading guide 146, and to access the internal dispenser cavity 140, so that a cutlery stack 107 can be inserted through the loading guide opening 144 into the dispenser cavity 140. In the figure, a stack of knives 107 is visible through the side door opening in FIG. 1E.

In the illustrated embodiment, each top loading door 134 is connected to its dispenser by a pair of hinges 138. A latch 136 is located on the opposing side of the hinges 138 to allow a user to open the top loading door 134. The latch 136 can comprise a simple lift tab, or can be any other style of latch, release, or locking mechanism known in the art. The arrangement of the hinges 138 and the latch 136 is configured to allow the top loading door 134 and access door 126 to collaboratively provide convenient access to the internal dispenser cavity 140 for loading a cutlery stack 107 therein. In other embodiments, one or more hinges 138 are positioned at the back of each dispenser 103, 104, or 105, with the latch 136 being correspondingly opposed from the hinges and located at the front of the dispenser, thereby allowing the top loading door to be lifted and opened from the front of the dispenser instead of from a side.

Figure 1F:
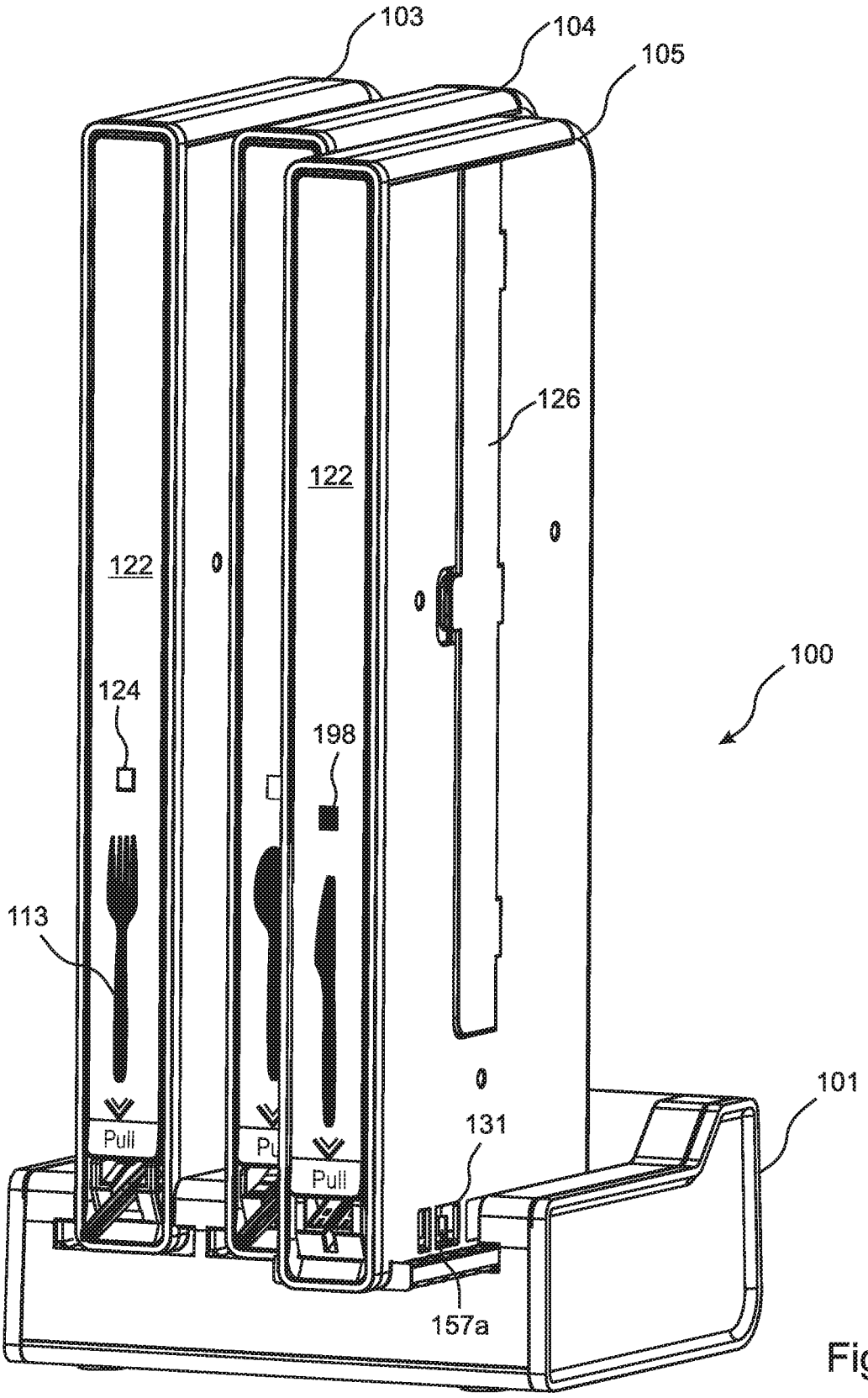
FIGS. 1F through 1K are perspective views that illustrate an embodiment of the disclosed cutlery dispenser during various stages of refilling and preparation for dispensing.
Figure 1G:
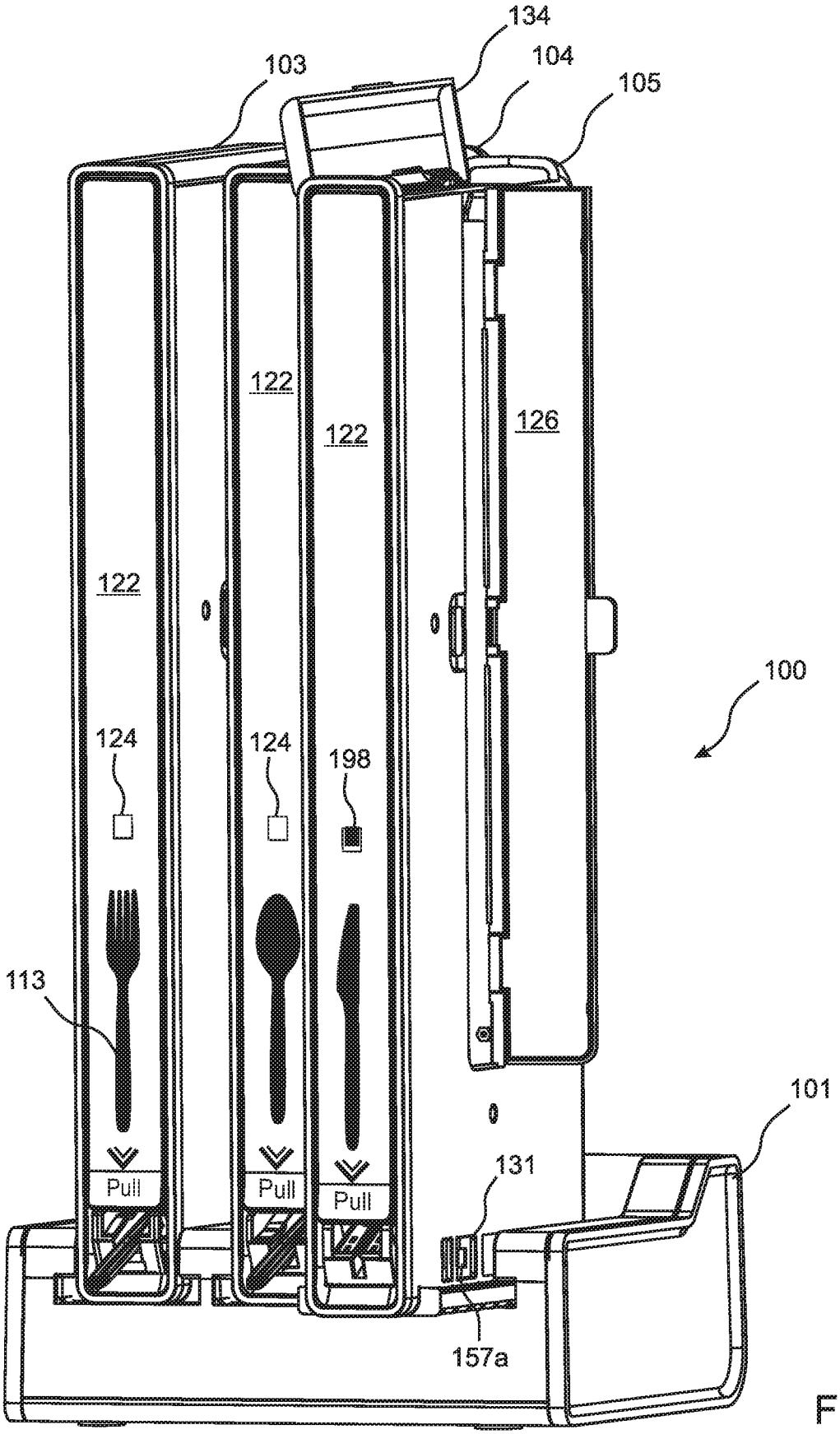
Figure 1H:
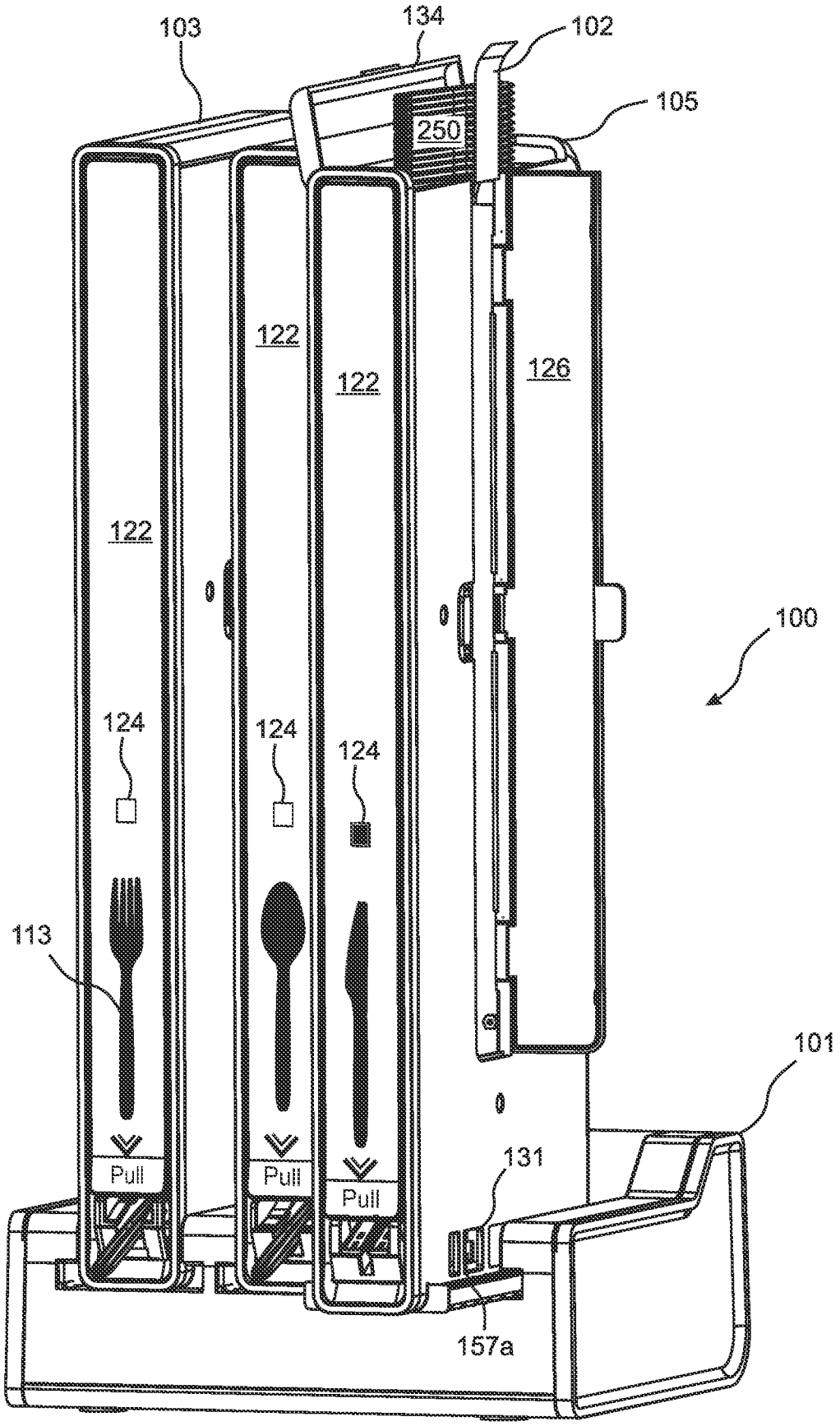
Figure 1I:
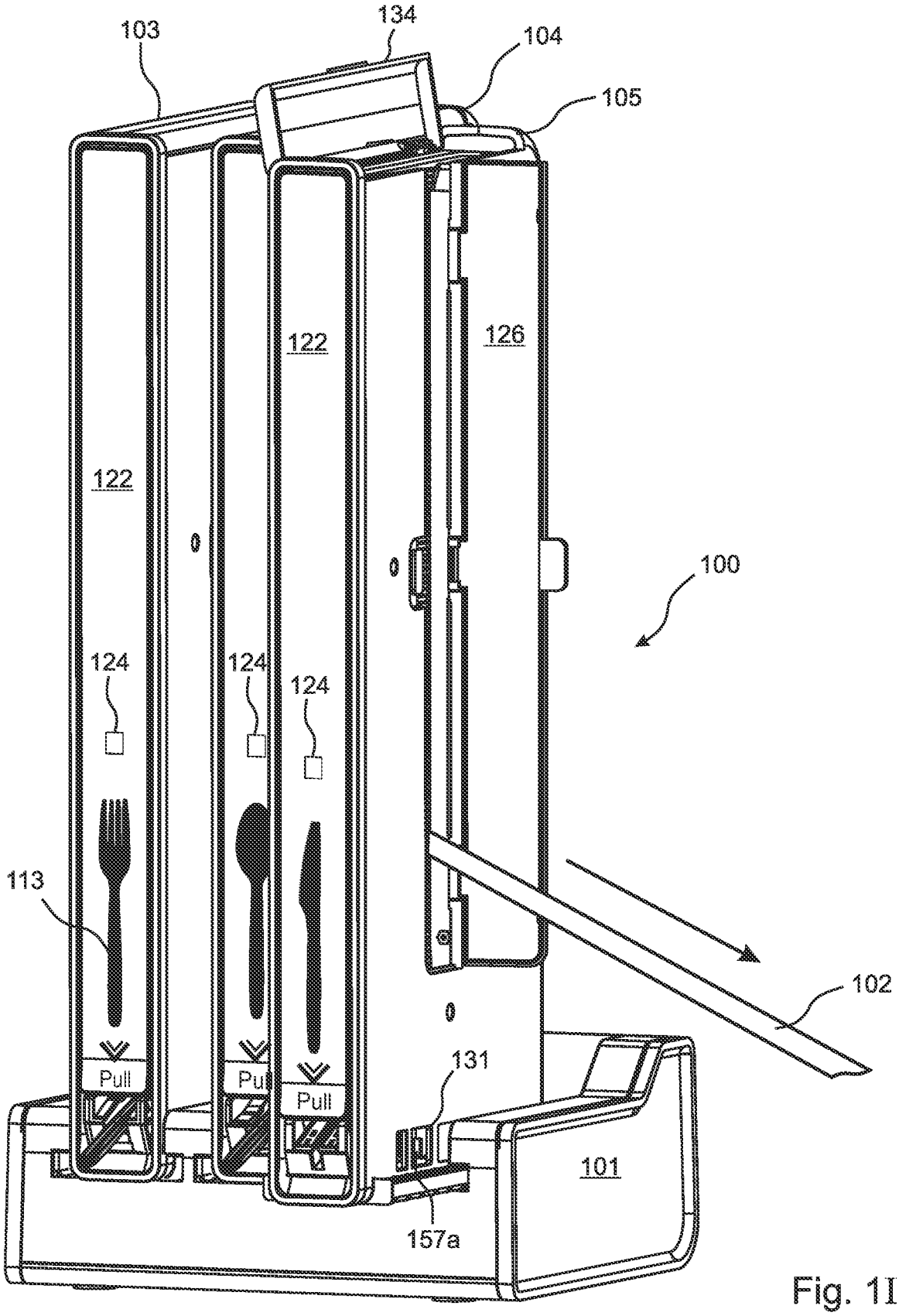
Figure 1J:
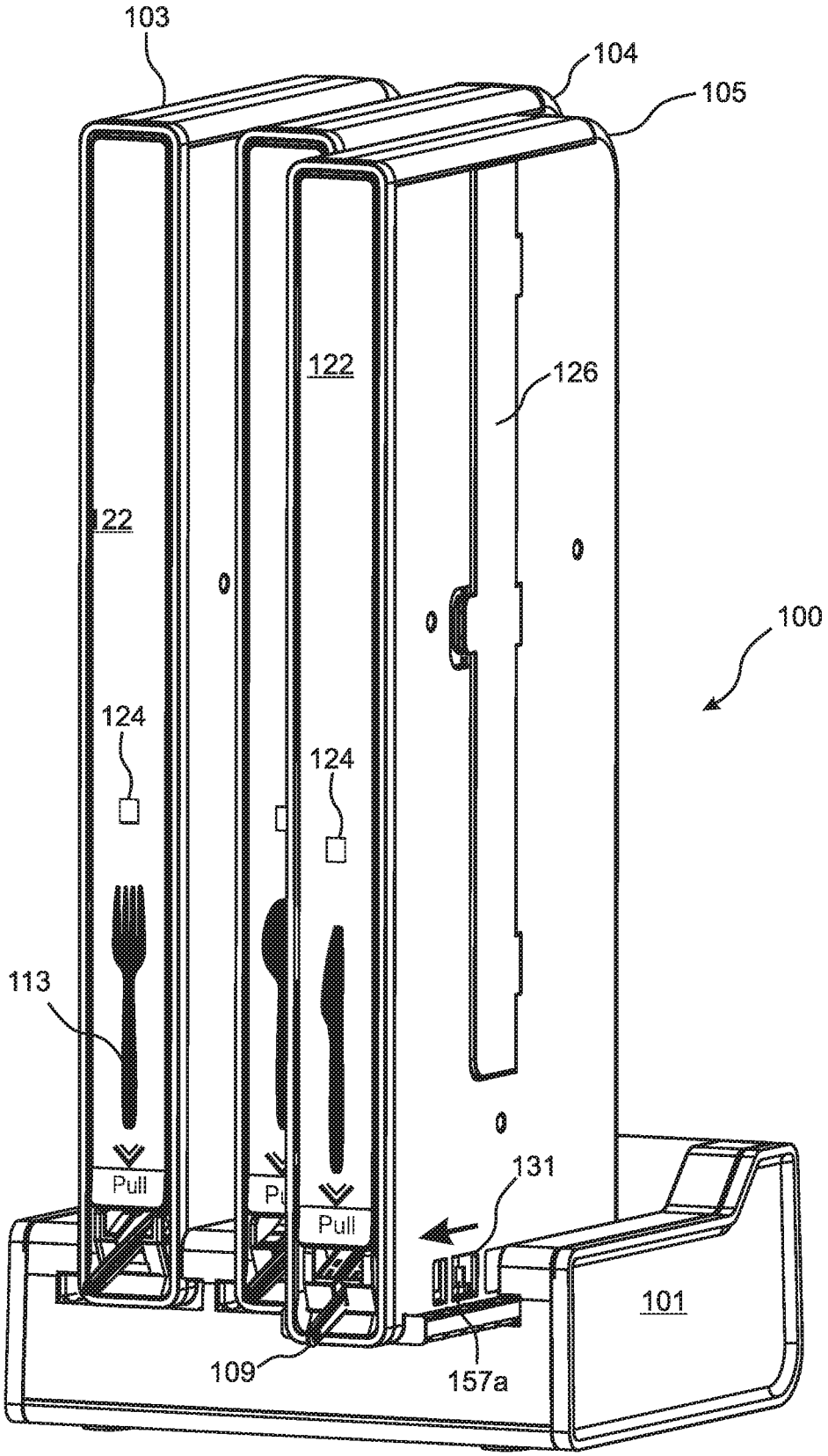
Figure 1K:
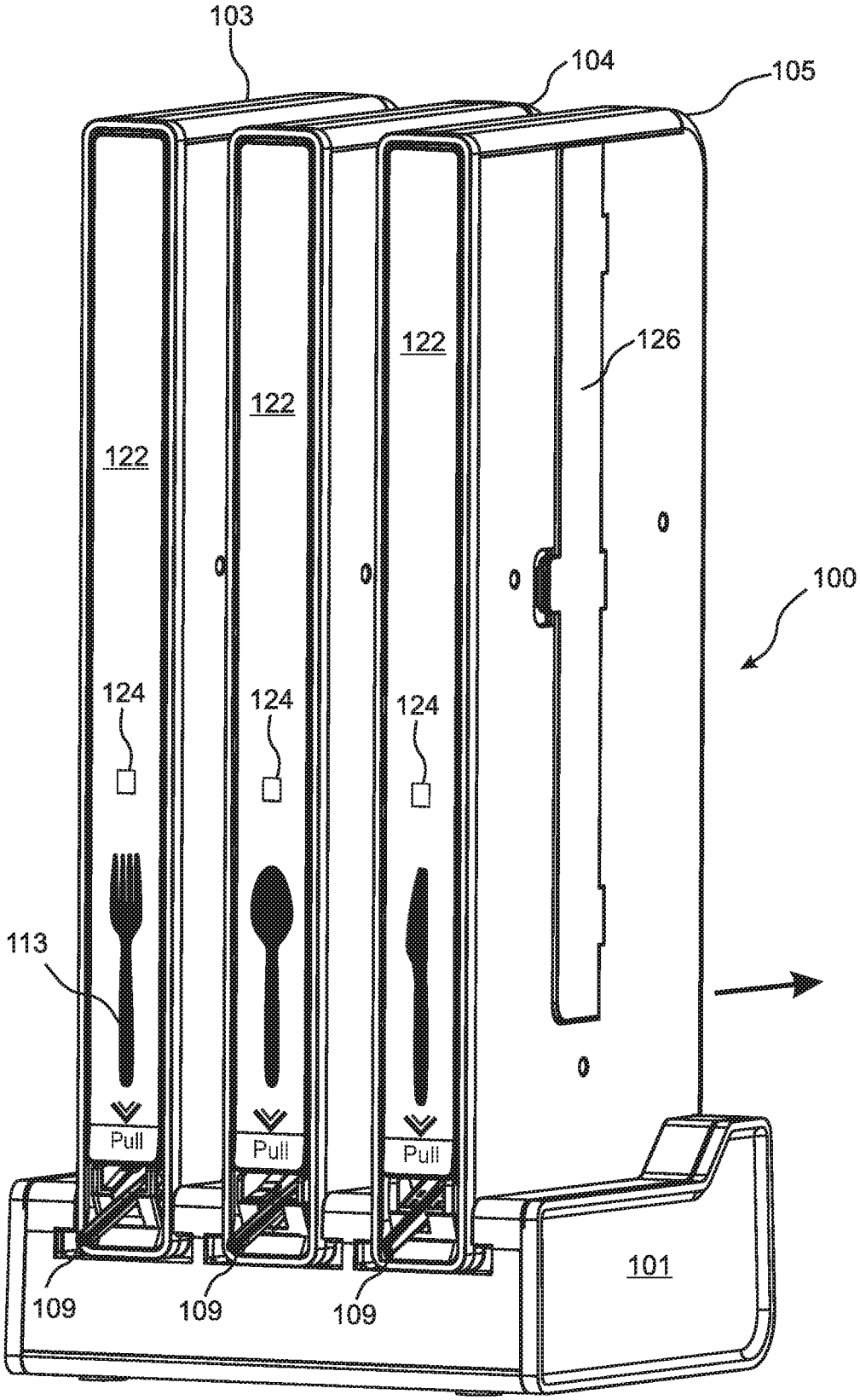
Figure 1L:
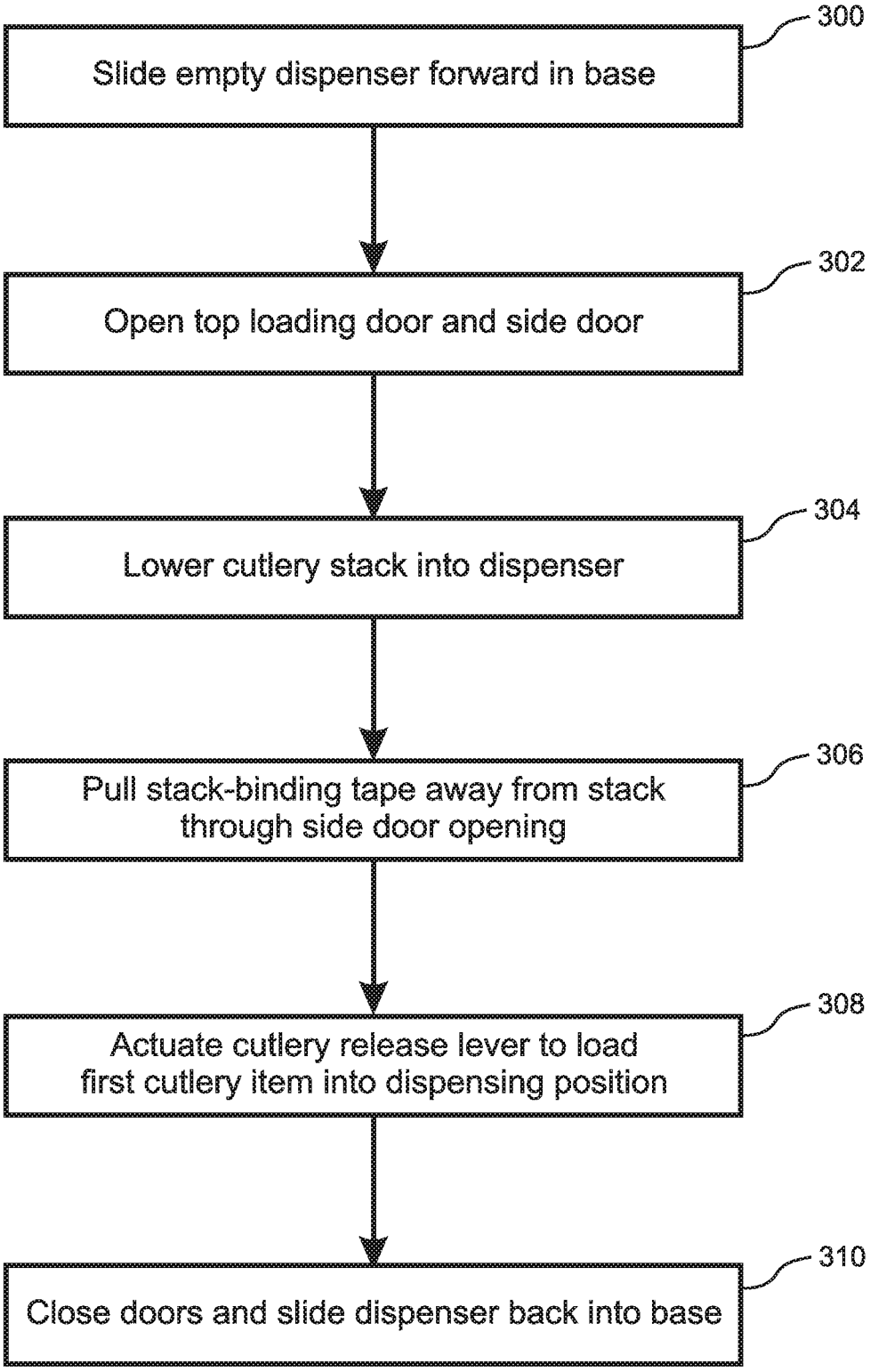
FIG. 1L is a flow diagram that summarizes the steps that are illustrated by FIGS. 1F through 1K.

The process of reloading an empty dispenser is illustrated in FIGS. 1F through 1K and summarized in the flow diagram of FIG. 1L. For ease of illustration, the right-most dispenser 105 is refilled in FIGS. 1F-1K, but the illustrated method applies to all of the dispensers 103-105. With reference to FIG. 1F, when the low-cutlery indicator 198 provides an indication that a dispenser 105 should be refilled, the dispenser 105 is slid forward partway out of the base 101 (step 300, FIG. 1L), so that the access door 126, cutlery release lever window 131, and priming lever end 157*a* become accessible. It can be seen that when either of the other two dispensers 103, 104 is refilled, it is also necessary to slide the dispenser forward to access the access door 126, and that the base 101 in the illustrated embodiment prevents access to the cutlery release lever window 131 and priming lever end 157*a* for all of the dispensers 103, 104, 105 when they are fully inserted in the base 101 (see FIG. 1K). FIGS. 10B-10G show views of the fork, spoon and knife dispensers as they appear when they are removed from the base 101, thereby clearly showing the cutlery release lever window 131 and priming lever end 157*a* for each of the three dispensers.

Figure 10H:
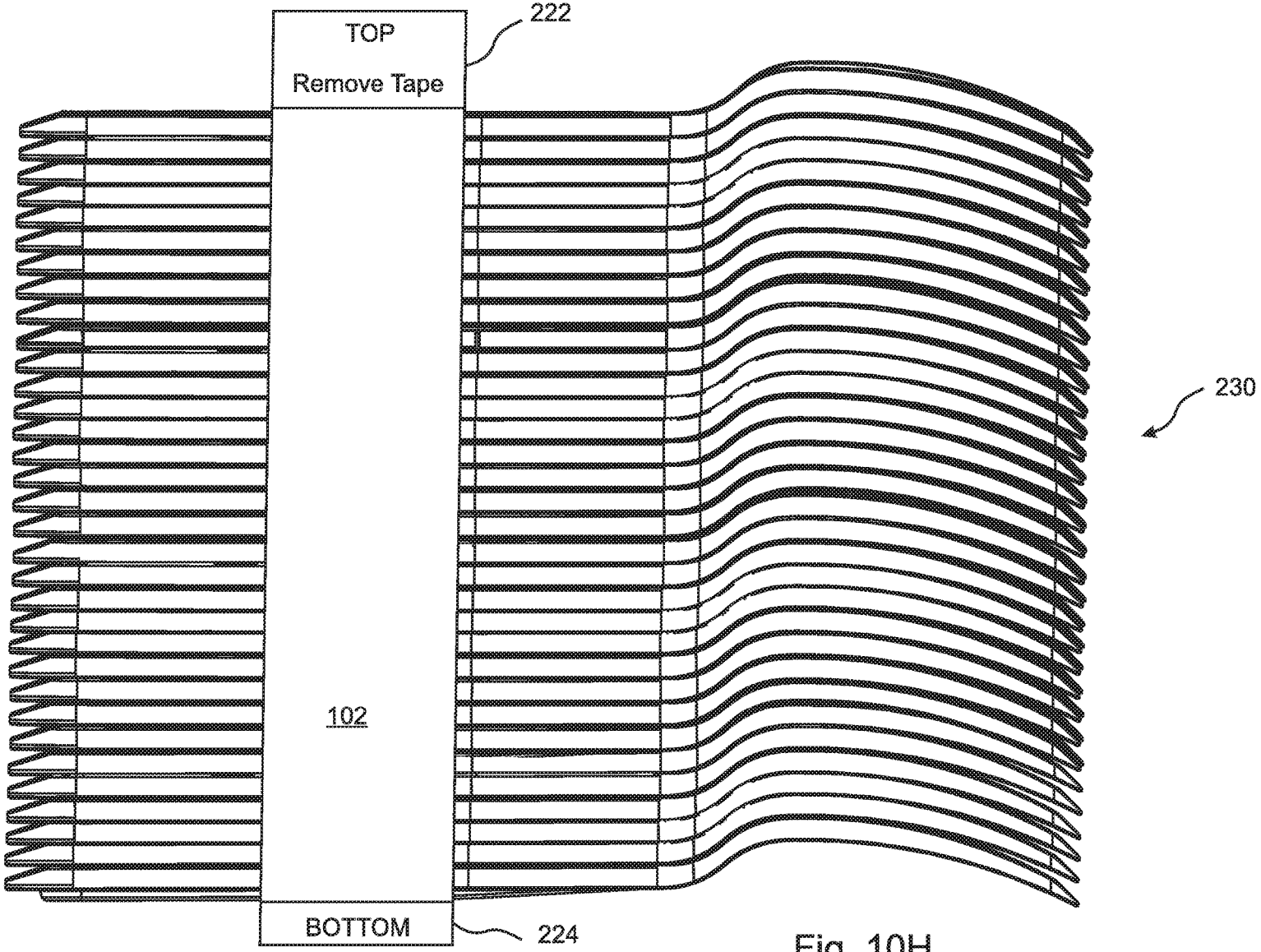
FIGS. 10H-10J are side views of refill packs configured for use in fork, spoon and knife dispensers respectively.
Figure 10I:
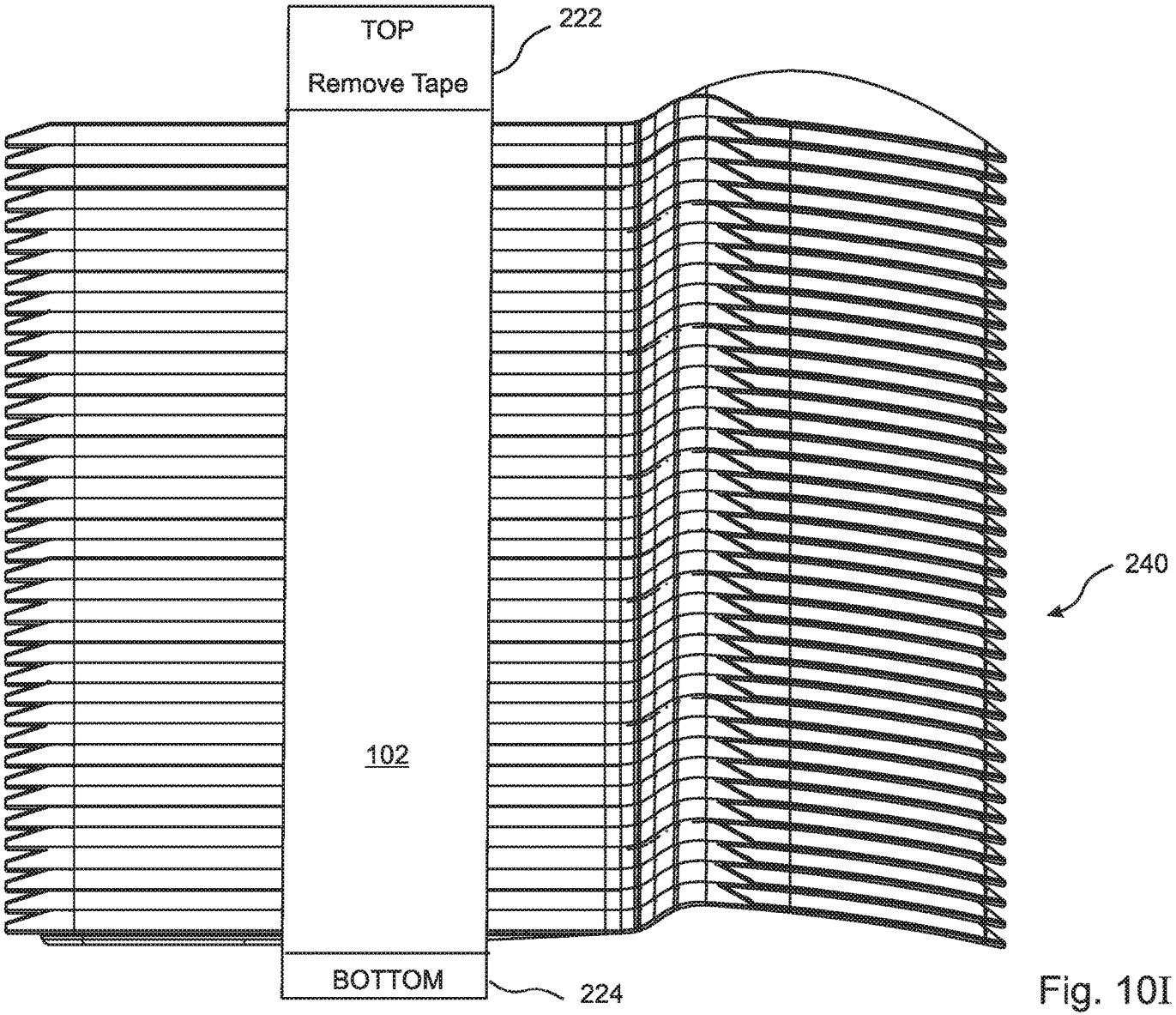
Figure 10J:
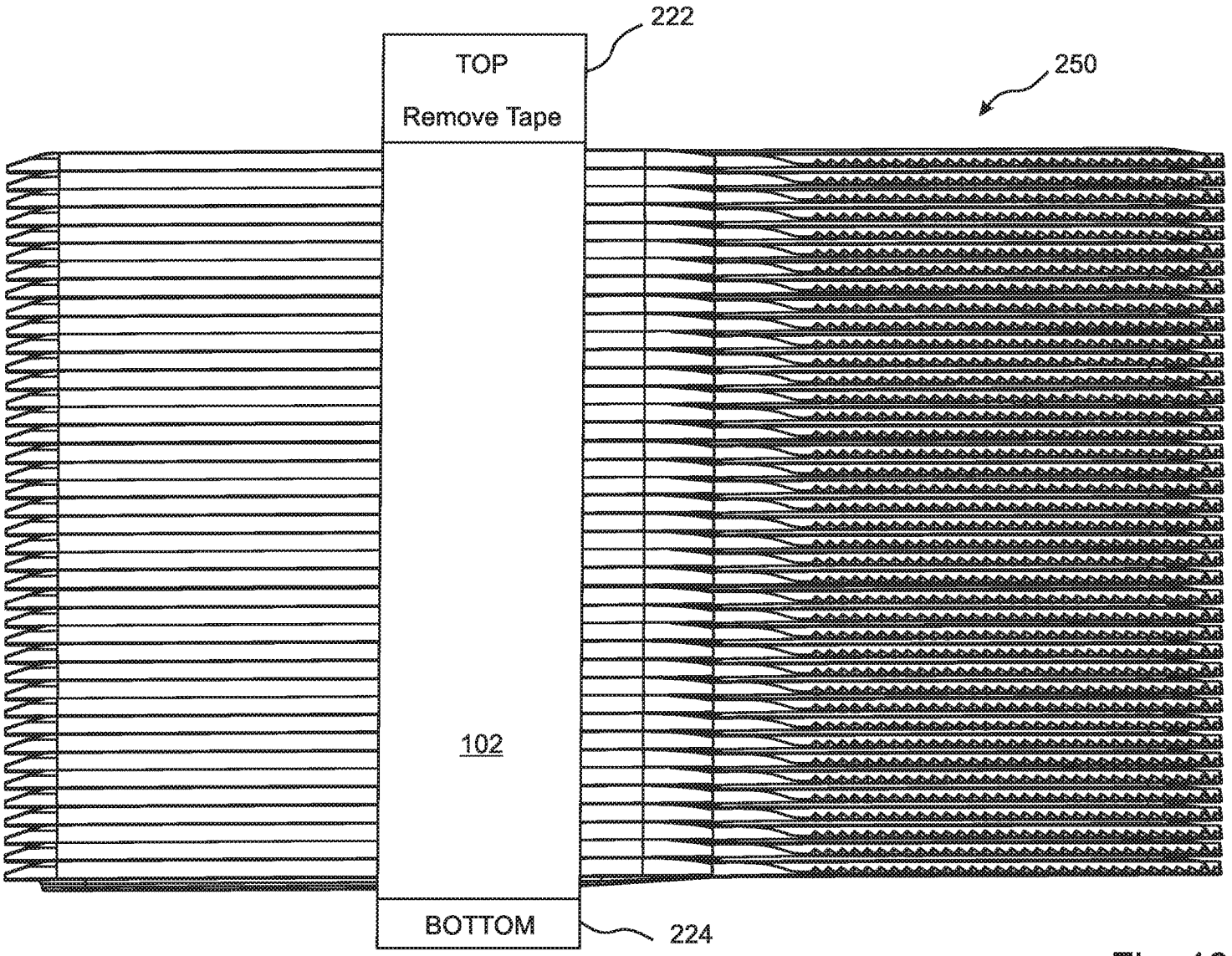

To facilitate efficient and convenient loading of a plurality of cutlery articles into the dispenser, the cutlery articles are stacked and bundled into a refill pack. FIGS. 10H-10J illustrate respectively a fork refill pack 230, a spoon refill pack 240 and a knife refill pack 250. Each of the refill packs is held together by a strip of tape 102 applied on one side of the stack of cutlery articles. The strip of tape can further include top tab 222 and bottom tab 224 that provide for convenient handling of the cutlery refill packs.

After opening the top loading door 134 and the access door 126 (FIG. 1G; step 302, FIG. 1L), an operator is able to lower a knife cutlery refill pack 250 downward (FIG. 1H) through the loading guide opening 144 provided in the loading guide 146 into the dispenser cavity 140 (step 304; FIG. 1L). The top end 222 of the tape 102 that maintains the refill pack 250 can be used as a handle to suspend the refill pack 250 as it is lowered into the dispenser 105. Inserting the refill pack 250 into the dispenser 105 automatically resets the low cutlery signal 198, which no longer appears in the low utensil window 124.

Once the refill pack 250 is loaded into the dispenser 105, the tape 102 is removed from the stack 107 by pulling the tape 102 away from the cutlery stack through the side door opening (FIG. 1I; step 306 FIG. 1L). In some embodiments featuring high capacity dispensers, a plurality of refill packs can be introduced into the dispenser so as to fill the dispenser 105 to a desired level. The top loading door 134 and access door 126 are then closed, and the priming lever end 157*a* is actuated (step 308, FIG. 1L) so as to deliver the bottommost cutlery article 108 from the cutlery stack 107 within the dispenser 105 to the dispensing position 109 (FIG. 1J).

Finally, with reference to FIG. 1K, the refilled dispenser 105 is slid back into place in the base 101 (step 310, FIG. 1L).

Figure 2A:
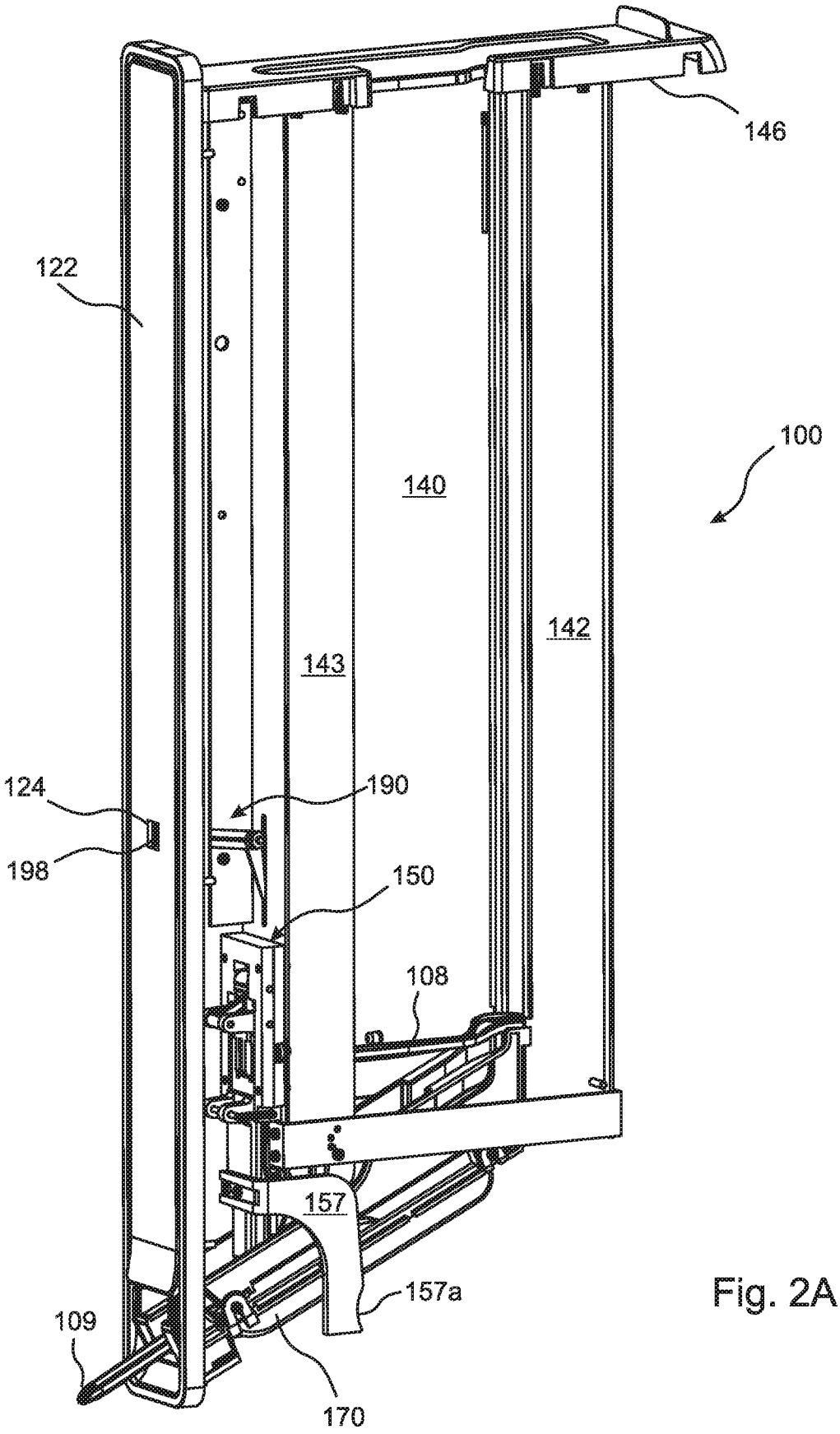
FIG. 2A is a perspective view of the fork dispenser of FIG. 1A, with all of the external housing and doors removed except for the front portion.
Figure 2B:
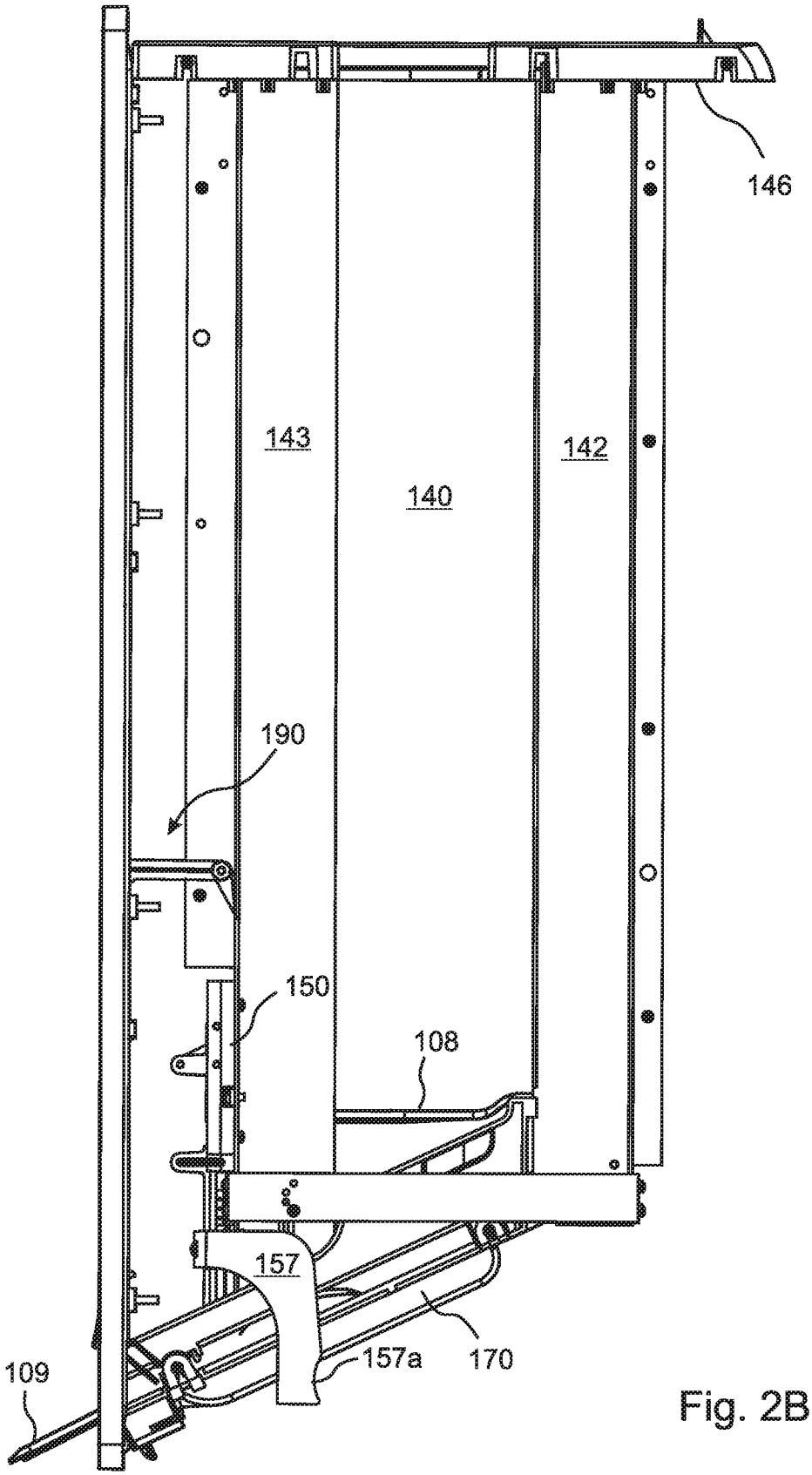
FIG. 2B is a side view of the dispenser of FIG. 2A showing the four main components of the dispenser, including the guide rails, escapement assembly, slide track, and cutlery indicator.

FIGS. 2A-2B illustrate an interior view of a fork dispenser 103, shown without the base 101, the loading door 134, and the external protective housing enclosure on the sides 112, 114, and back of the dispenser 103. In the illustrated embodiment, two guide rails 142 and 143 extend vertically downward from a top loading guide 146 at least past the resting position of the bottommost cutlery article 108. Guide rail 142 serves as an alignment guide for the head portion of the cutlery article, while guide rail 143 serves as an alignment guide for the handle portion of the cutlery article. The guide rails 142 and 143 facilitate loading of cutlery and retaining of the cutlery in a stack, whereby the guide rails 142 and 143 define the dispenser cavity 140 therebetween. Each of the guide rails 142 and 143 can be in the form of a U-shaped channel. Other embodiments include various configurations and shapes of the guide rails 142 and 143, which can simply be in the form of bars or rods with provision for multiple guide rails such as three, four five, six, or more guide rails, in lieu of the two guide rails shown in the illustrated embodiment.

During cutlery loading, the guide rails 142 and 143 ensure that each cutlery article 106 in the cutlery stack 107 remains in the proper stacked configuration. Partially visible in FIGS. 2A and 2B are an escapement assembly 150, a slide track 170, and a cutlery level indicator system 190, each of which is discussed in more detail below. As shown in FIGS. 1G and 2A, the low-cutlery indication 198 of the cutlery level indicator 190 is visible as a darkened section through the cutlery indicator window 124 located on front plate 122.

Figure 2C:
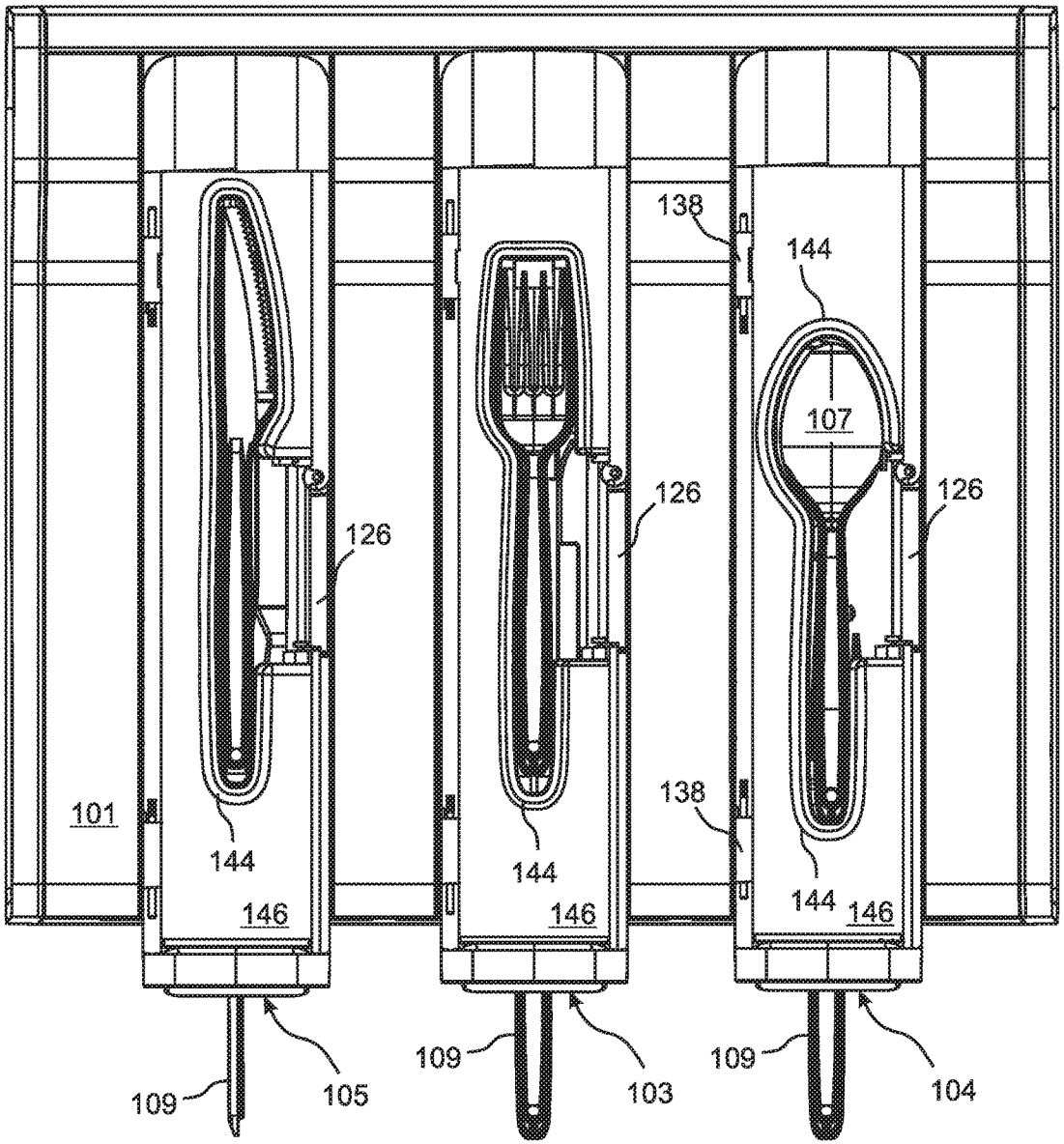
FIG. 2C is a top view of the dispenser assembly of FIG. 1A with the loading door of each dispenser removed.

FIG. 2C is a top view of the loading guides 146 for the three dispensers 103, 104, and 105, with a cutlery stack 107 loaded into each of the dispenser cavities 140. The loading guide 146 in each dispenser has a suitably shaped opening 144 to allow a cutlery stack 107 to pass through from above and to be channeled into the dispenser cavity 140. Each of the loading guide openings 144 in the illustrated embodiment closely corresponds in shape with the profile of the intended cutlery stack 107, and is slightly larger than the profile of the intended cutlery type, so as to assist an operator in guiding and loading the cutlery stacks into their respective dispensers 103, 104, or 105, while avoiding inadvertent loading of a cutlery stack into a dispenser that is configured for a different type of cutlery, for example to prevent inserting a stack of forks or knives into a dispenser 104 that is configured to dispense spoons. However, embodiments can include any size, shape, or profile of the opening 144 in the loading guide 146 that is slightly larger than the profile of the intended cutlery stack 107.

The top loading doors 134 have been removed in FIG. 2C, thereby allowing the hinges 138 to be more clearly visible on each dispenser 103, 104, and 105. The top of the access door 126 is visible in the figure. Typically an operator will open the top loading door 134 and access door 126 for loading cutlery refills into the dispenser cavity 140.

FIGS. 3A-3D present various views of an escapement assembly 150 shown with a bottommost cutlery article 108 positioned in a release position, and the slide track 170 having a first cutlery article 109 aligned in the dispensing position with the handle portion of first cutlery article 109 being accessible to a user for grasping and removal. FIG. 3E is a top view similar to FIG. 3D, but with the cutlery article 108, 109 omitted. FIG. 3F is a perspective view of the escapement assembly 150 shown together with the slide track and other features. FIGS. 3G and 3H are side views of the escapement mechanism 150 shown in the resting configuration and the actuated configuration, respectively With reference to FIGS. 3F-3H, the escapement assembly 150 comprises a plurality of components that are connected to each other by four pivot pins 164*a-d*. These include a mounting block 152, a swing member 158 having an upper retaining surface 159 attached thereto, a link 160, and an escapement member 154. The escapement member 154 has a lower retaining surface 156 attached thereto. Note that distribution of the mechanism over four pivots in the illustrated embodiment, instead of having only one or two pivots, serves to reduce the wear on each pivot and thereby extends the lifetime of the dispenser.

The mounting block 152 of the escapement assembly 150 can be affixed to the dispenser housing or to another structure, which can include one or more guide rails 143 (see FIG. 2A), and is preferably located at the front of the dispenser 103, 104, or 105. The swing member 158 is pivotally connected to the mounting block 152 by a pivot pin 164*a*, with the swing member being oriented generally vertically and in line with the mounting block. The swing member 158 extends downward to the upper retaining surface 159, which is a generally horizontal projection, projecting inward from the swing member 158 toward the dispenser cavity 140. The upper end of the escapement member 154 is also pivotally connected to the mounting block 152 by pivot pin 164*d*.

The swing member 158 is pivotally connected near its top end to a distal end of a link 160 by means of pivot pin 164*b*, while the proximal end of link 160 is pivotally connected near the upper end of escapement member 154 by pivot pin 164*c*.

The escapement assembly 150 is configured such that actuation of the escapement member 154 (FIG. 3G), when a user grasps the first cutlery piece 109 and removes it from the dispensing position, results in contrary horizontal movements of the upper 159 and lower 156 retaining surfaces, whereby the movement of the escapement member 154 causes the lower retaining surface 156 to be withdrawn from beneath the cutlery stack 107, while the upper retaining surface is simultaneously inserted into the cutlery stack 107 at a location just above the bottommost cutlery article 108, thereby allowing the bottommost cutlery article 108 to be released from the stack and transferred to the dispensing position for retrieval by a next user. The vertical gap between the lower retaining surface 156 and upper retaining surface 159 is configured to allow insertion of upper retaining surface 159 just above the bottommost cutlery article 108, while the cutlery stack 107 is configured to provide gaps between the proximal ends of the cutlery articles in the stack 107 so as to enable insertion of upper retaining surface 159 in between the bottommost cutlery article 108 and the article just above it in the cutlery stack 107. Similarly, recovery of the escapement member 154 to its original position causes the upper retaining surface 159 to be withdrawn, while the lower retaining surface is reasserted beneath the stack so as to retain a replacement bottommost cutlery article.

Figure 3A:
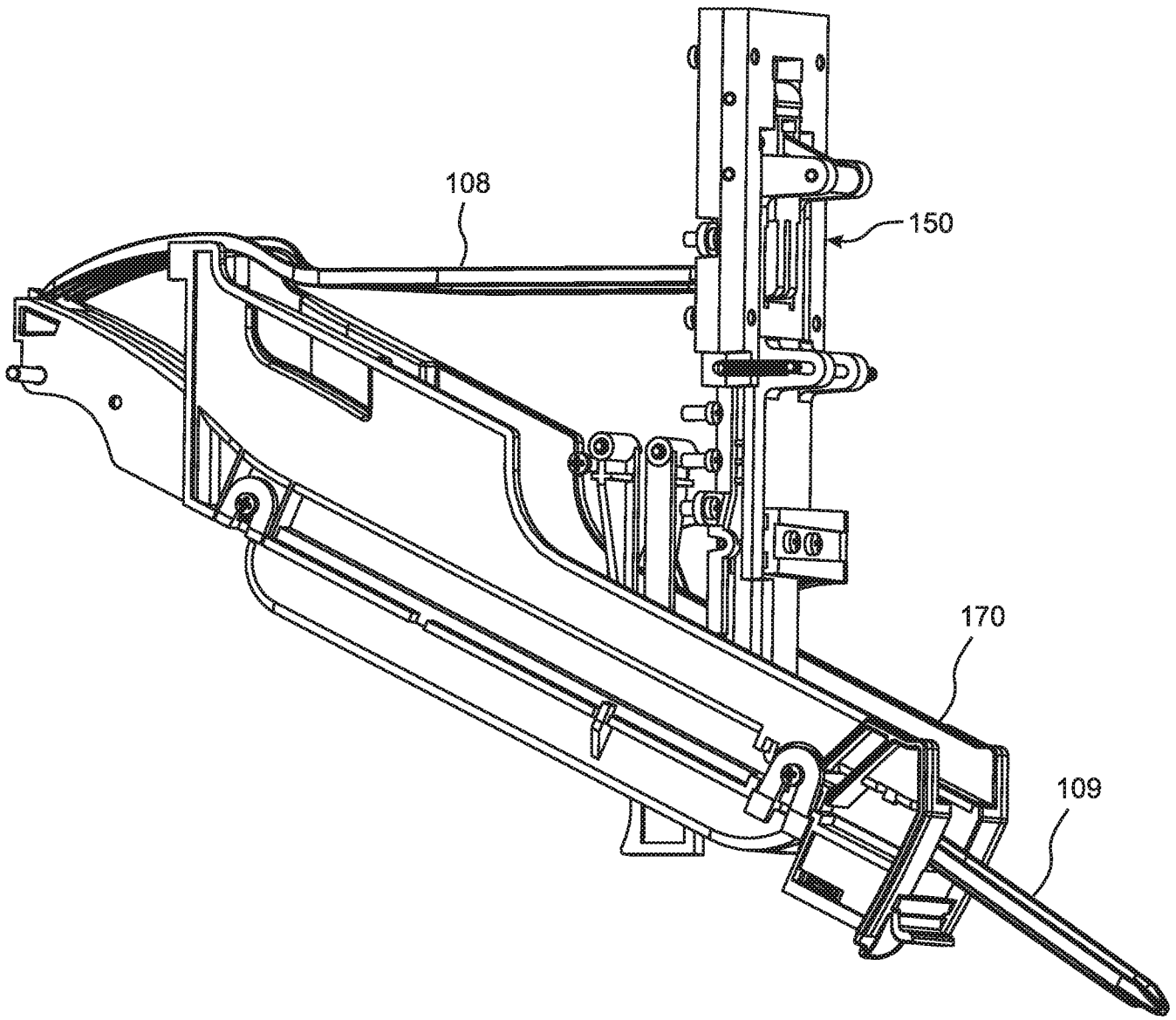
FIGS. 3A-3D illustrate an escapement assembly for a fork dispenser according to an embodiment of the present invention, shown with a bottommost cutlery positioned in a release position, and the slide track having a first cutlery aligned in the dispensing position.
Figure 3B:
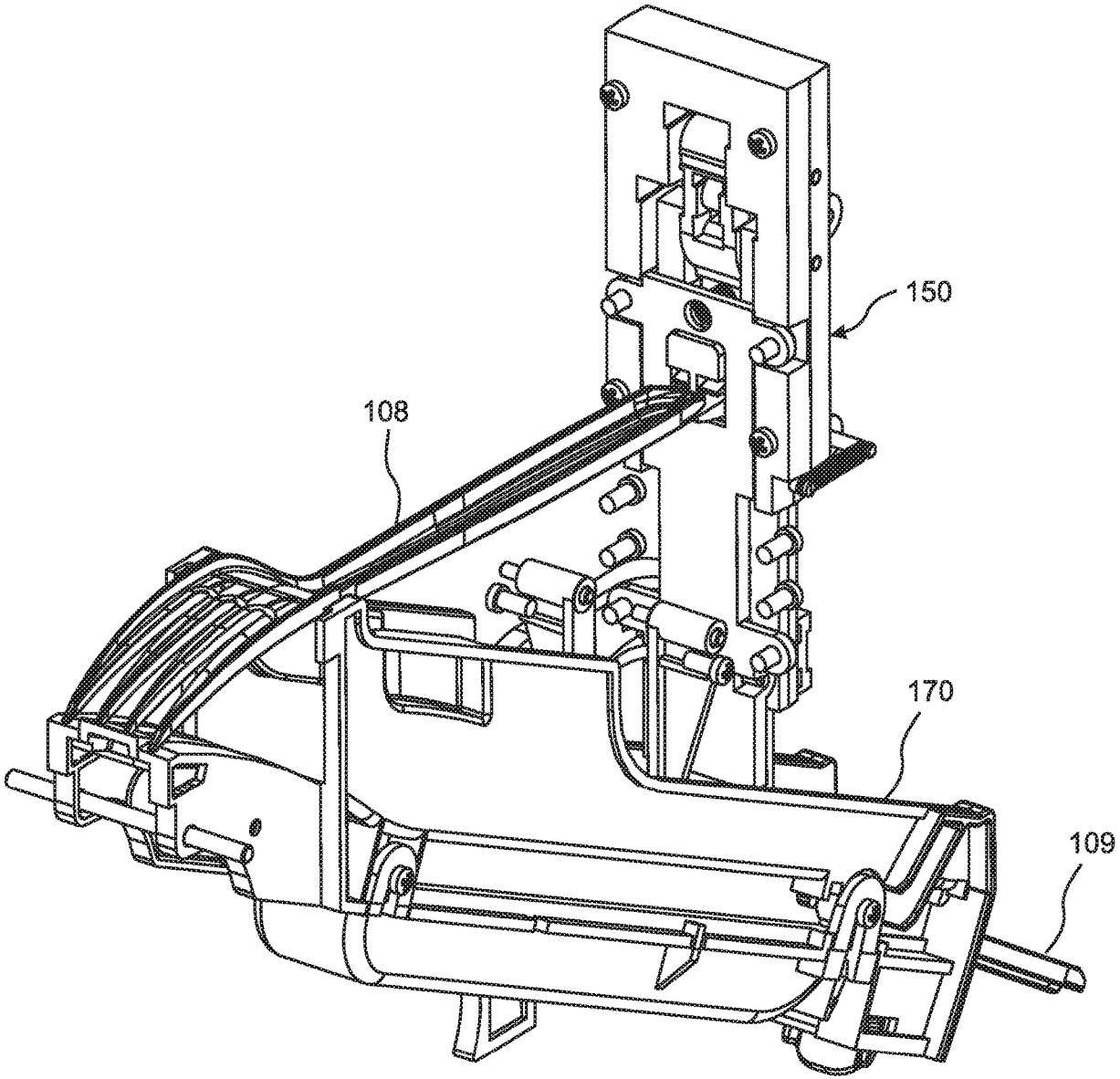
Figure 3C:
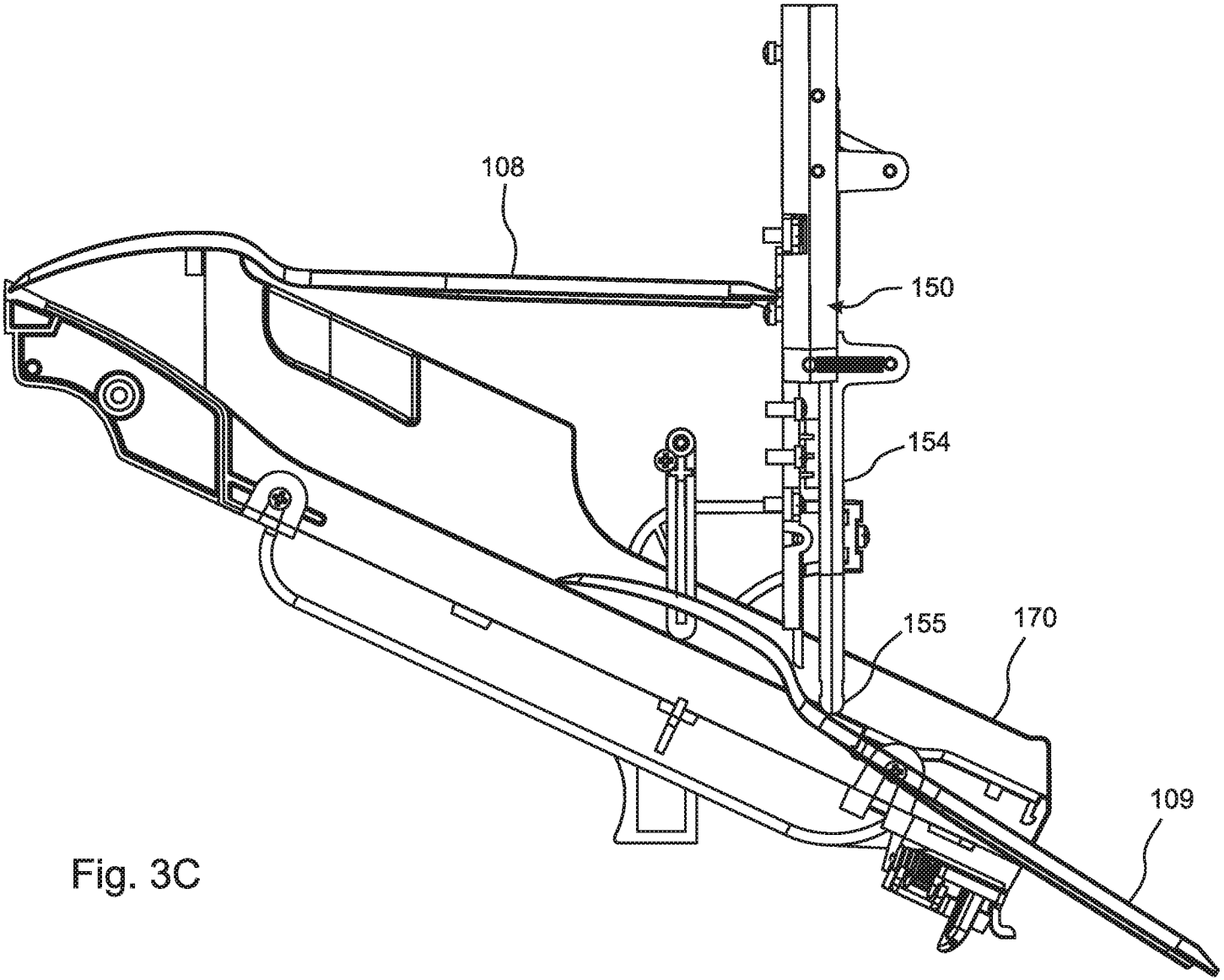
Figure 3D:
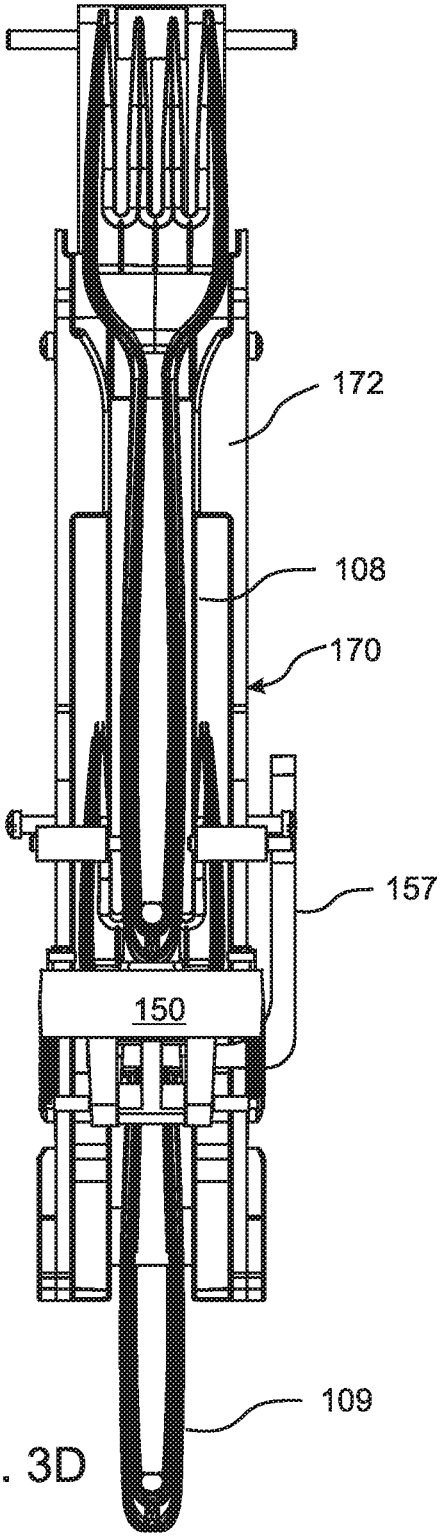
Figure 3E:
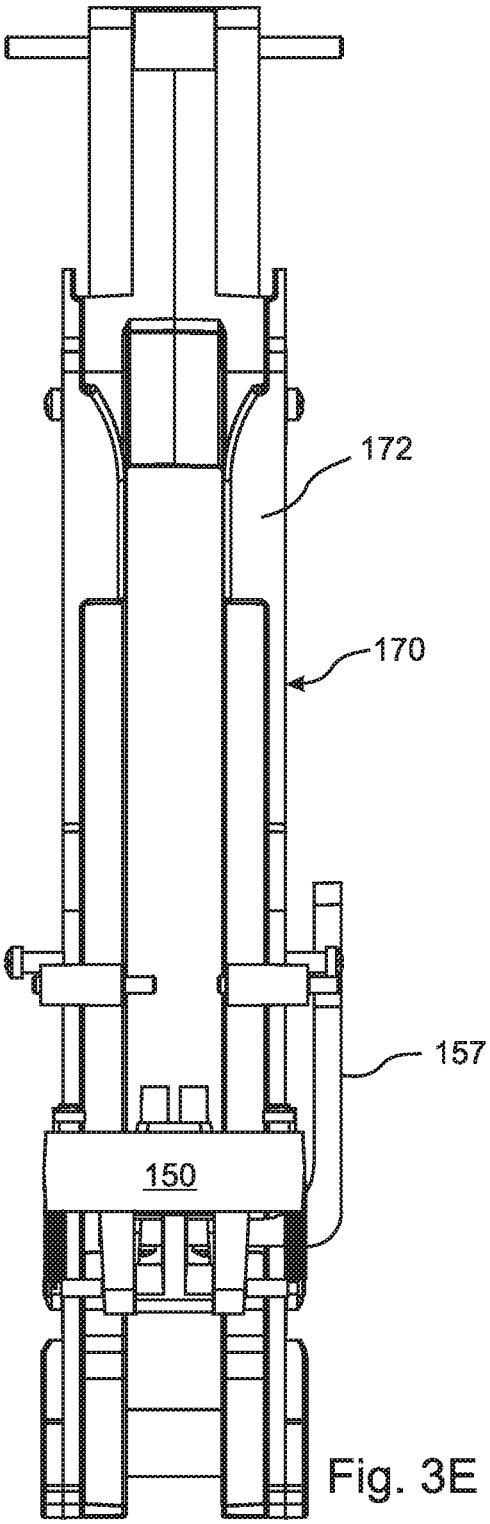
FIGS. 3E-3F illustrate the embodiment of FIG. 3A shown without cutlery.
Figure 3F:
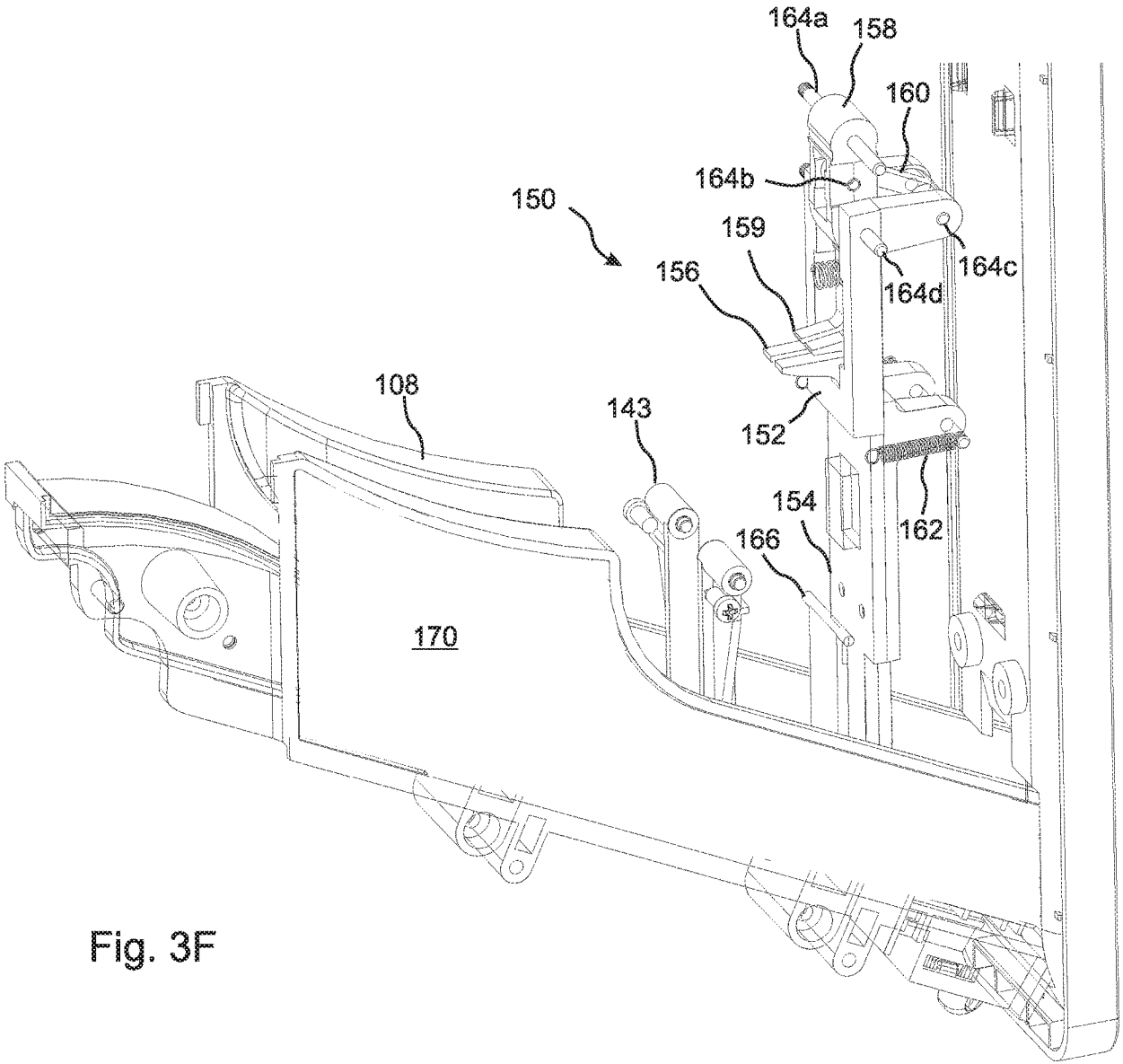
Figure 3G:
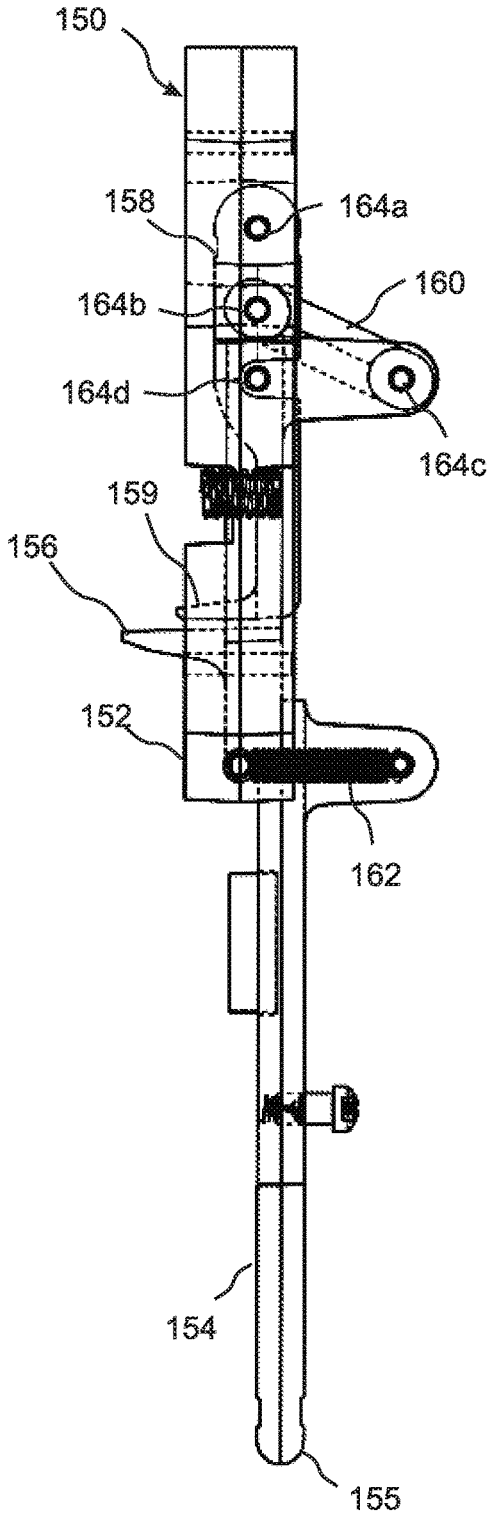
FIGS. 3G and 3H are transparent side views of the escapement assembly of FIG. 3F, shown in the resting and actuated configurations, respectively.
Figure 3H:
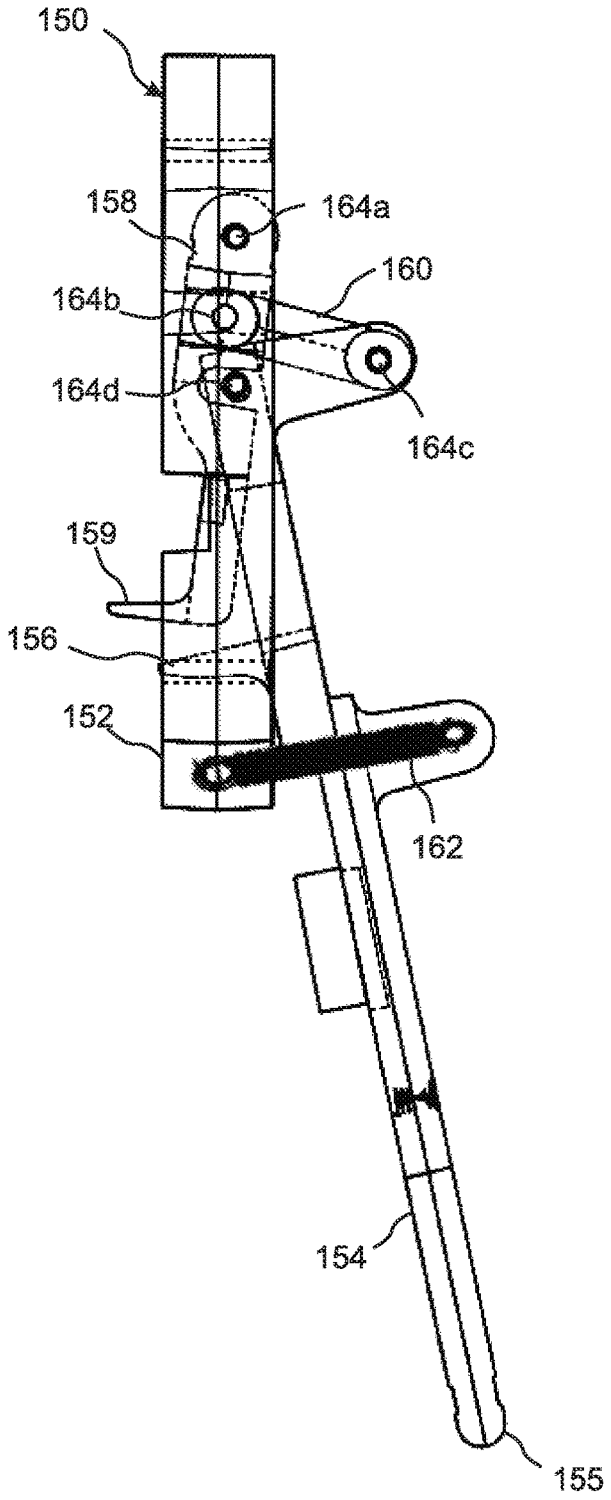
Figure 4A:
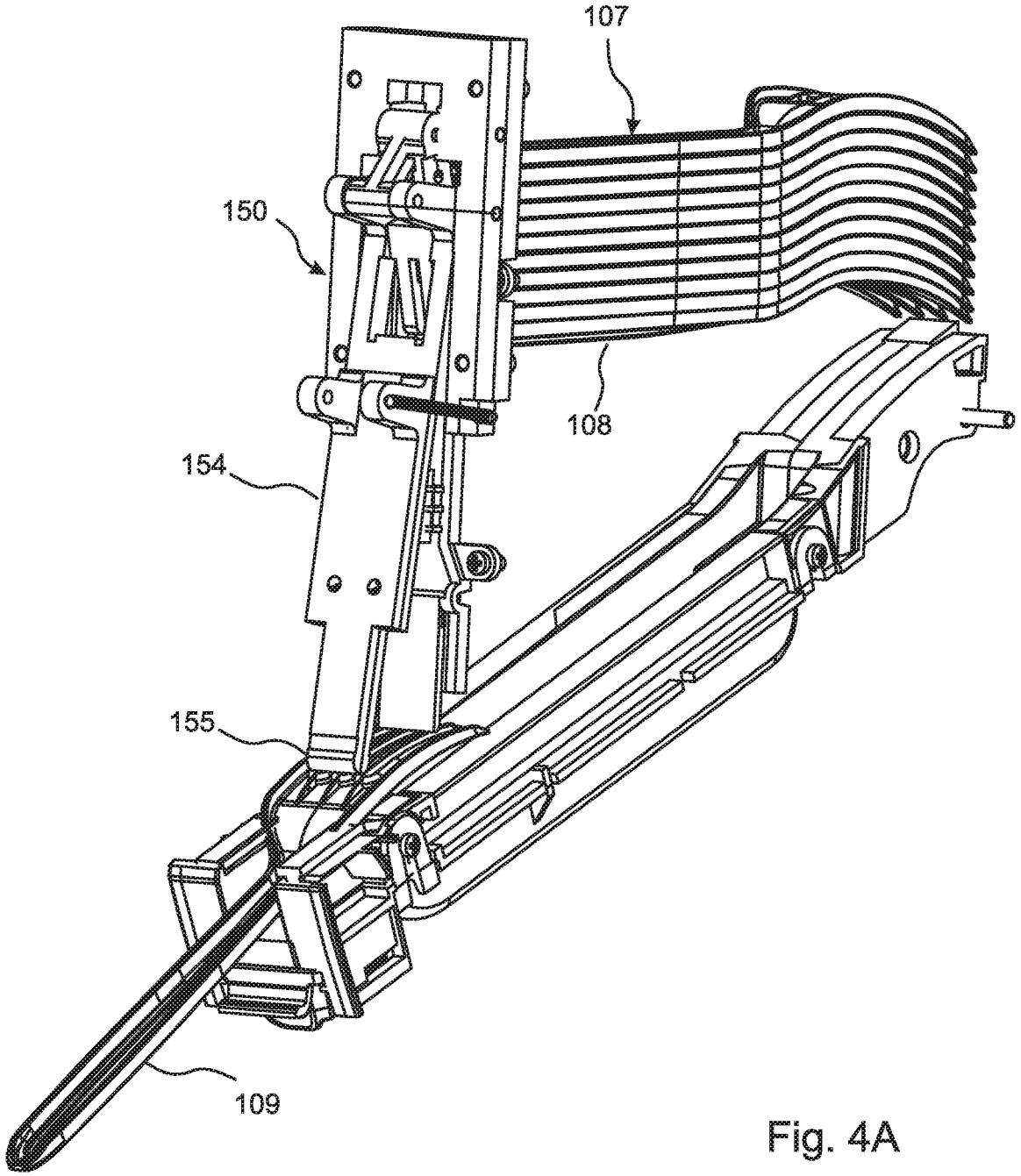
FIGS. 4A-4E illustrate the embodiment of FIG. 3A shown with a cutlery in the dispensing position and a stack of cutlery stored and ready for dispensing.
Figure 4B:
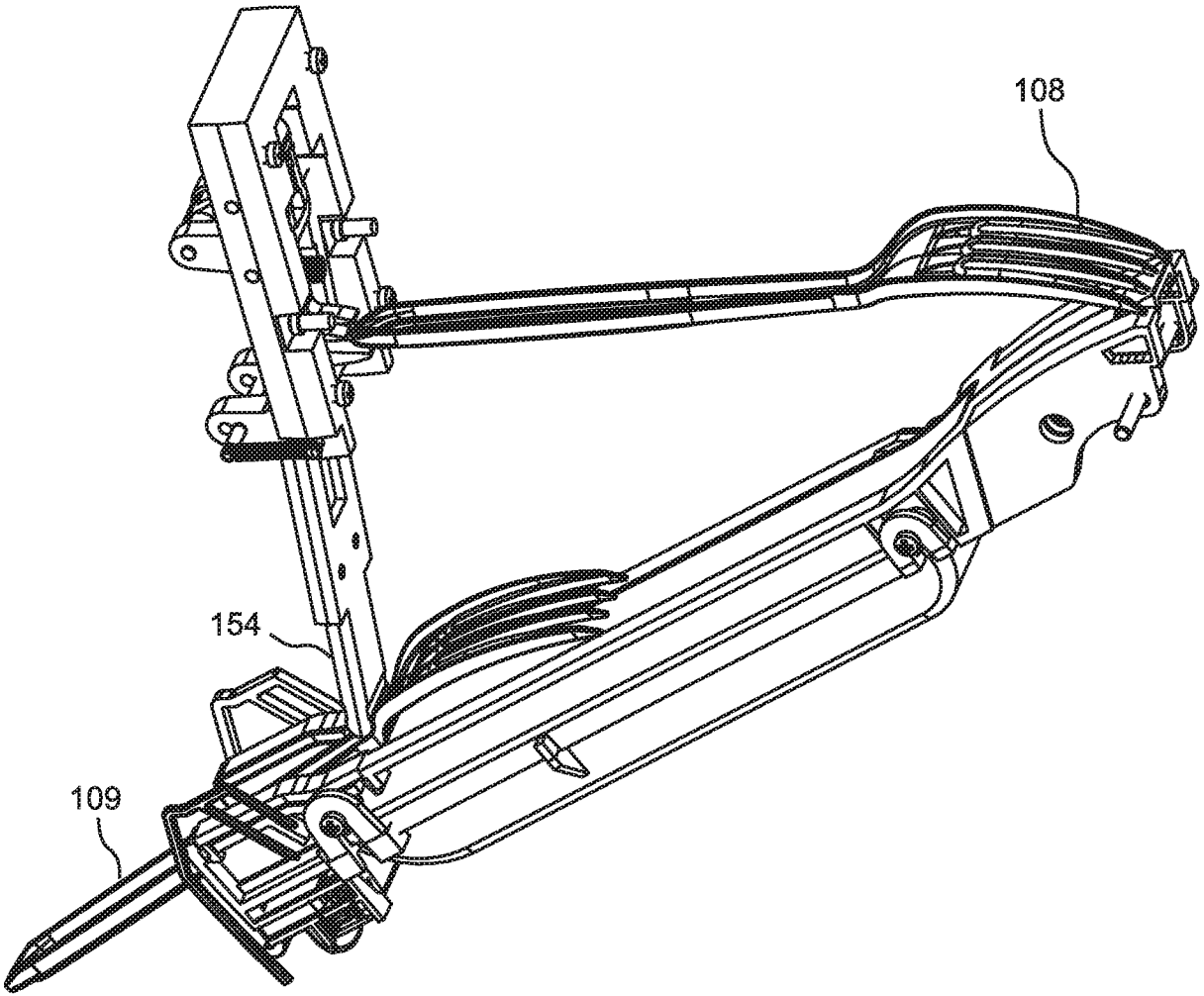
Figure 4C:
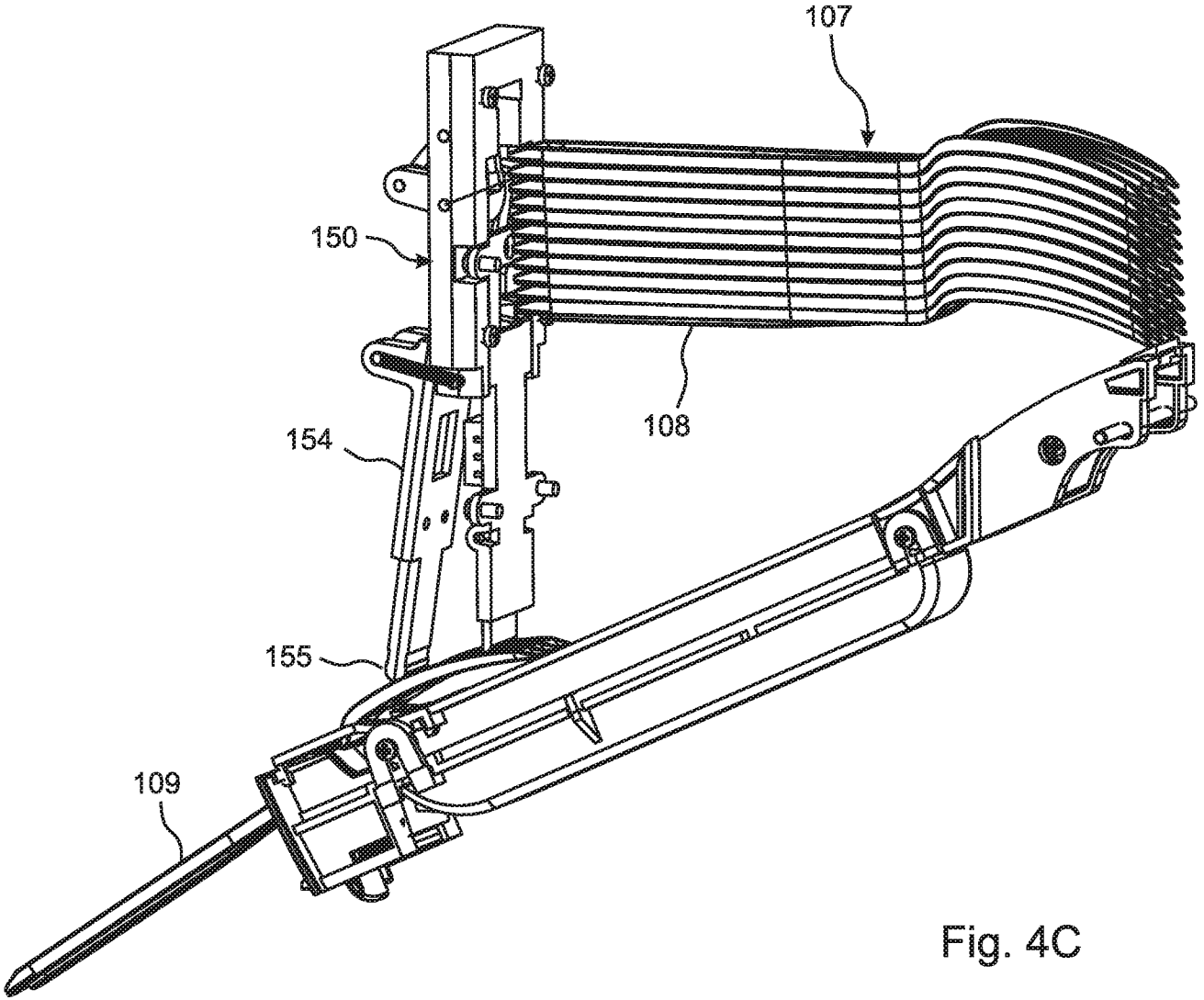
Figure 4D:
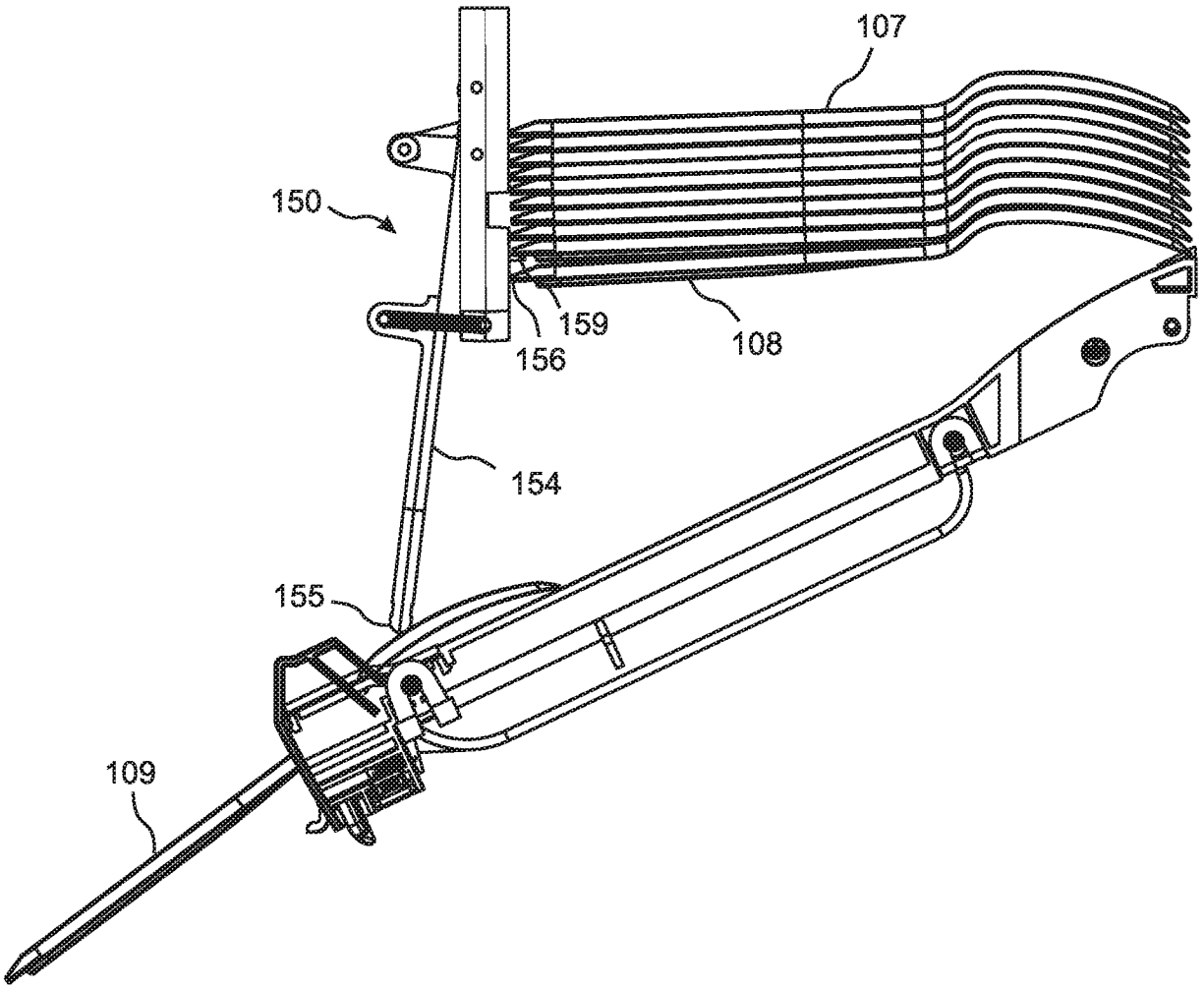
Figure 4E:
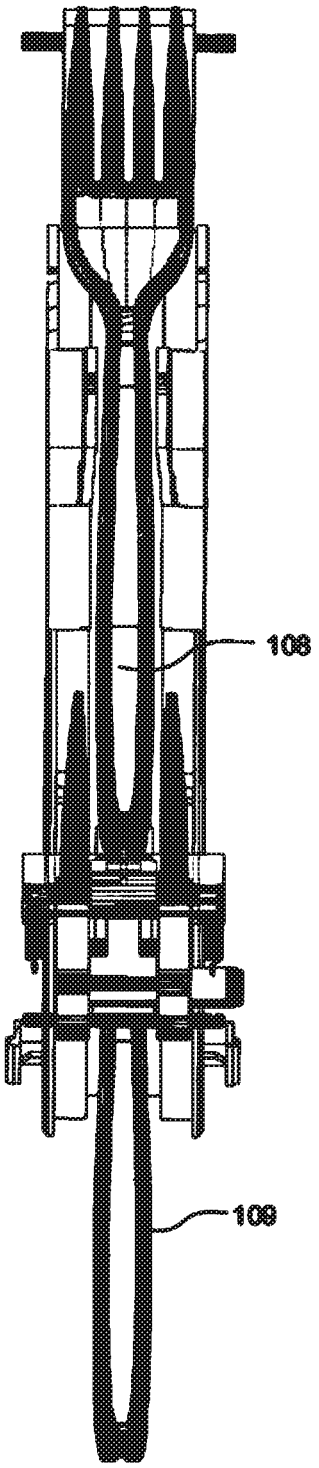

With reference to FIGS. 3B and 3C, while in a resting configuration the proximal end of the handle of the bottommost cutlery article 108 rests on the lower retaining surface 156, while a distal end of the head of the bottommost cutlery article rests on a retaining ledge, thereby maintaining the bottommost cutlery article 108, and the cutlery stack 107 as a whole, in a generally horizontal orientation. In various embodiments, the distal end of the head of bottommost cutlery article 108 can be supported in any of a variety of manners, such as by resting on a ledge or shelf, by resting on a post, or by a cooperative retaining means such as a projection. In embodiments, the cutlery articles 106 are configured to include a compatible feature at their distal ends, such as a corresponding indentation, that cooperatively enhances the suspension and release of the cutlery article 106.

As is shown in Figures, the escapement member 154 extends generally vertically downward, with its lower end 155 configured to contact and intercept a head portion of the first cutlery article 109 while the first cutlery article rests upon the slide track 170, thereby preventing the first cutlery article 109 from gravitationally traveling past the defined dispensing position until it is pulled out by a user (see FIG. 3C). The lower retaining surface 156 extends horizontally and is positioned near the upper end of the escapement member 154, and is configured to extend horizontally into the dispenser cavity 140. While the escapement member 154 is in its resting position (FIGS. 3F-G), the lower retaining surface 156 is configured to act as a stop to hold and maintain the proximal end of bottommost cutlery article 108 in the cutlery stack 107 within the dispenser cavity. The lower retaining surface 156 can be of any size or shape, and can be positioned at any desired location. It should be noted that the upper retaining surface 159 and lower retaining surface 156 need not be of a unitary construction with swing member 158 and/or escapement member 154 respectively, and can be separate parts that can be attached accordingly.

FIGS. 4A-4E illustrate dispensing of the first cutlery article 109 from the dispenser 103 (fork dispenser). As a user (not shown) grasps the handle of the first cutlery article 109 and pulls it out, the lower end 155 of the escapement member 154 is forced to pivot outward away from the dispenser cavity 140 due to contact with the raised head portion of the first cutlery article 109, while the upper end of the escapement member pivots at pivot pin 164*d*. This movement withdraws the lower retaining surface 156 away from beneath the bottommost cutlery article 108.

As the lower retaining surface 156 is withdrawn, the bottommost cutlery article 108 is thereby released from the cutlery stack 107, and the proximal end thereof is gravitationally compelled downward. As the escapement member 154 pivots, link 160 is moved, forcing the upper end of the swing member 158 to pivot inward, thereby causing the upper retaining surface 159 to enter the vertical plane of the dispenser cavity 140. As the upper retaining surface 159 enters the vertical plane of dispenser cavity 140, the bottom of a "next" cutlery article in the cutlery stack 107 contacts the upper retaining surface 159, so that the cutlery stack 107 is held and maintained in place. The bottommost cutlery article 108 is thereby singulated from the remainder of the stack 107. Once the first cutlery article 109 has been dispensed from the dispenser and contact between the first cutlery article 109 and the escapement member 154 ends, the escapement member 154 is pulled back to a resting position by a pair of coil return springs 162.

As the escapement member 154 returns to its resting position, the link 160 and swing member 158 correspondingly pivot back to their resting positions, causing the lower retaining surface 156 to be reinserted beneath the replacement bottommost cutlery article 108, while the upper retaining surface 159 is withdrawn from beneath the cutlery stack 107, causing the proximal end of the cutlery stack 107, which is no longer held and maintained by the upper retaining surface 159, to fall onto the lower retaining surface 156, thereby resetting the dispenser and causing the "next" cutlery article to become a replacement bottommost cutlery article 108. Note that use of a pair of coil springs and a 4-pin pivot arrangement for sequencing the lower and upper retaining surfaces significantly extends the useful life of the dispenser and the number of cutlery dispensing cycles that the dispenser can undergo.

Figure 5:
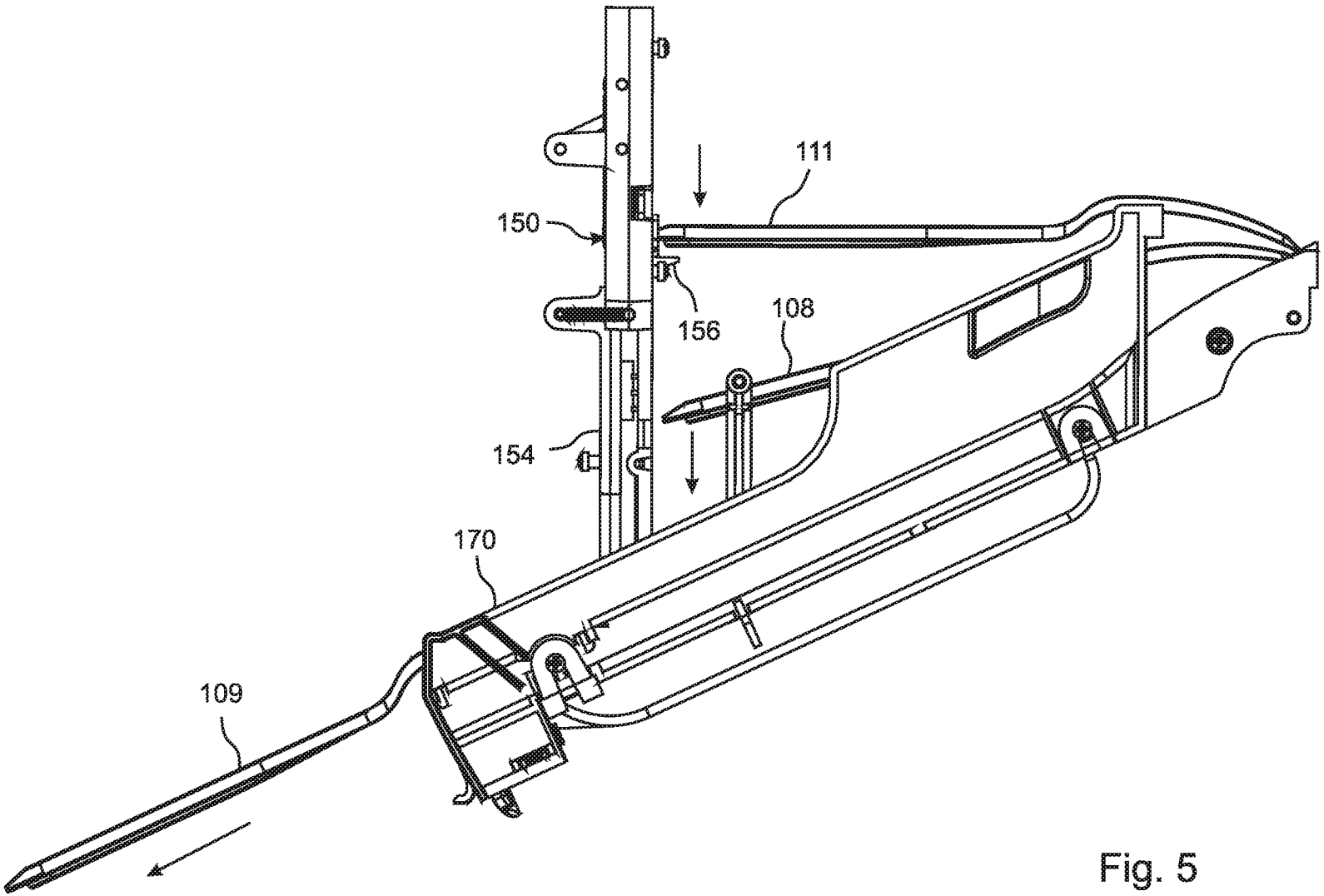
FIG. 5 is a side view of the embodiment of FIGS. 3A-3E illustrating the positions of the cutlery in the dispenser at the moment when the escapement member has just been returned to its rest position after being actuated by the head of the first cutlery.
Figure 6A:
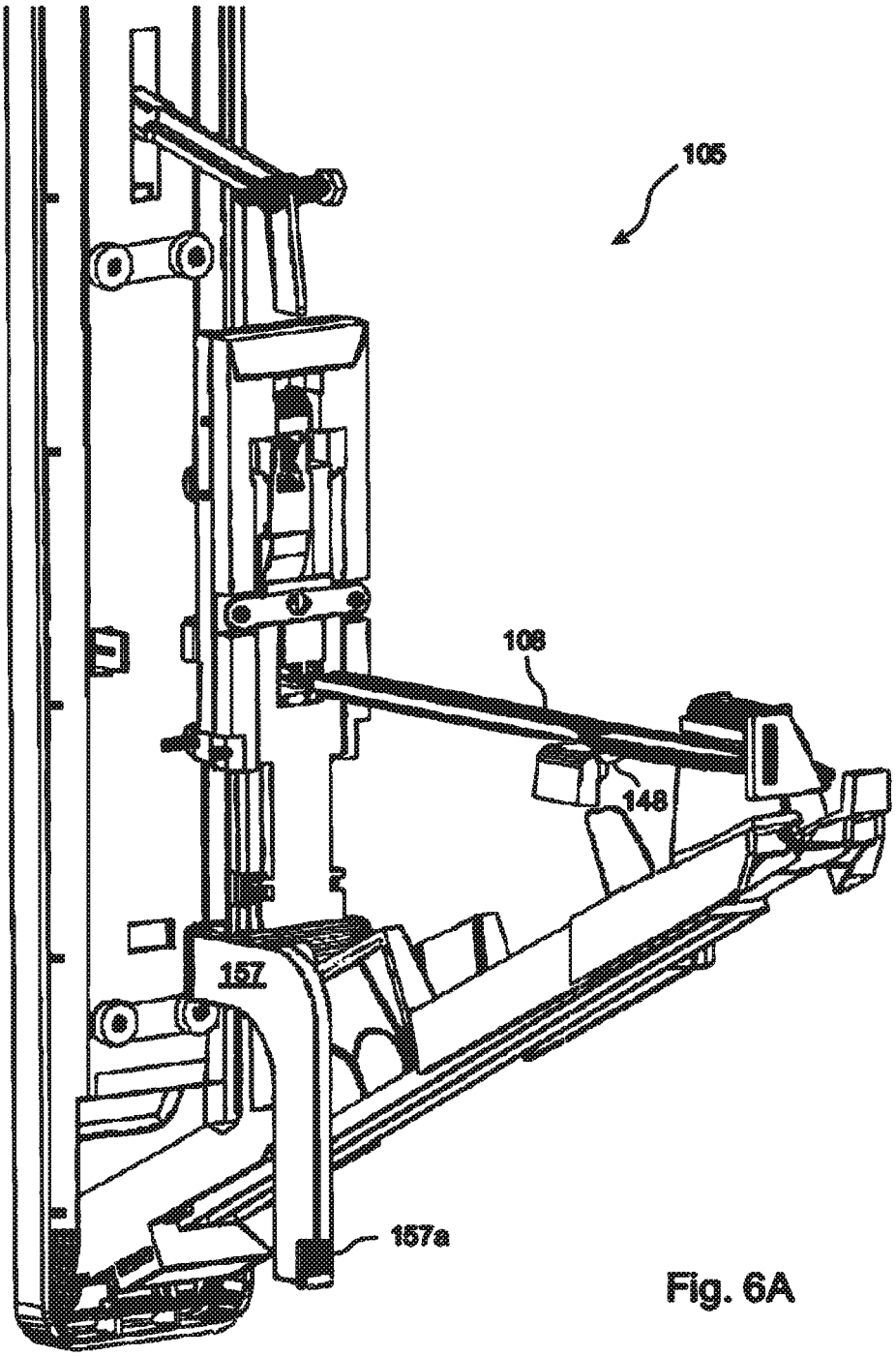
FIGS. 6A-6C illustrate the escapement assembly for a knife dispenser in an embodiment of the present invention.
Figure 6B:
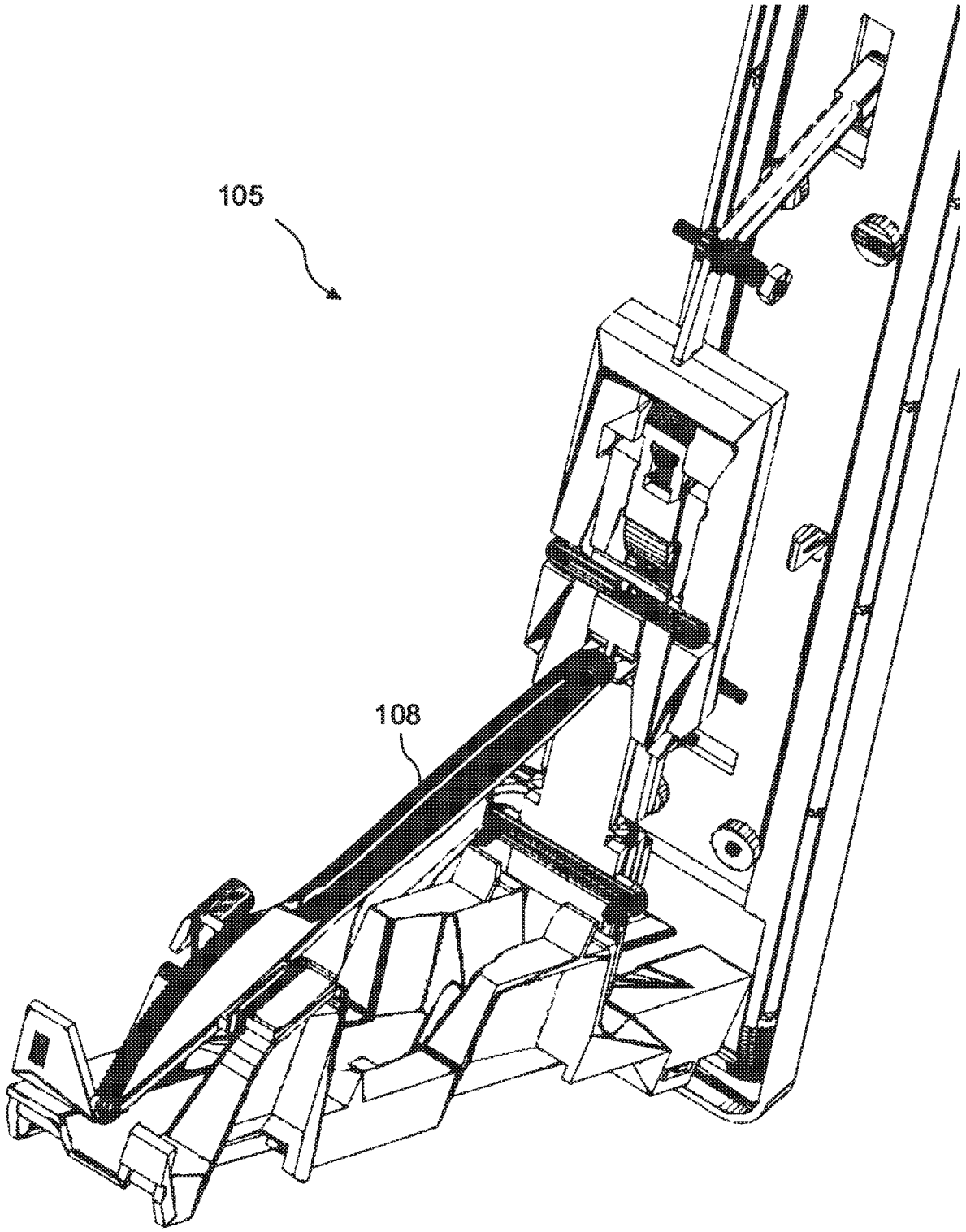
Figure 6C:
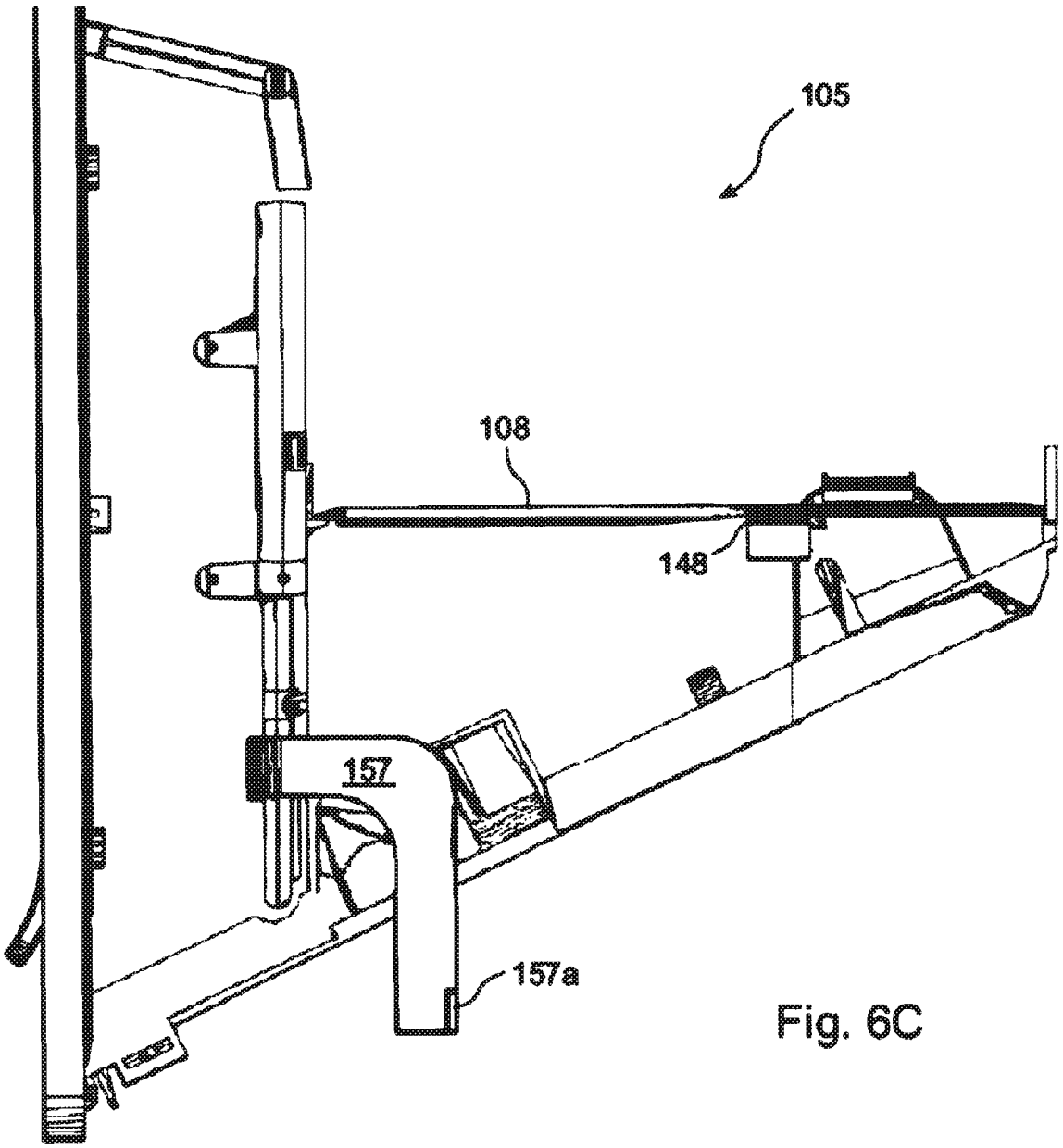

FIG. 5 is a side view of the embodiment shown in FIGS. 4A-4E, illustrating the positions of the cutlery in the dispenser at the moment when the escapement member 154 has just been returned to its rest position after being actuated by the head of the first cutlery article 109. The figure shows the first cutlery article 109 in the act of completing its movement downward and outward from the slide track 170 and out of the dispenser. The proximal handle end of the bottommost cutlery article 108 has fallen below the lower retaining surface 156 and is falling toward the slide track 170 to replace the first cutlery article 109, while the proximal handle end of the next cutlery article 111 in the stack, which was previously retained by the upper retaining surface 159 (now withdrawn and not visible in the figure), is falling toward the lower retaining surface 156 as the next cutlery article 111 is about to become a replacement bottommost cutlery article 108.

FIGS. 6A-7G present an interior view of an embodiment of the present invention that is configured as a knife dispenser 105. Unlike a fork or a spoon, the head portion of a knife, while wider than the handle, is not taller than the handle. For this reason, a knife is not easily retained in the dispensing position by the escapement member 154 if it remains in a horizontal orientation. Instead, the knife dispenser 105 in the illustrated embodiment includes features that cause the bottommost knife 108 to rotate 90 degrees about its long axis as it falls toward the slide track 170. The knife thereby is oriented in the slide track 170 such that the wider blade of the knife extends upward relative to the handle, and is retained by the lower end of the escapement member 154 when the knife reaches the dispensing position.

Figure 7A:
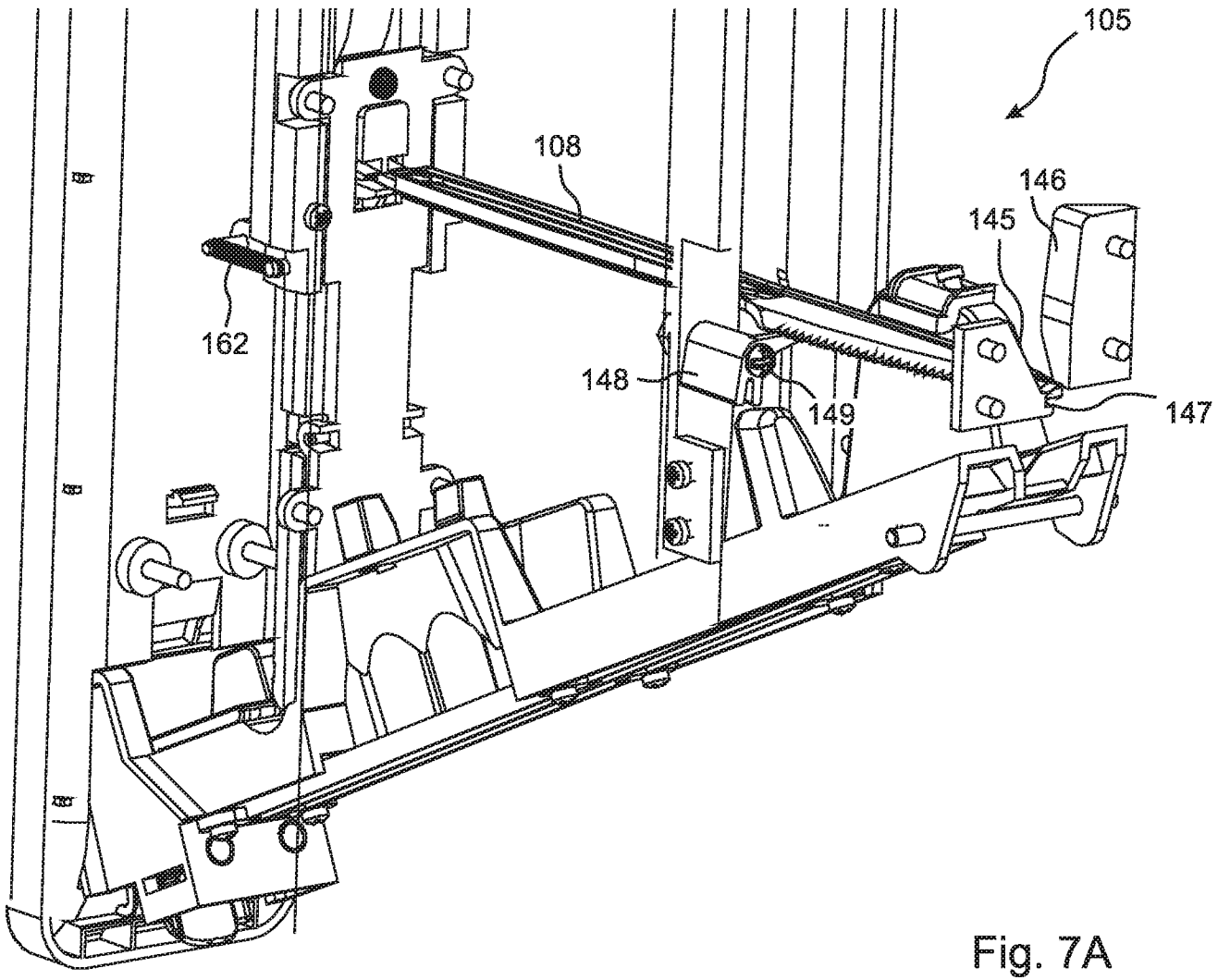
FIGS. 7A-7G illustrate the alignment guides and rollers used in dispensing of a knife from the knife dispenser of FIGS. 6A-6C.
Figure 7B:
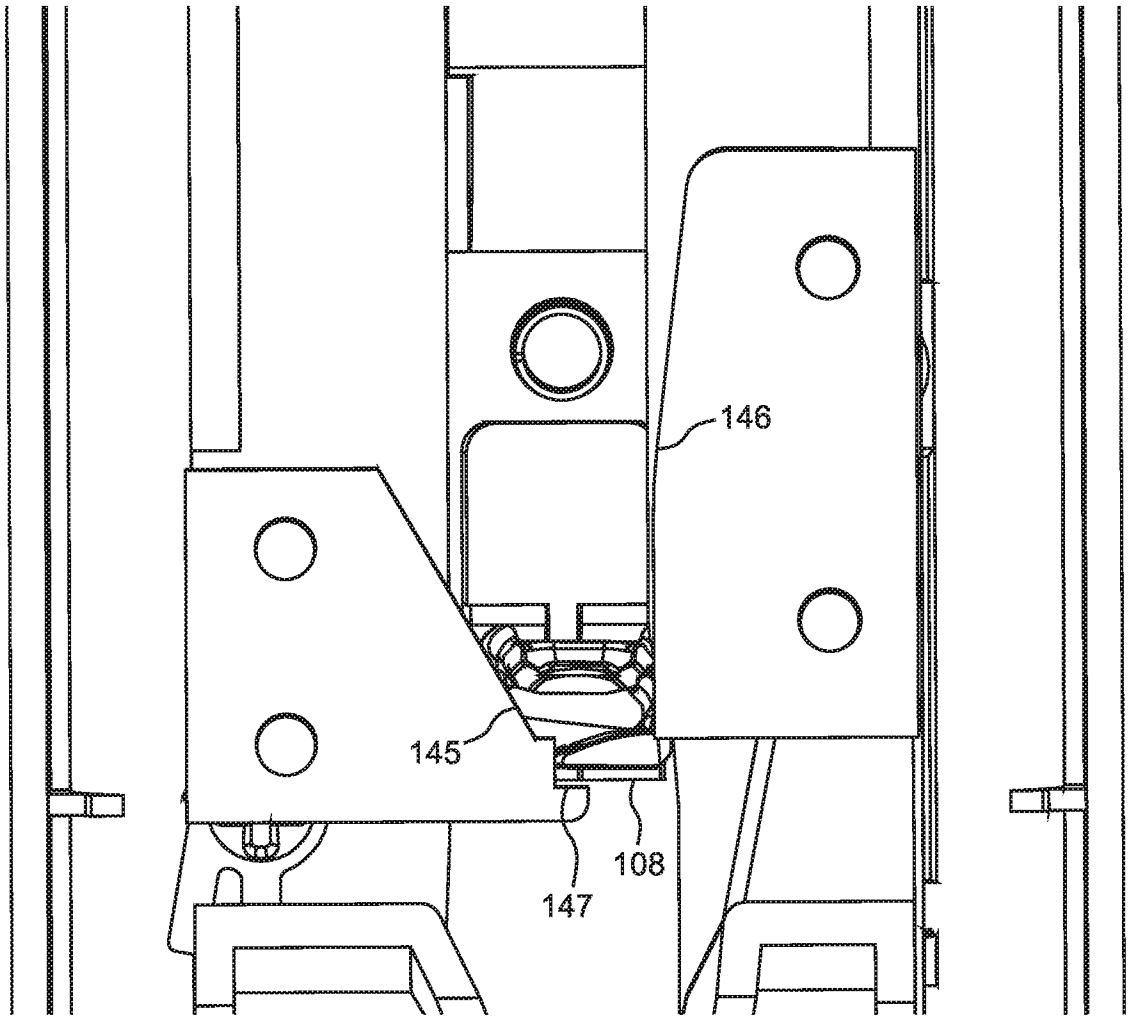
Figure 7C:
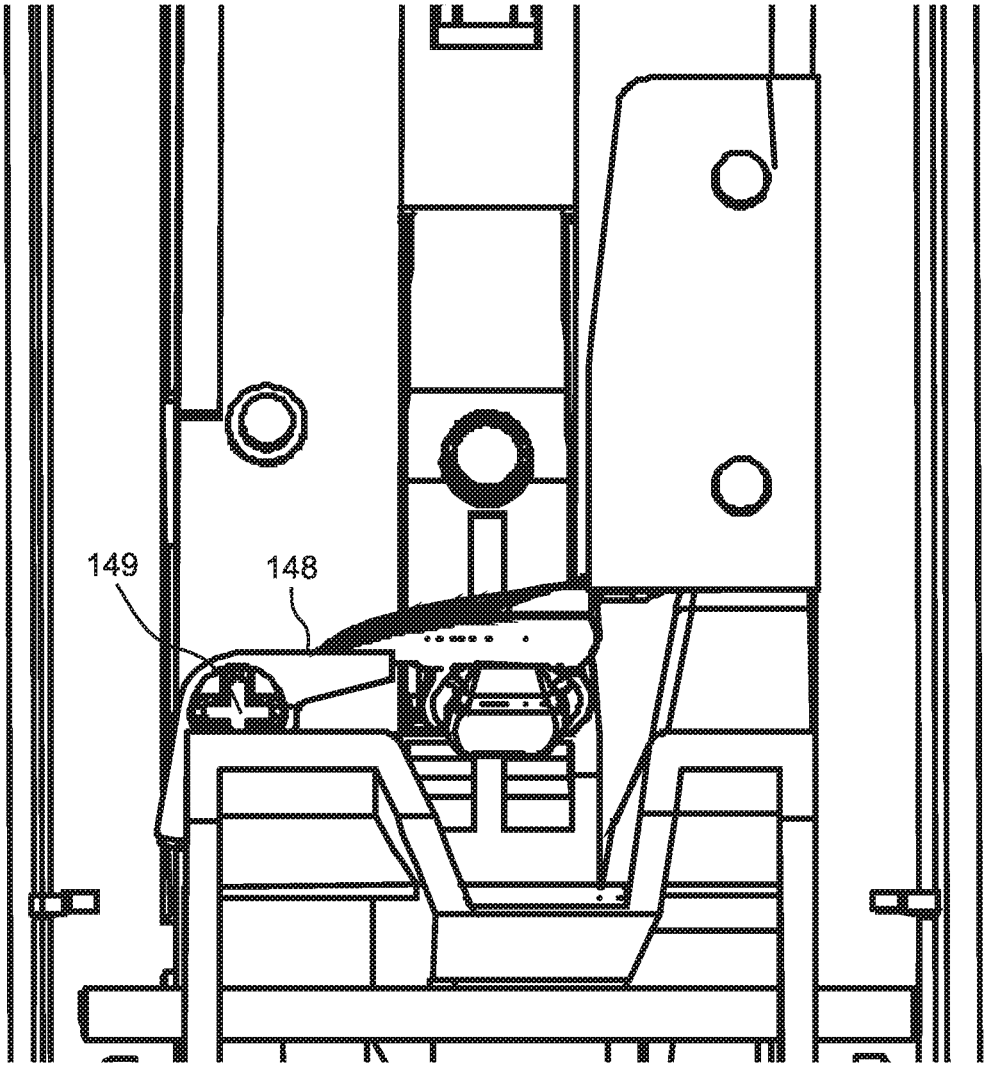
Figure 7D:
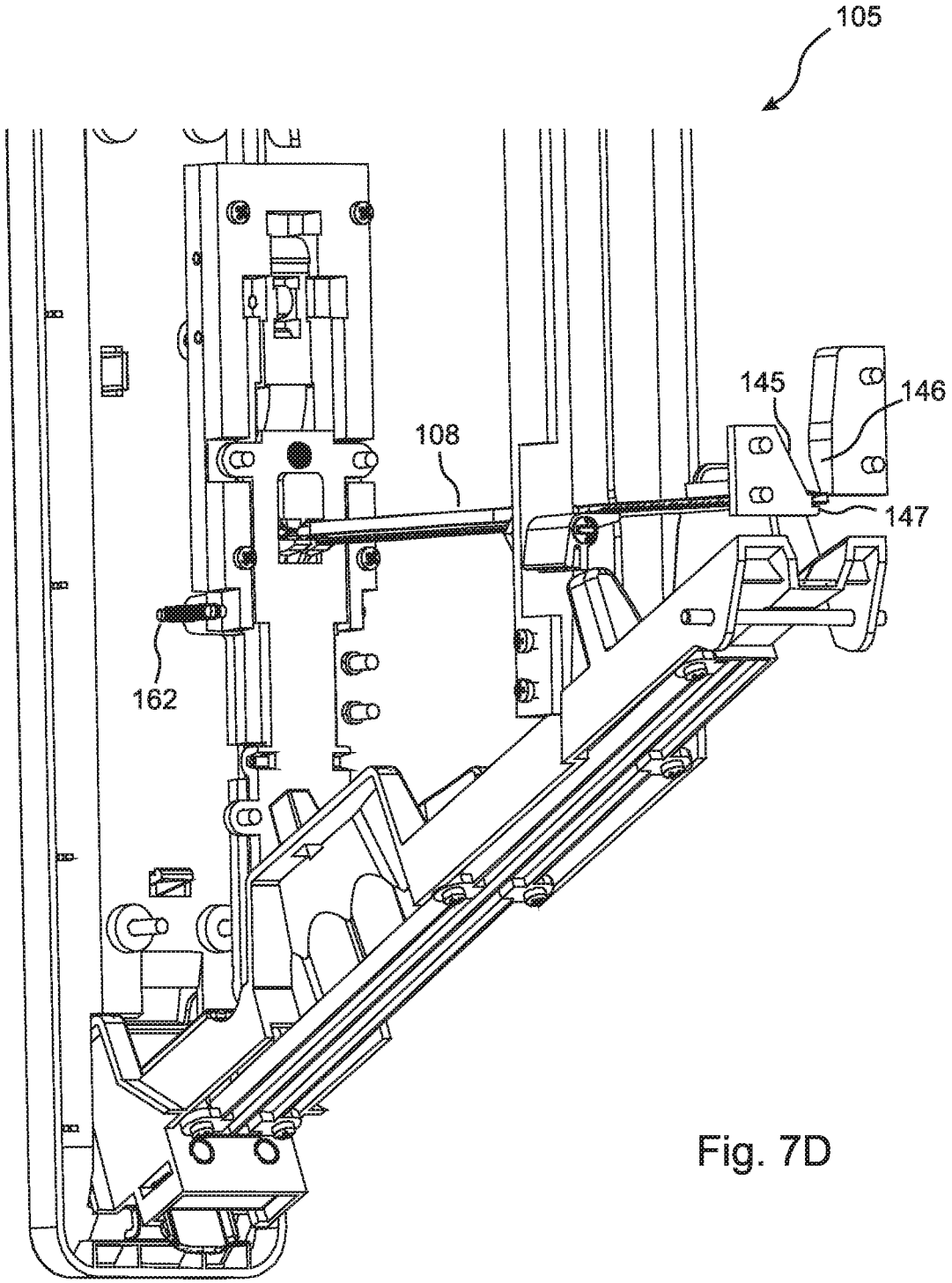
Figure 7E:
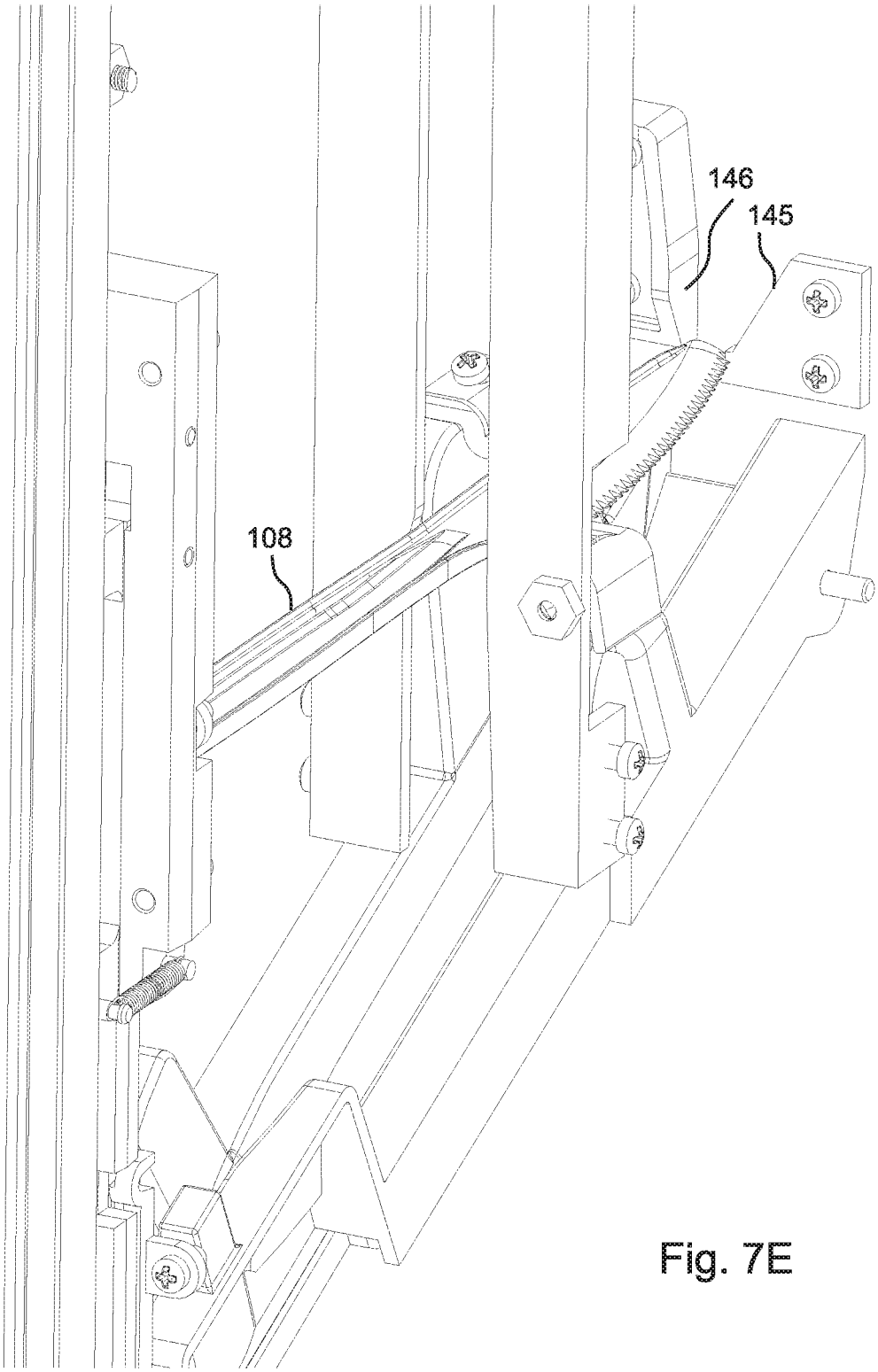

Specifically, as shown in FIG. 7A, guide 146 and angle guide 145 located at the distal end of the dispenser 105 are configured to guide the head (i.e. blade) portion of the bottommost knife 108 to rest on a knife head retaining surface 147. As can be seen for example in the rear view of FIG. 7B, the knife head retaining surface 147 is configured to contact only a portion of the distal end of the bottommost knife 108. As can be seen for example in FIGS. 7A and 7C, the blade of the bottommost knife 108 further rests either on or just above a roller 148, which is connected to the dispenser 105 by a roller pivot pin 149.

Figure 7F:
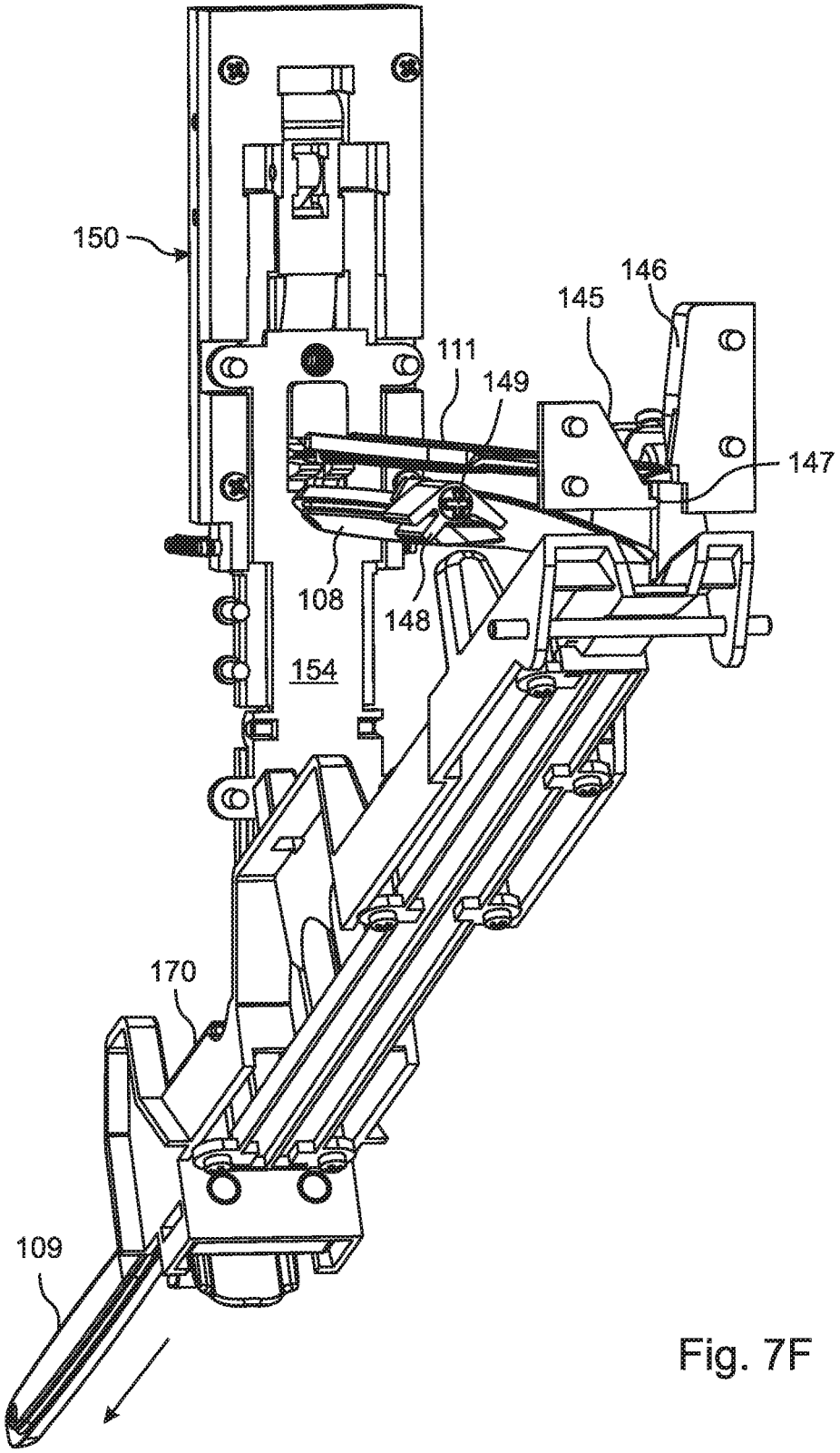
Figure 7G:
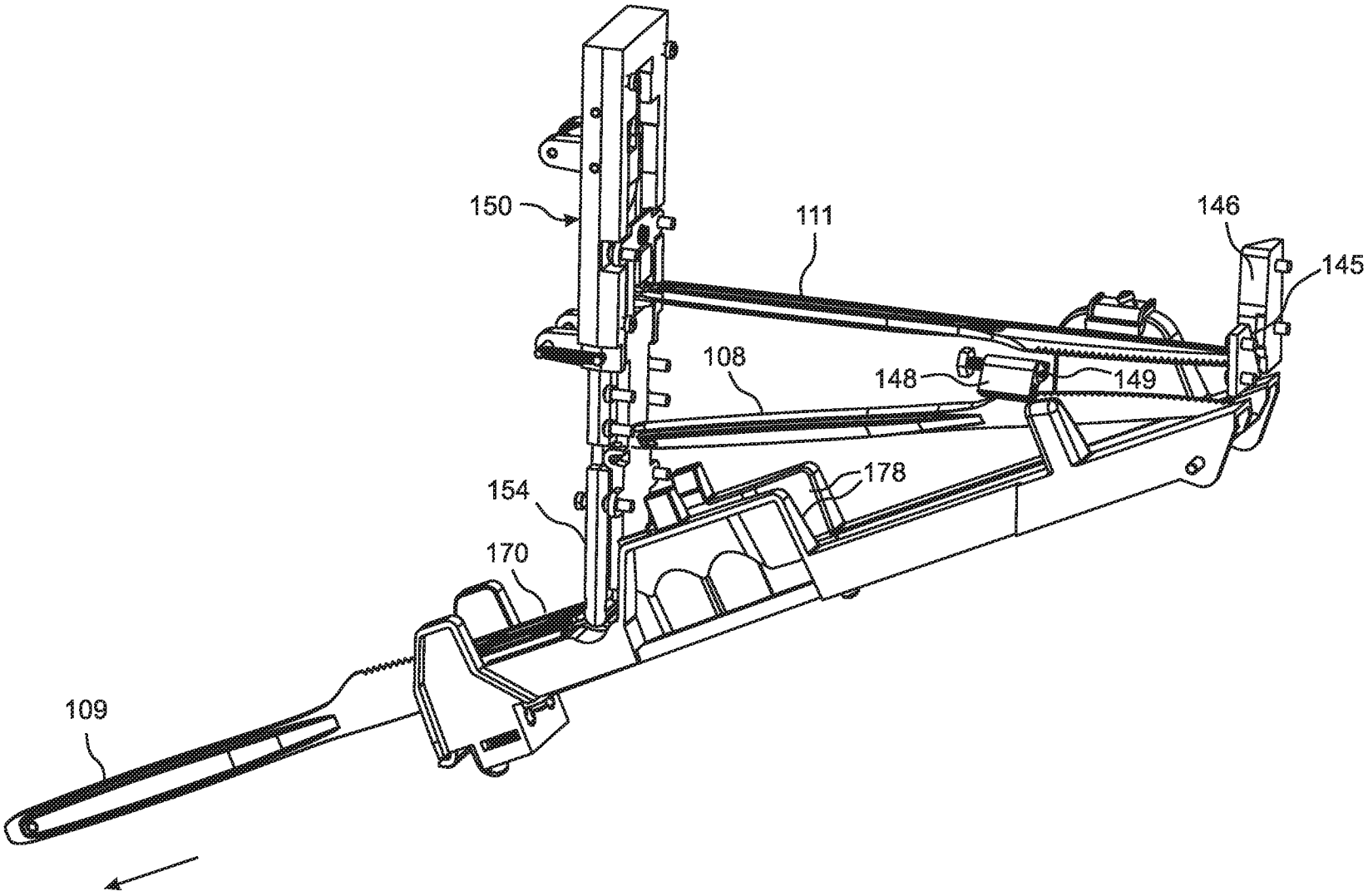

With reference to FIGS. 7F and 7G, in some knife dispenser embodiments the first knife 109 is pulled from the dispenser 105 by a user, causing the bottommost knife 108 to be singulated from the stack 107 (not shown) of stored knives 106, as described above, by withdrawing lower retaining surface 156, leaving no support holding the proximal, handle end of the bottommost knife 108 while the upper retaining surface 159 retains the remainder of the stack 107. As can be seen in FIG. 7F, as the proximal end of the bottommost knife 108 begins to fall, the weight of the knife 108 forces the roller 148, positioned near a mid-point of the knife, to swivel on roller pivot pin 149, causing the knife 108 to rotate from its stacked horizontal position toward a vertical position as the distal, blade end of the knife 108 is pulled off of and falls away from the knife head retaining surface 147. FIG. 7G shows the configuration of FIG. 7F after a short time interval, where the bottommost knife 108 has fallen beyond the roller 148 and is in a nearly vertical orientation. It can be seen that as the knife 108 continues to fall, it will be guided into a fully vertical orientation by guides 178 provided in the slide track 170.

With reference again to FIG. 6C, embodiments of the cutlery dispenser include a primer lever 157 that can be used to actuate the escapement mechanism 150 when there is no cutlery article in the dispensing position, thereby "priming" the dispenser by transitioning the bottommost cutlery article 108 to the dispensing position. The illustrated embodiment includes a cutout in the external housing that corresponds with the bottom end 157*a* of the priming lever 157, allowing the lever 157 to be accessed and pulled through the cutlery release lever window 131 by an operator so as to conveniently feed a starter cutlery article (first cutlery article 109) from the stack 107 into the dispensing position when the dispenser 105 is initially loaded with cutlery (see for example FIG. 1J). As discussed above, in embodiments the dispenser can be slid partway out of the base 101 so as to gain access to the cutlery release lever window 131 and primer lever 157.

Figure 8A:
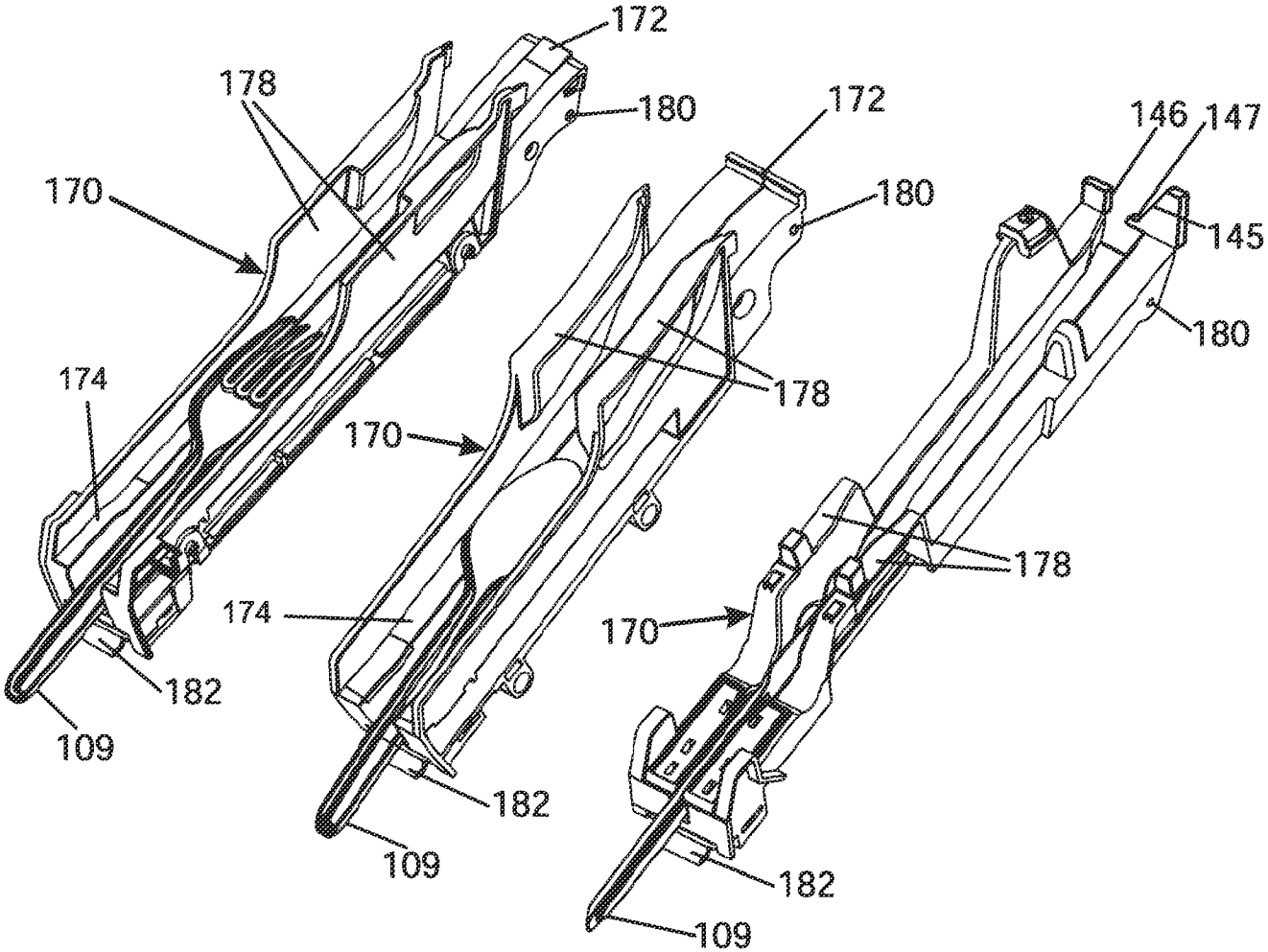
FIG. 8A is a perspective view of the embodiment of FIG. 1A, showing the slide tracks from each of the fork, spoon, and knife dispensers.
Figure 8B:
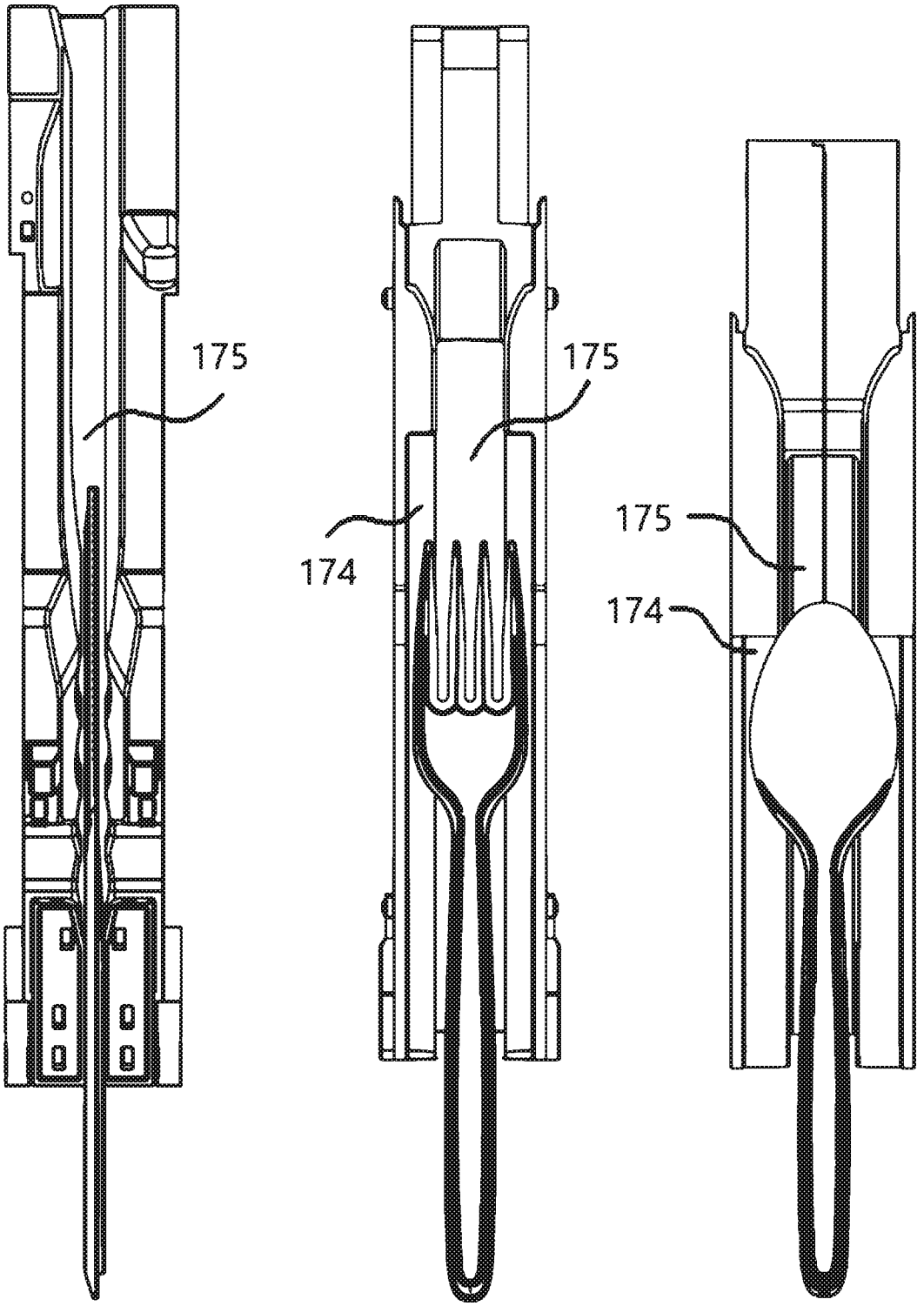
FIG. 8B is a top view of the slide tracks of FIG. 8A, showing a cutlery article in the dispensing position in each of the dispensers.
Figure 8C:
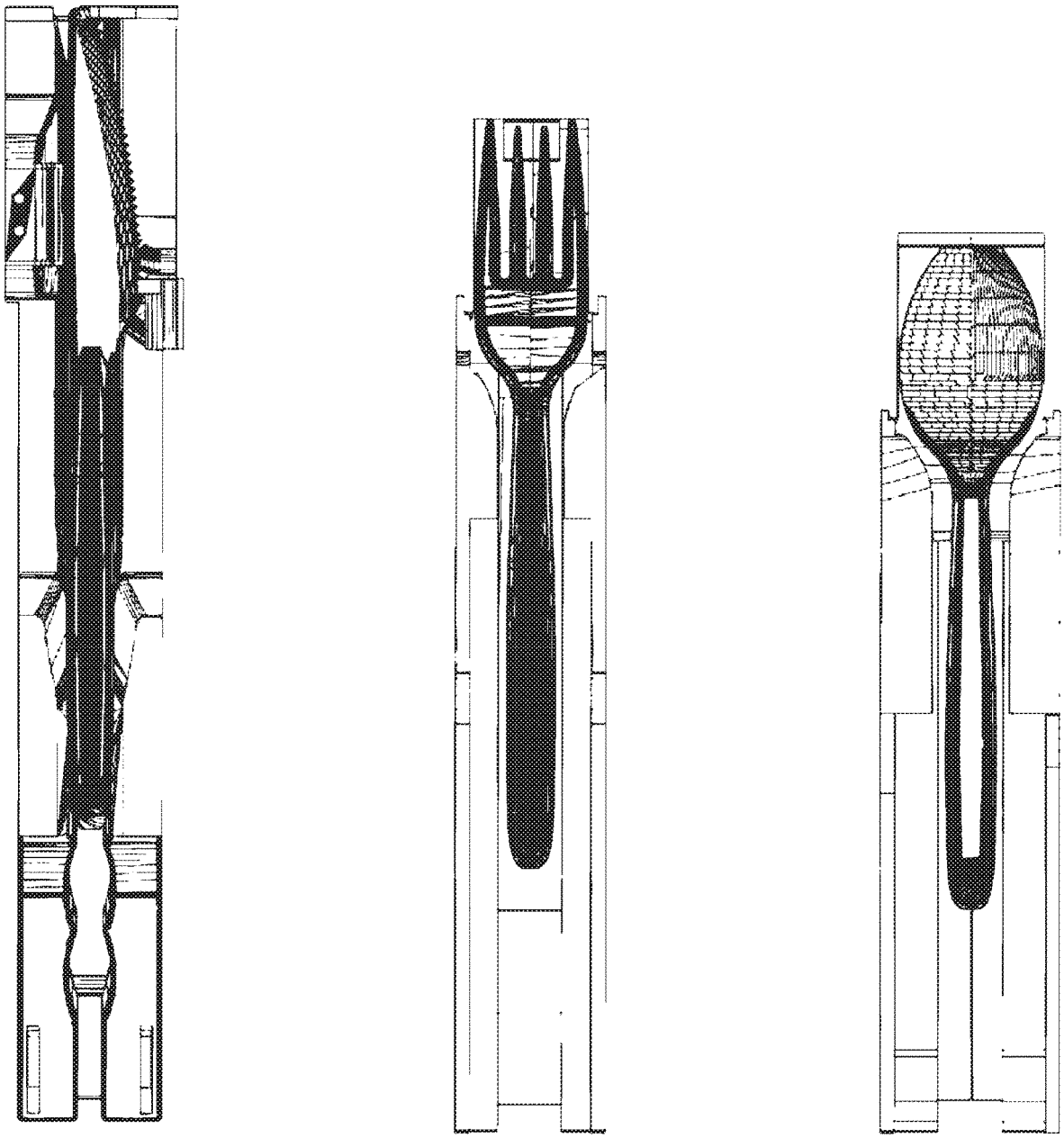
FIG. 8C is a top view of the slide tracks of FIG. 8A, showing a cutlery in the bottommost position in each of the dispensers.
Figure 8D:
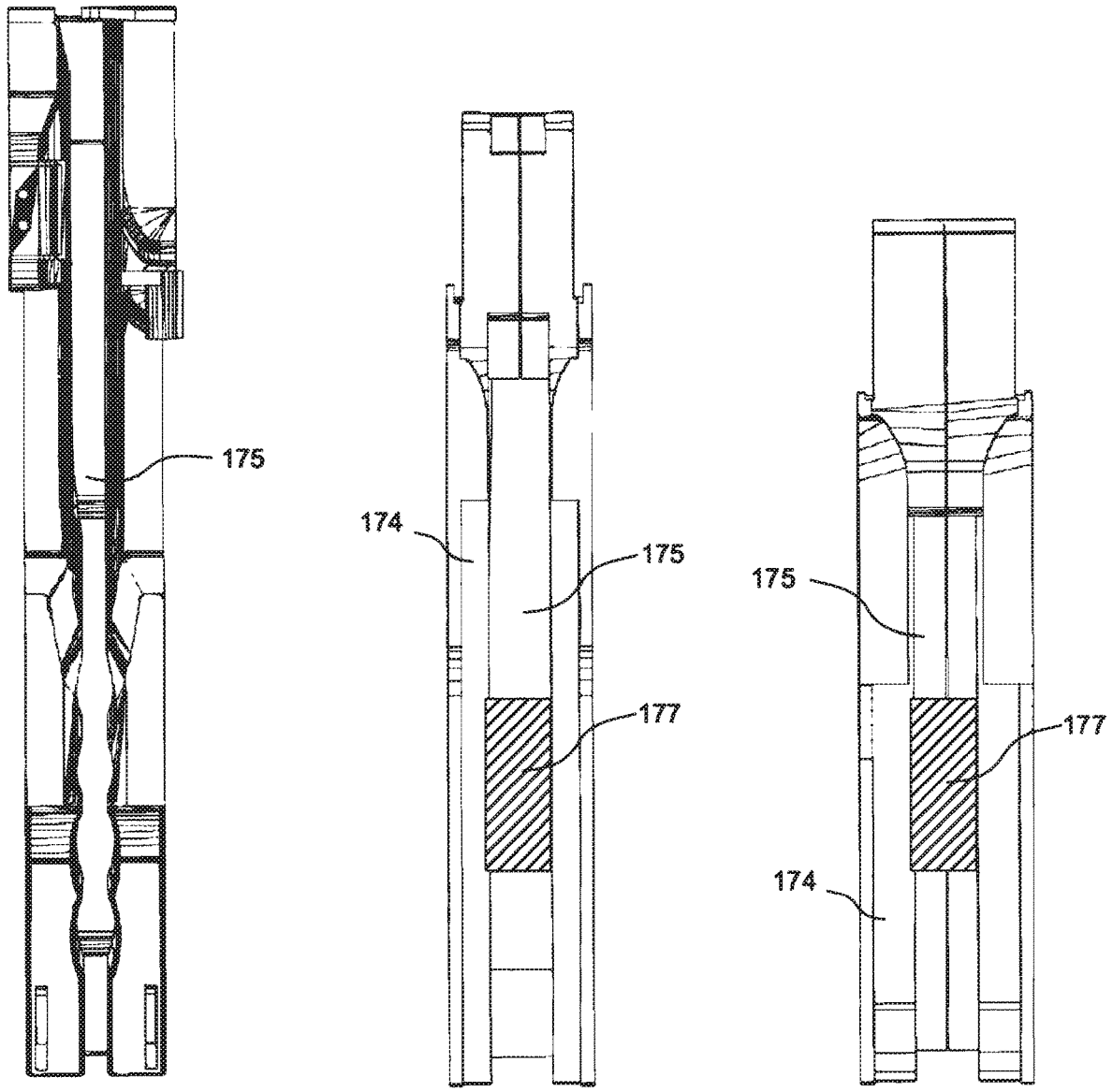
FIG. 8D is a top view of the slide tracks of FIG. 8A, shown without cutlery.

FIG. 8A presents a perspective view of the slide tracks 170 for each of the dispensers 103 (fork), 104 (spoon), and 105 (knife) of FIG. 1A, with a corresponding first cutlery article 109 set in the dispensing position on the slide track 170. FIGS. 8B-8D present various top views of the slide track 170 of the three dispensers 103, 104, and 105, each of the slide tracks having a slide channel 175 configured to accept at least the handle of a bottommost cutlery article 108, or in the case of a rotated knife the entire length of said knife, including the head. At the distal end of each slide track 170, a retaining surface 172 (fork and spoon), 147 (knife) is provided for supporting the head of the bottommost cutlery 108 of the cutlery stack 107 that has been loaded into the dispenser 103, 104, and 105. The dispensers 103, 104, and 105 each have one or more guide skirts 178 that are configured to steer the bottommost cutlery 108 as it is dropping toward the slide track 170 under gravity. FIG. 8B is a top view of the slide tracks of FIG. 8A. The guide skirts 178 are of suitable size and shape to serve as an alignment guide for the bottommost cutlery article 108 as it is released from the cutlery stack 107 and conveyed under the influence of gravity into the dispensing position. For the knife dispenser 103, the guide skirts 178 also function to complete the rotation of the bottommost fork to a vertical orientation.

As can be seen more clearly in FIG. 8B, the slide tracks 170 for each of the dispensers 103, 104 and 105 generally include a central slide channel 175 for guiding the bottommost cutlery as it is released and compelled by gravity toward the dispensing position to become the first cutlery article 109. In the illustrated embodiment, slide channel 175 is configured to accommodate the handle width of the fork and spoon cutlery articles so as to avoid misalignment or skewing thereof, while adjacent slide surfaces 174 are configured to support the head portions of the fork and spoon cutlery articles. In some embodiments, a pair of deflectors 143 (see FIG. 9A) can be provided to keep the handle portion of spoon and fork cutlery articles within central side channel 175.

In preferred embodiments, the slide surface 174 and slide channel 175 are both set at inclination angles ranging from about 25 to about 30 degrees. The inclines of the slide surfaces 174 and slide channels 175 may be configured at different angles from each other within a slide track assembly 170, and can also vary from one type of cutlery article to another depending upon the geometry of the cutlery articles, the mass of the cutlery articles, and the contact area between the cutlery articles and the respective regions of the slide track for controlling or enhancing the sliding of the bottommost cutlery piece. In general, the slide surface 174 and slide channel 175 can be inclined at an angle ranging between 15 degrees and 35 degrees. In a specific preferred embodiment, the slide surface 174 and/or slide channel 175 is set at an incline angle of about 27 degrees to assist the sliding of the bottommost cutlery article 108 into the dispensing position under gravity. In the case of the knife dispenser 105, the slide channel 175 is of an appropriate width to accommodate the thickness of the knife article and maintain the knife article in a rotated orientation edgewise within the slide channel 175.

Figure 9A:
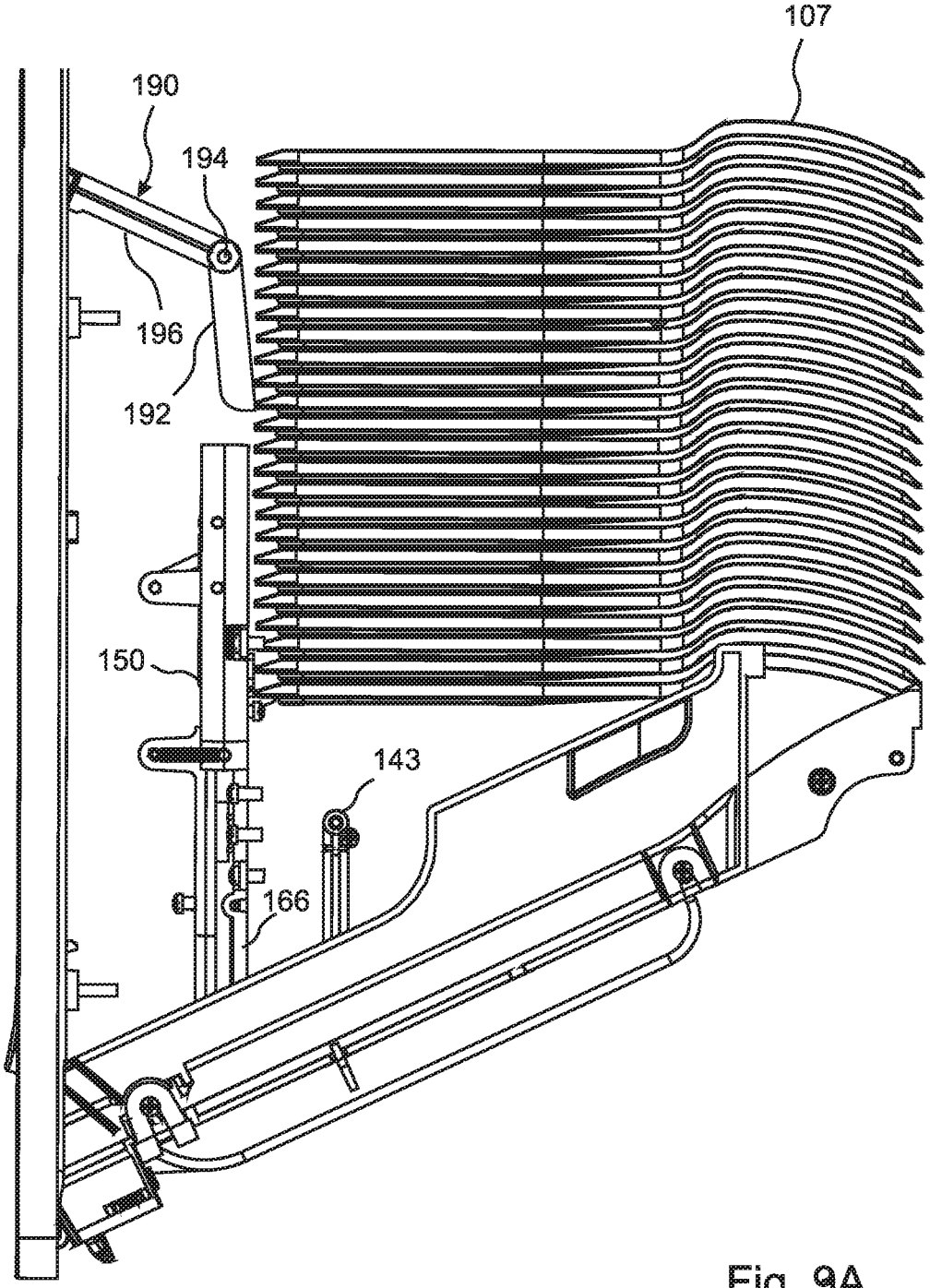
FIG. 9A is a side view of the inside of the fork dispenser of FIG. 1A, showing the low-cutlery indicator in its engaged position.
Figure 9B:
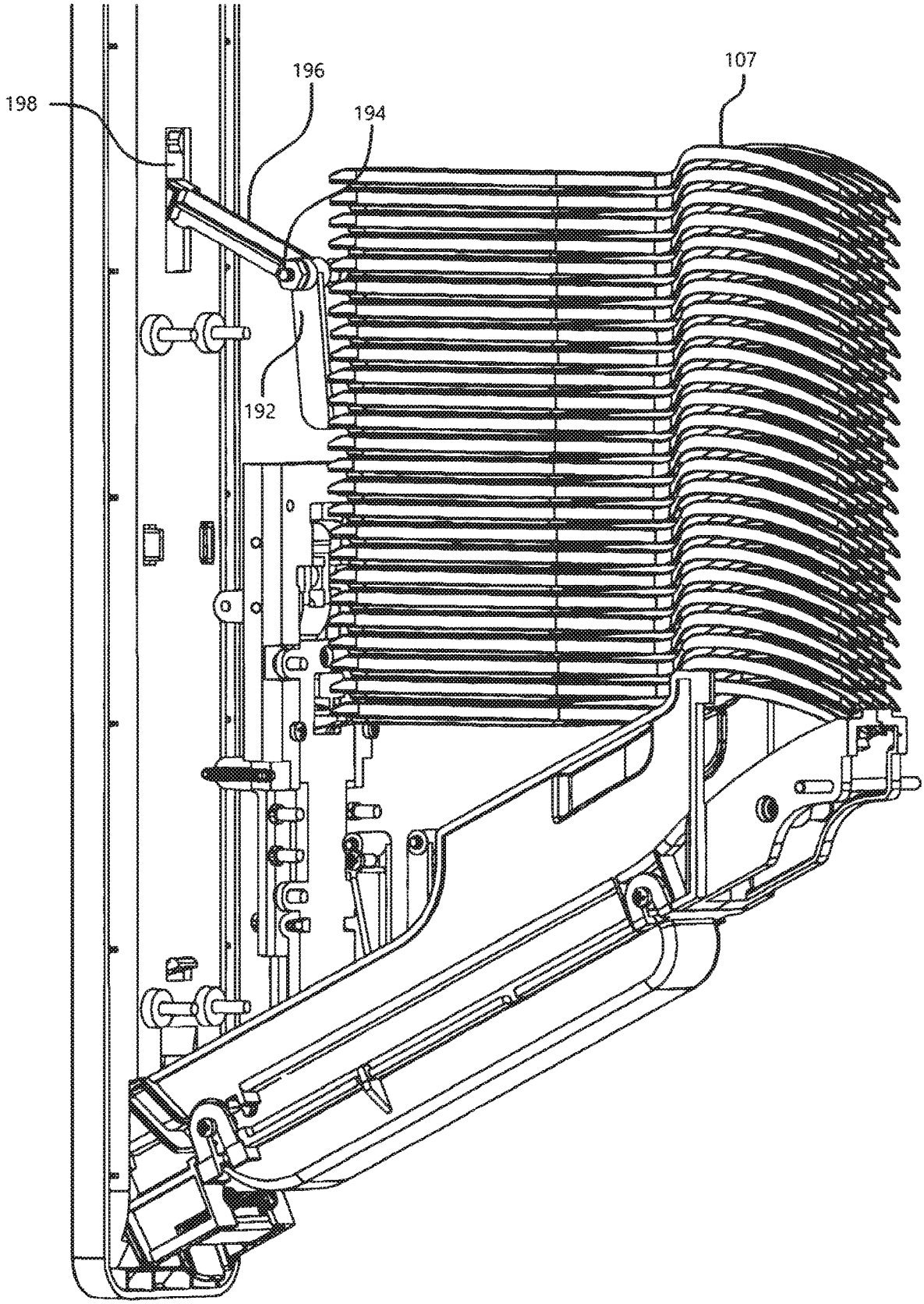
FIG. 9B is a perspective view of FIG. 9A.
Figure 9C:
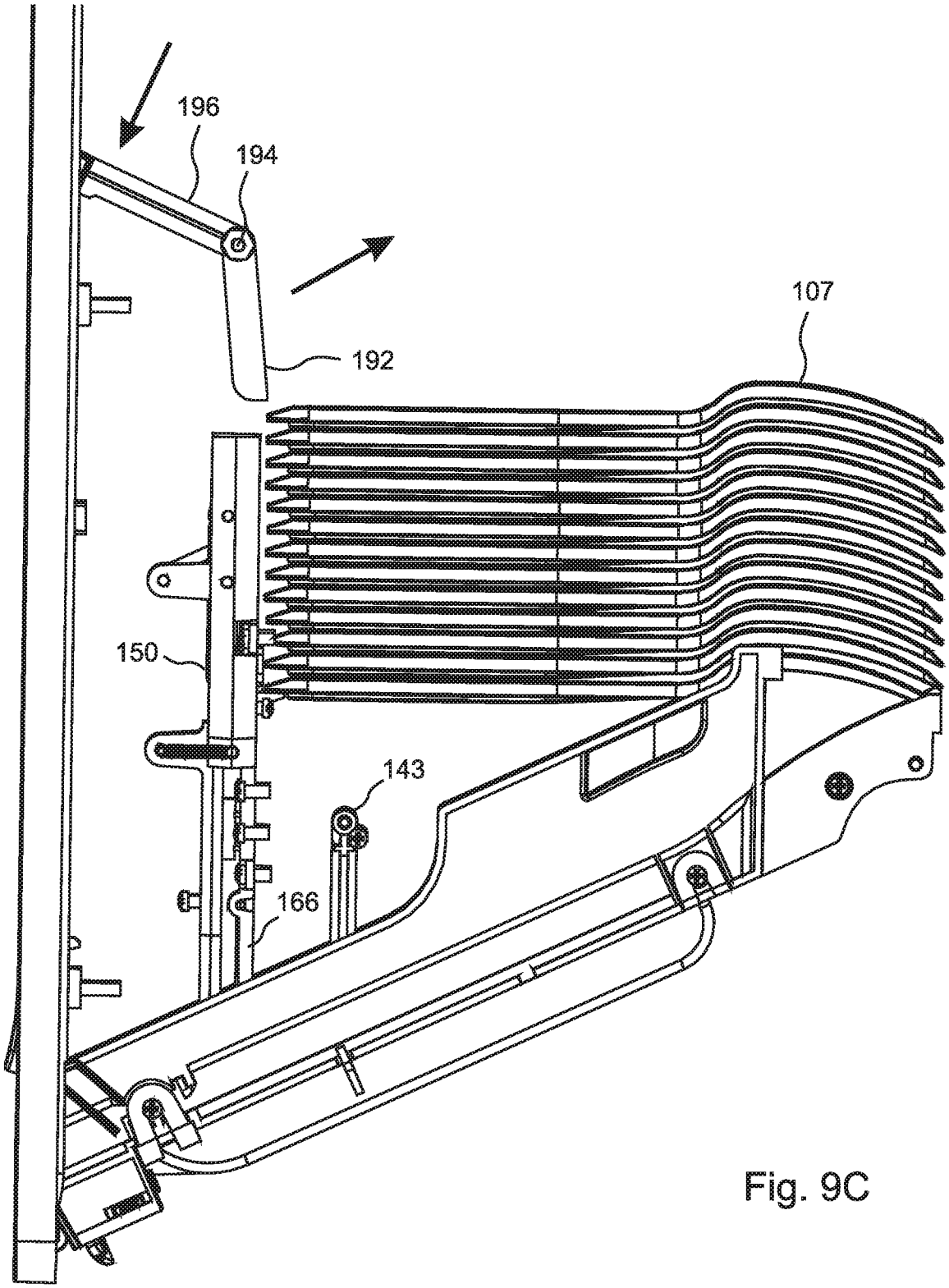
FIG. 9C is a side view of FIG. 9A, showing the low-cutlery indicator in its engaged position immediately before transitioning to its unengaged position.
Figure 9D:
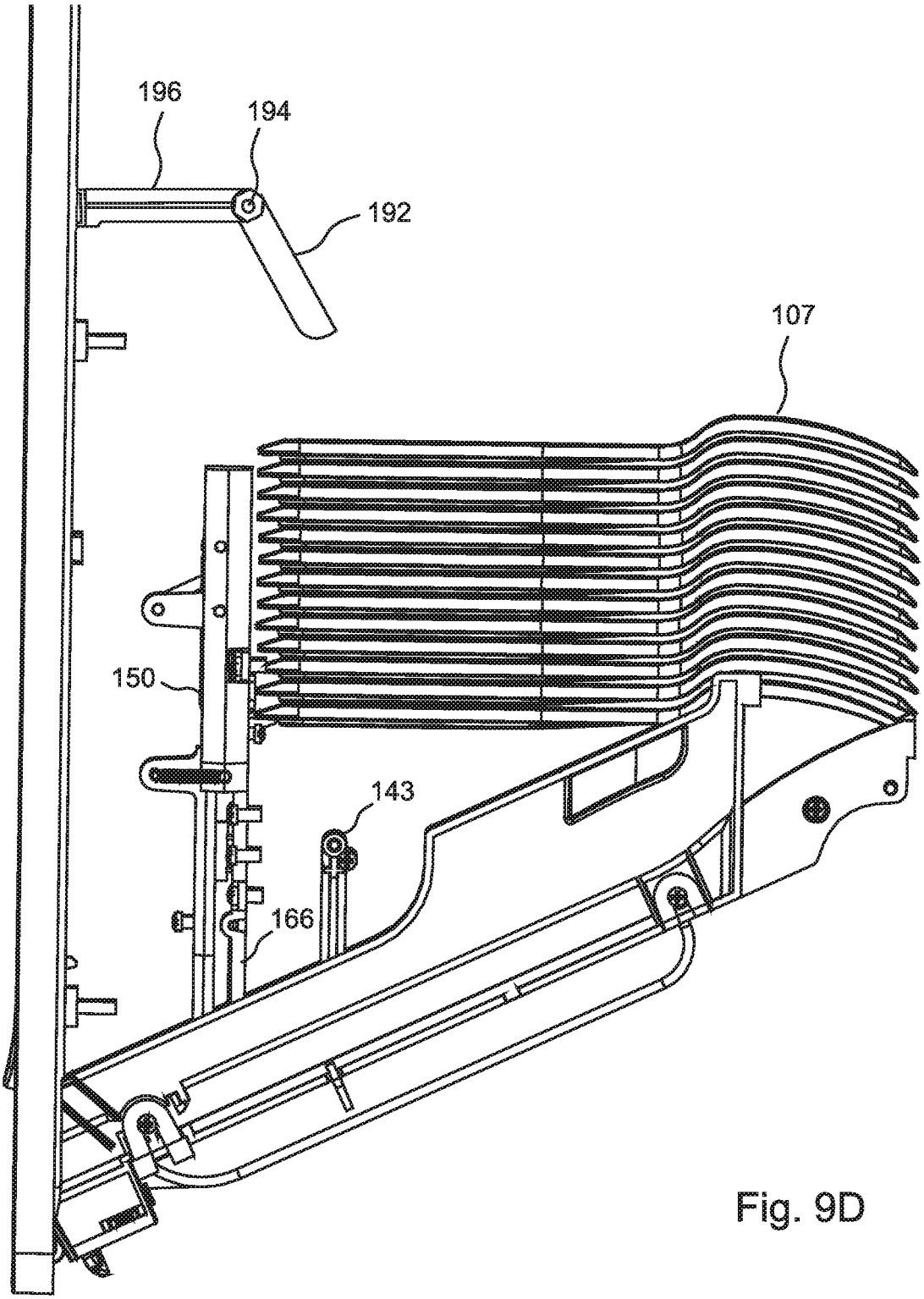
FIG. 9D is a side view of FIG. 9A, showing the low-cutlery indicator in its unengaged position.

Embodiments further include a dampening surface 177 provided on the floor of the slide channel 175 to reduce or limit bouncing of the handle of the bottommost cutlery article 108 as it falls and contacts the slide channel 175 (see FIG. 9D). The dampening surface 177 can be made of a semi-rigid material that can be flexed or momentarily deformed, thereby reducing or limiting recoil of the falling cutlery handle, and reducing or eliminating skewing and/or bouncing of the bottommost cutlery article 108 within the slide track 170. In some embodiments the dampening surface 177 is configured as a thin, semi-rigid metal substrate or foil that is suspended above an open area or cavity, thereby allowing for momentary deformation or flexing of the dampening surface for reducing excessive bouncing or skewing of the falling cutlery.

In various embodiments, the slide track mounting includes a pivot 180 at its distal end and a latch at its proximal end that is accessible to an operator to allow the entire slide track to swing downward for cleaning and/or maintenance. In embodiments, an access latch 182 is located at the proximal end of each slide track 170, thereby providing a means to disengage the proximal end of the slide track from the housing of the dispenser 103, 104, or 105, whereby in conjunction with pivot pin 180, the slide track 170 may be partially rotated downward from the dispenser to allow an operator's hands to access the slide track 170 for cleaning and/or removal of a trapped cutlery article or any other foreign object.

The slide surfaces 174 and/or slide channels 175 can be provided at an incline of 20° to 30° from at least the mid-point of the slide track through the proximal end of the slide track 170, so as to allow the cutlery article 108 to glide smoothly down the slide surfaces 174, 175 under only the influence of gravity, thereby allowing a portion of the handle of the cutlery article 108 to exit from the dispensing area 120, so that the positioning of the cutlery article 108 in the dispensing position is similar to cutlery article 109 shown in FIG. 1A. As noted previously, the incline of slide surfaces 174 and slide channels 175 may be configured at different angles from each other within a slide track 170 in order to enhance sliding of a bottommost cutlery article 108. In the illustrated embodiment, the slide channels 175 for the fork and spoon slide tracks 170 are configured on lower planes than the slide surfaces 174, so as to accept the handle of a cutlery article 106, and are provided so as to increase the gravitational pull on the cutlery article as it descends the slide track 170, by directing the cutlery handle at an increased downward angle.

FIGS. 9A-9D illustrate the structure and operation of the low-cutlery indicator 190 in embodiments of the present invention. In the illustrated embodiment, the low-cutlery indicator 190 includes a contact arm 192 and an indicator arm 196 which are pivotably interconnected by a pivot 194. FIG. 9A is a side view that illustrates the indicator 190 in its engaged position, wherein the contact arm 192 is in contact with the proximal ends of the cutlery 106 in the cutlery stack 107, such that the cutlery stack 107 holds the distal end of the contact arm 192 down, which in turn prevents the indicator arm 196 from pivoting about the pivot 194, so that the indicator arm 196 is not able to drop downward. In various embodiments the low-cutlery indicator 190 can be located as desired within the dispenser 103, 104, or 105 and can contact the distal end of the cutlery stack 107 or any location between the proximal and distal ends of the cutlery in stack 107. FIG. 9B is a perspective view of the configuration of FIG. 9A.

With reference to FIG. 9C, as the cutlery articles from the stack 107 are dispensed, the height of the stack 107 decreases until the top of the stack falls below the contact arm 192, as shown in the figure. At this point, because the distal end of the contact arm 192 is unfettered by any of the cutlery in the stack 107, the indicator 190 is free to pivot about pivot 194 to its unengaged position, causing the indicator arm 196 to rotate to its resting position, as shown in FIG. 9D. Once the indicator arm 196 rotates to its resting position, the low-cutlery signal 198 that is located on the proximal end of the indicator arm becomes visible to an operator or user through the cutlery indicator window 124 as shown in FIG. 1B.

The low-cutlery signal 198 thereby provides a visual indication to an operator or user as to whether the cutlery stack 107 is at or below a certain level or quantity of cutlery. According to the embodiment, the low-cutlery signal 198 can present a single color, such as red, or can present indicia or images to signify a low quantity of cutlery 106 within the dispenser. As discussed above, in other embodiments more than one cutlery level indicator 190 can be provided in a single dispenser, with each cutlery level indicator 190 having its own corresponding cutlery indicator window 124, so as to provide to a user several visual cues as to the quantity of cutlery remaining in the dispenser.

Also visible in FIGS. 9A, 9C, and 9D is a handle deflector 143 located on each side of the dispenser below the bottommost cutlery article 108. The handle deflector 143 is included in embodiments to avoid jamming of the dispenser by helping to guide the handle portion of the bottommost cutlery article 108 downward into the slide channel. In addition, a blocking member 166 can be seen in FIGS. 9A, C and D. The blocking member 166 is pivotally attached to the mounting block 152 (see FIG. 3F), and is configured to swing out with the first cutlery article 109 as it is dispensed, thereby preventing a user from pushing the first cutlery article 109 back into the dispenser and causing a jam.

In embodiments, the dispenser components can be constructed from metal or plastic depending on their use, functionality, properties, and manufacturing ease and cost. One or more components of the dispensing assembly can be manufactured by at least one of thermoforming, injection molding, compression molding, vacuum forming, pressure forming, hydro forming, or any other known method. In some embodiments the dispensers, base, or any parts thereof may be of any desired color, and may be clear, frosted, or semi-opaque. It should be noted that the term "cutlery" is used broadly herein such that it encompasses any cutlery article or cutlery item, including but not limited, to forks, knives, spoons, and sporks. It should further be noted that the dispensed cutlery can be disposable, e.g. plastic cutlery, or permanent ware, e.g. metal cutlery.

Figure 11A:
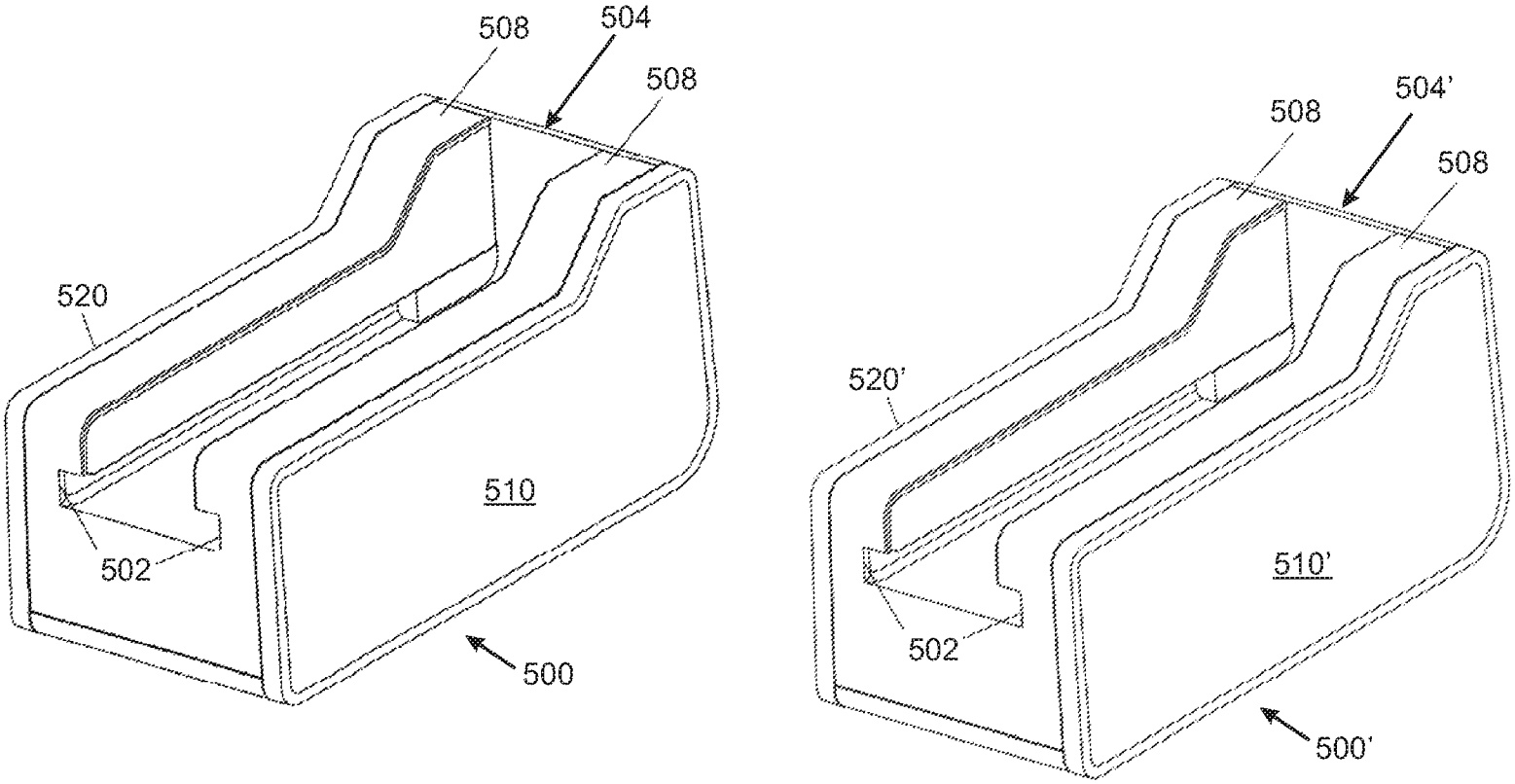
FIG. 11A is a perspective view of a compartmental base unit configured as a 1-compartment dispenser base in an embodiment of the present invention.

With reference to FIG. 11A there is shown a perspective view of a compartment base unit 504 having a single compartment that can be utilized as a stand-alone base 500 for receiving any one of the dispensers 103, 104 or 105 described herein above for locations where space is limited or the event requires a single cutlery dispenser, such as spoons only for a dessert service. The illustrated compartment base unit 504 features side rails 508 extending from the front to the back of the compartment base unit 504 on either side of the compartment formed by pair of channels or slots 502 for receiving the corresponding flanges 212 of any of the dispensers as described above with reference to the 3-compartment base 101 shown in FIG. 10A. The assembled, single-compartment base 500 also includes a pair of end caps or side plates 510 and 520 attached to the compartment base unit 504. A second, identical base 500' is shown in the figure, which includes a compartment base unit 504' and a pair of end caps 510', 520'.

Figure 11B:
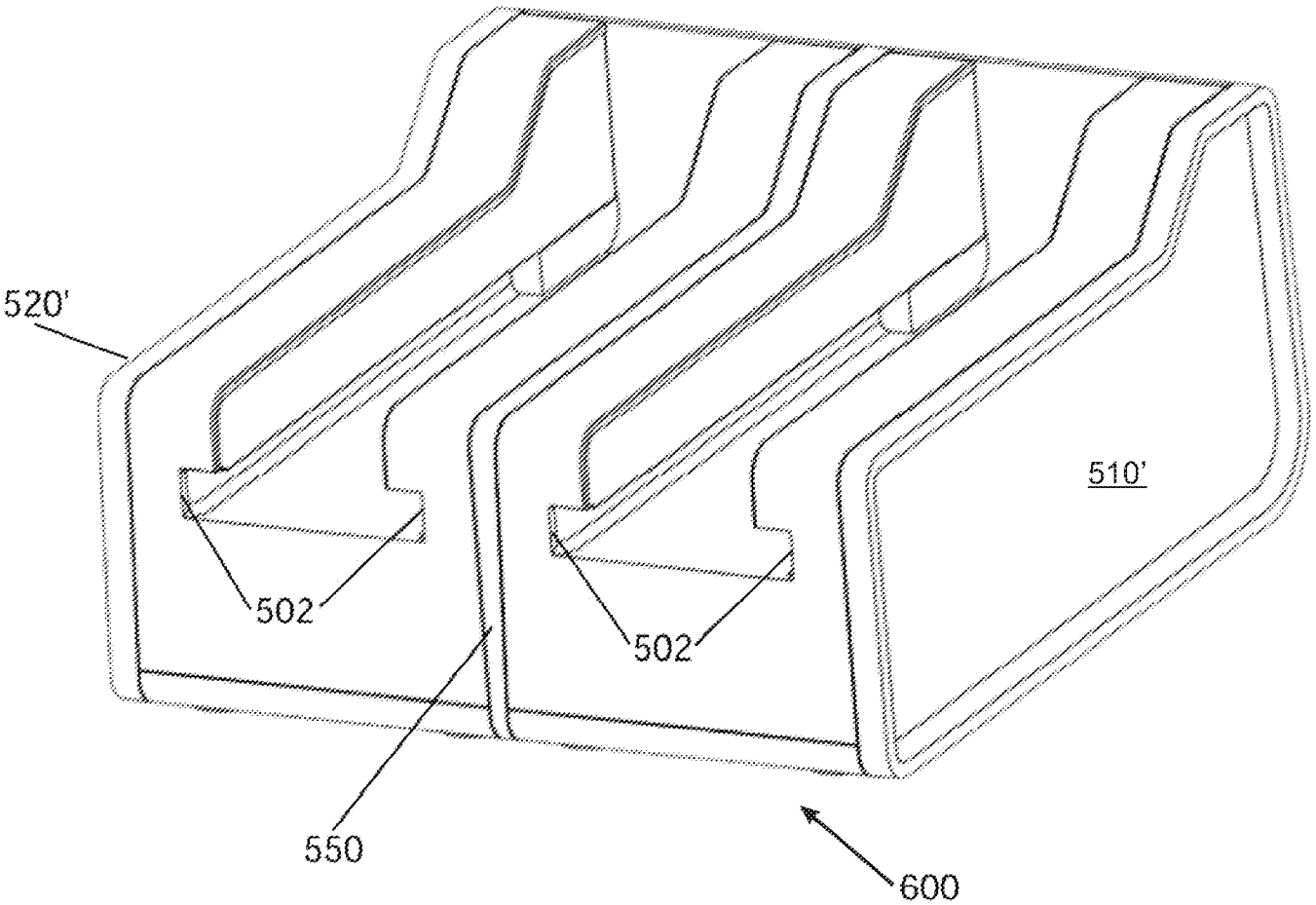
FIG. 11B is a perspective view of a 2-compartment dispenser base configured by ganging together two compartmental base units of the type illustrated in FIG. 11A.

FIG. 11B is a perspective view of a two-compartment base 600 in an exemplary embodiment of the invention that is configured by ganging together the first compartment base unit 504 of FIG. 11A with a second base unit 504' of FIG. 11A through an interconnection feature 550. To configure two compartment base units 500, 500' of the type shown in FIG. 11A for mutual assembly, the inward-facing end caps 510 and 520' are omitted (or removed) and the interconnection feature 550 is installed in their place.

Figure 11C:
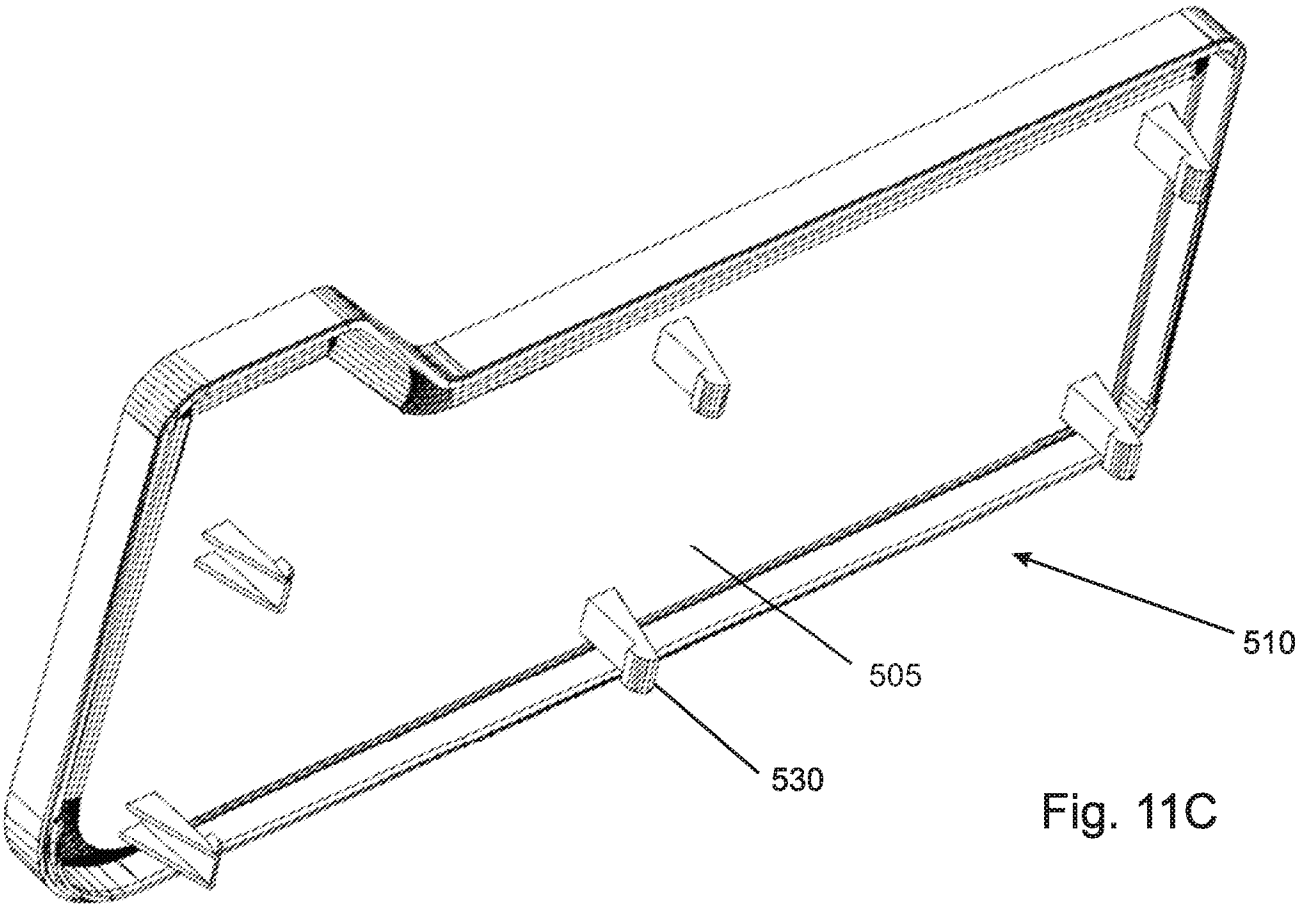
FIG. 11C is perspective view of an end cap that is compatible for use with a compartmental base unit as shown in FIGS. 11A and 11B.

FIG. 11C is a perspective view of an end cap 510 in an exemplary embodiment that is equipped with a plurality of attachment features 530 configured as snap fits that protrude from an inward-facing surface 505 of the end cap 510, the attachment features 530 being configured for engagement with corresponding receptacles (535 in FIGS. 11F and 11H) provided in compartment base unit 504. The snap fit attachment features 530 of the end caps 510 and 520 allow for easy assembly and disassembly with the compartment base unit 504, so that compartment base unit 500 can be customized and ganged together with other base units as needed.

Figure 11D:
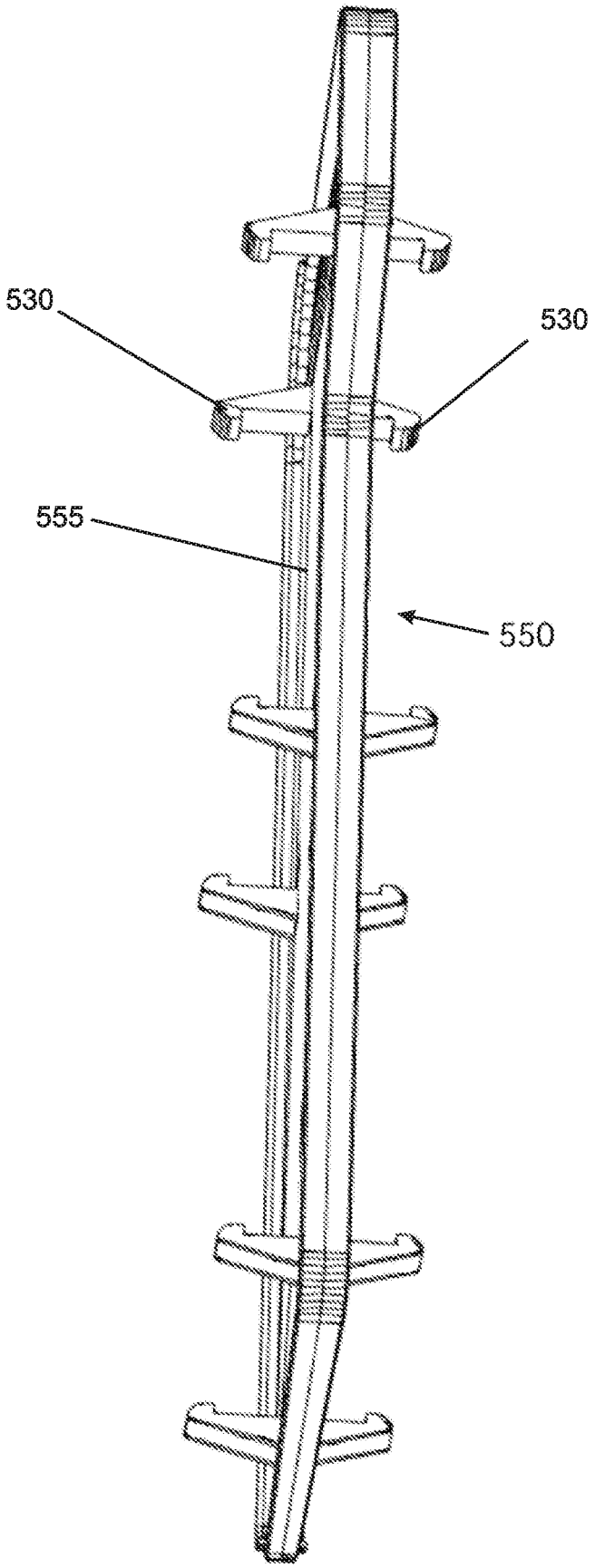
FIG. 11D is a perspective end view of an interconnection feature that is compatible for interconnecting compartmental base units as illustrated in FIGS. 11A and 11B.

FIG. 11D is an end perspective view of an interconnection feature 550 in an exemplary embodiment, where the interconnection feature 550 is equipped with a plurality of snap fits 530 that extend outwardly from both sides of a central wall 555 of the interconnect feature for engagement with corresponding receptacles 535 that are provided in the compartment base units 504, 504'. It will be understood that in embodiments the attachment features can include latches, hooks, interference fit protrusions, hook and loop sections, screws, adhesives, screws, and any other types of attachment features as are known in the art.

Furthermore, it will be clear to those of skill in the art that a plurality of interconnection features 550 can be used in between adjacent compartment base units to interconnect together a plurality of compartment base units to provide base configurations having any desired number of compartments, including two, three, four, five, six, or more than six compartments.

Figure 11E:
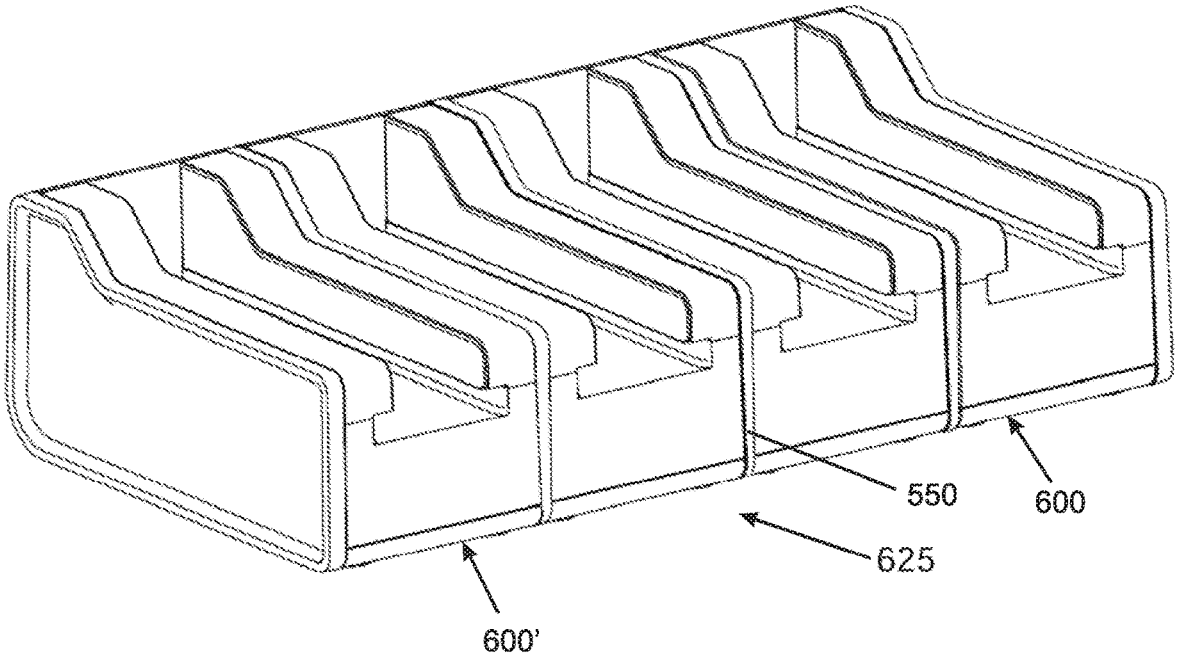
FIG. 11E is a perspective, assembled view of a four-compartment base formed by combining two compartmental base units, each of which includes two compartments.
Figure 11F:
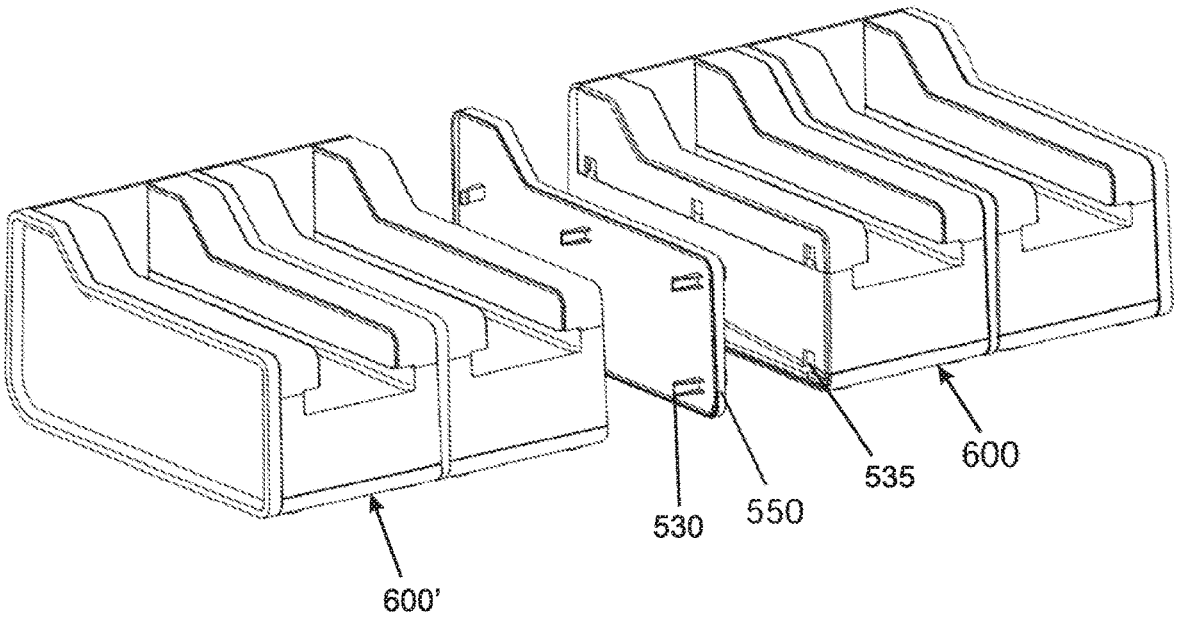
FIG. 11F is an exploded perspective views of the four-compartment base of FIG. 11E.

FIGS. 11E and 11F are perspective assembled and exploded views respectively of a four-compartment base 625 obtained by combining two compartment base units 600 and 600' using a single interconnection feature 550, where each of the compartment base units 600, 600' provides two compartments.

Figure 11G:
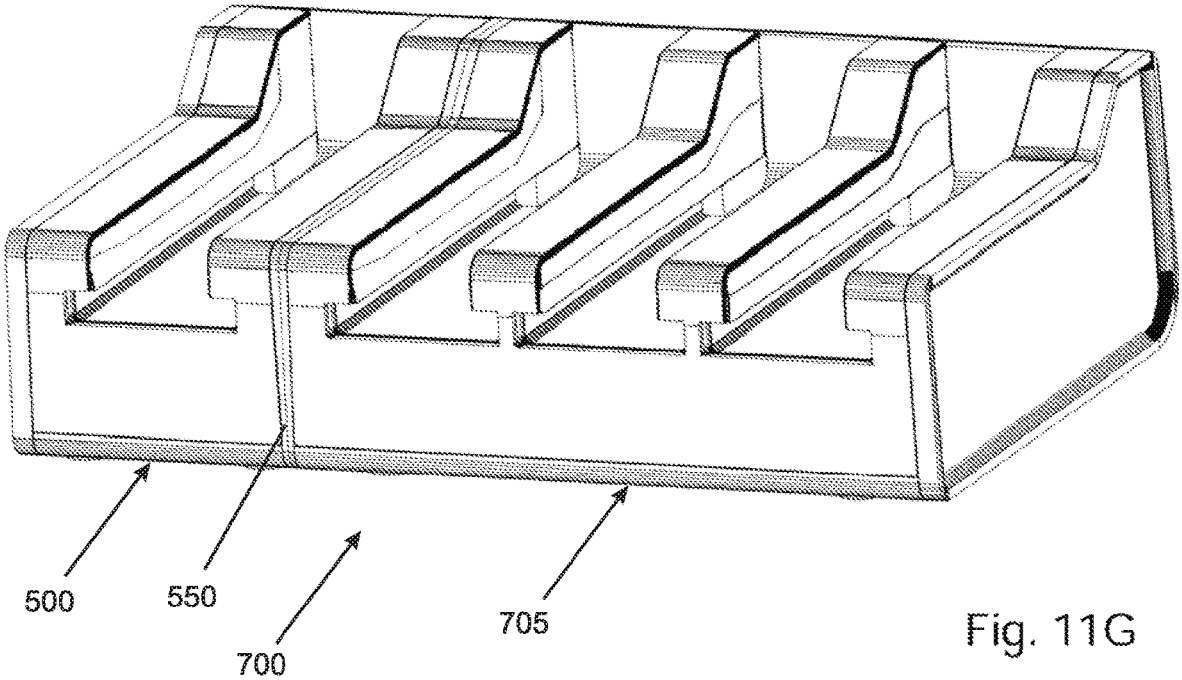
FIGS. 11G-11H are exploded and assembled perspective views, respectively, of a four-compartment base formed by combining a single-compartment base unit with a three-compartment base unit.
Figure 11H:
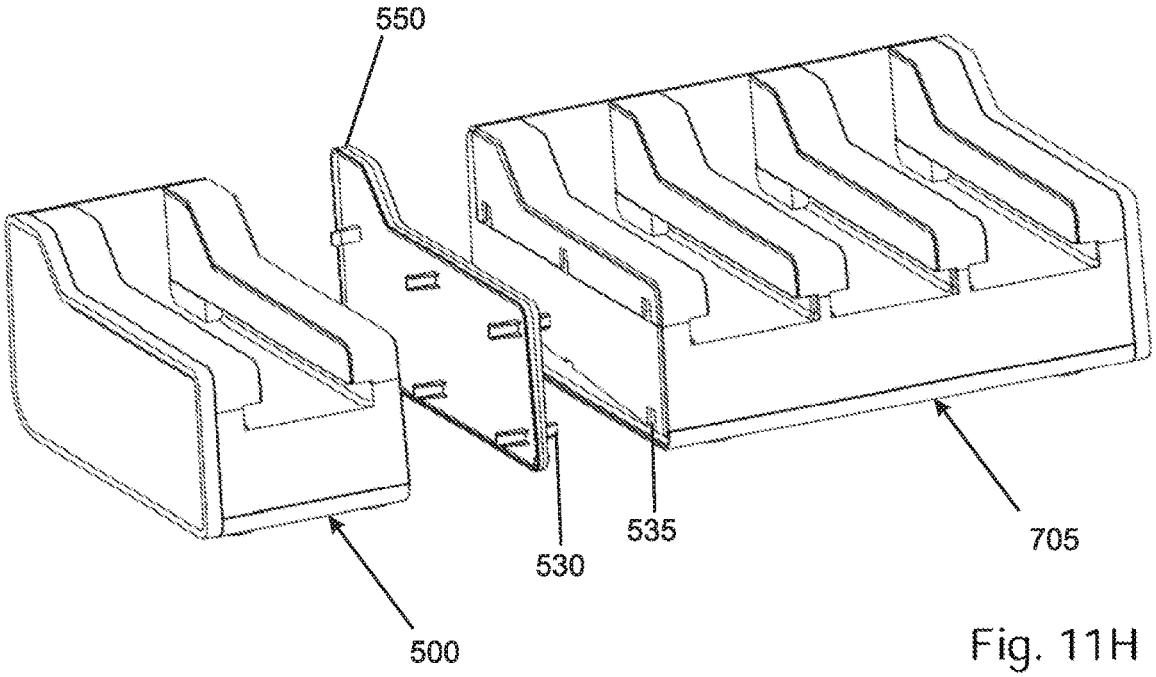

It will be further understood that the compartment base units that are assemble to provide a multi-compartment base need not be identical to each other. FIGS. 11G and 11H are assembled and exploded views, respectively, of a four-compartment base 700 obtained by using a single interconnection feature 550 to combine a compartment base unit 500 having a single compartment with a compartment base unit 705 having three compartments. It should therefore be clear that a wide variety of different base configurations can be obtained in various embodiments by selecting compartment base units of various configurations as building blocks, and securing them together by interposing an interconnection feature between each adjoining pair of compartment base units.

Furthermore, while the present invention is described herein with exemplary reference to dispensing of cutlery used for consuming food, it should be understood that scope of the present invention is not limited only to dispensing of such cutlery. Instead, it should be understood that the term "cutlery" is used broadly herein to refer to any elongate object that includes a handle portion and a head portion, where the head portion is wider and/or taller than the handle portion. Accordingly, the dispenser of the present invention is application to dispensing of many and various medical and dental tools, as well as other objects that are not directed to the consumption of food.

The foregoing description of the embodiments of the invention has been presented for the purposes of illustration and description and not for limiting the scope of the invention. Each and every page of this submission, and all content herein, however characterized, identified, or numbered, is considered a substantive part of this application for all purposes, irrespective of form or placement within the application. This specification is not intended to be exhaustive. Although the present application is shown in a limited number of forms, the scope of the invention is not limited to just these forms, but is amenable to various changes and modifications without departing from the spirit thereof. It will be apparent to those skilled in the art from the foregoing description that many modifications and variations to the embodiments shown herein are possible in light of this disclosure. Accordingly, the claimed subject matter includes any combination of the above-described elements in all possible variations thereof, unless otherwise indicated herein or otherwise clearly contradicted by context. In particular, the limitations presented in dependent claims below can be combined with their corresponding independent claims in any number and in any order without departing from the scope of this disclosure, unless the dependent claims are logically incompatible with each other.

We claim:

1. A cutlery dispenser configured to serially dispense a plurality of cutlery articles, each of the cutlery articles having a handle and a head arranged at opposite ends of a long axis of the cutlery article, the head being at least one of wider and taller than the handle, wherein the cutlery dispenser includes:

a housing having a front, a rear, two sides, a top, and a bottom, a front-facing width thereof being smaller than a side facing depth thereof;

a dispenser cavity located in an upper region of the dispenser within the housing, the dispenser cavity being configured to contain a vertical stack of the cutlery articles, the vertical stack being terminated at its bottom end by a bottommost cutlery article of the vertical stack;

an escapement mechanism configured to retain a first cutlery article of the plurality of cutlery articles in a dispensing position whereby the handle of the first cutlery article extends beyond the front of the dispenser housing, the escapement mechanism being configured such that removal by a user of the first cutlery article from the dispenser by grasping and pulling of the handle thereof actuates the escapement mechanism, causing the bottommost cutlery article to be singulated from the stack and gravitationally transitioned to the dispensing position, while a remainder of the stack is retained in the dispenser cavity, whereby the bottommost cutlery article becomes a replacement first cutlery article, and a next cutlery article in the stack becomes a replacement bottommost cutlery article; and a downward sloping slide track;

wherein the dispenser is configured to rotate the bottommost cutlery article about its long axis from a horizontal to a vertical orientation as it falls from the stack onto the slide track, so that the head of the bottommost cutlery article extends upward above the slide track and is retained by the escapement mechanism in the dispensing position.

2. The cutlery dispenser of claim 1, wherein the escapement mechanism comprises at least three pivoting members interconnected by at least three distinct pivots.

3. The cutlery dispenser of claim 2, wherein the escapement mechanism comprises:

an escapement member configured to retain the first cutlery in the dispensing position by contact between the head of the first cutlery article and a bottom end of the escapement member;

a lower retaining surface cooperative with the escapement member and configured to support a proximal end of the bottommost cutlery while a distal end of the bottommost cutlery is supported by a supporting surface proximate a distal end of the track;

a swing member pivotally cooperative with the escapement member; and an upper retaining surface cooperative with the swing member and positioned at an elevation between the proximal ends of the handles of the bottommost cutlery article and the next cutlery article in the vertical stack;

the escapement mechanism being configured such that when the handle of the first cutlery article is grasped by the user and the first cutlery article is removed from the dispenser:

the bottom end of the escapement member is pulled forward by the head of the first cutlery article as the first cutlery article passes beneath the escapement member;

the first retaining surface is withdrawn from beneath the proximal end of the bottommost cutlery article;

the swing arm is actuated by the escapement member, causing the second retaining member to pivot and be inserted beneath the proximal end of the handle of the next cutlery article;

the bottommost cutlery article falls downward from the vertical stack onto the slide track and is guided by the slide track as it slides gravitationally to the dispensing position;

the escapement member recovers from actuation, thereby retaining the bottommost cutlery article as a replacement first cutlery article in the dispensing position; and upon recovery of the escapement member:

the lower retaining surface is reasserted beneath the proximal end of the handle of the next cutlery article; and the upper retaining surface is withdrawn from beneath the proximal end of the handle of the next cutlery article, whereby the proximal end of the next cutlery article falls onto the lower retaining surface, the next cutlery article thereby becoming a replacement bottommost cutlery article.

4. The cutlery dispenser of claim 1, wherein the escapement mechanism further comprises a coil return spring configured to return the escapement mechanism to a rest configuration after actuation thereof.

5. The cutlery dispenser of claim 4, wherein the escapement mechanism comprises a plurality of coil return springs.

6. The cutlery dispenser claim 1, wherein upon being singulated, the bottommost cutlery article is gravitationally guided by the downward sloping slide track to the dispensing position, while a remainder of the vertical stack is retained in the dispenser cavity, and wherein the slide track includes a slide channel configured to laterally confine the handle and head of the bottommost cutlery article as the bottommost cutlery article gravitationally slides to the dispensing position.

7. The cutlery dispenser of claim 6, wherein the slide channel further includes a dampening surface configured to reduce bouncing and skewing of the bottommost cutlery article as the proximal end of the bottommost cutlery article falls onto the dampening surface.

8. The cutlery dispenser of claim 7, further comprising a damping space provided beneath the dampening surface that enables the dampening surface to elastically expand into the damping space when the proximal end of the bottommost cutlery article falls onto the dampening surface.

9. The cutlery dispenser of claim 1, further comprising at least one pivoting support that is vertically impacted by the bottommost cutlery article when the bottommost cutlery article is released from the stack, the pivoting support being configured to pivot in response to a gravitational force applied thereto by the bottommost cutlery article, thereby inducing a rotation of the bottommost cutlery article about its long axis.

10. The cutlery dispenser of claim 1, wherein the slide track further comprises at least one inwardly sloped surface configured to guide the bottommost cutlery article from a partially rotated configuration to a fully rotated configuration as it falls into the slide channel.

11. The cutlery dispenser of claim 1, wherein before the bottommost cutlery article is singulated and released from the stack, a distal end of the head thereof is supported by a head-supporting surface that extends only partway beneath the distal end, such that when a proximal end of the handle of the bottommost cutlery article is released by the escapement mechanism, the head-supporting surface imparts a rotational torque to the bottommost cutlery article about its long axis as the bottommost cutlery article falls toward the slide track.

12. The cutlery dispenser of claim 1, further comprising a cutlery article quantity indicator that includes:

an indicator arm pivotal about an indicator pivot between an engaged position and an unengaged position;

a contact arm cooperative with the indicator arm and configured to laterally contact the cutlery article stack at an indicator height of the cutlery article stack, the contact arm when in contact with the cutlery article stack maintaining the indicator arm in the engaged position; and an indicator signal cooperative with the indicator arm and configured to be externally visible when the indicator arm is in the unengaged position, and to be externally not-visible when the indicator arm is in the engaged position;

the cutlery article quantity indicator being operable such that when the cutlery article stack is reduced in height to below the indicator height, the contact arm is released from contact with the cutlery article stack, causing the indicator arm to pivot to the unengaged position, thereby causing the indicator signal to become externally visible.

13. The cutlery dispenser of claim 12, wherein the dispenser front includes an indicator window through which the indicator signal is visible when the indicator arm is in the unengaged position.

14. The cutlery dispenser of claim 12, wherein the contact arm is configured to laterally contact a proximal end of at least one cutlery article included in the cutlery article stack when the indicator arm is in the engaged position.

15. The cutlery dispenser of claim 12, wherein said indicator height is set at a sufficient level from said bottom-most cutlery article in said cutlery article stack to provide at least one cutlery article remaining in said cutlery article stack after the indicator signal is activated to be visible.

16. The cutlery dispenser of claim 12, further comprising a plurality of cutlery article quantity indicators having contact arms that are configured to be released at a corresponding plurality of different indicator heights of the cutlery article stack.

17. A cutlery dispensing system comprising:

a base, said base comprising a base front, a base rear, left and right base sides, and at least one base compartment, wherein each of the base compartments comprises a first retaining feature; and a cutlery dispenser according to claim 1, said cutlery dispenser including a second retaining feature proximate said dispenser bottom;

said cutlery dispenser being configured for installation in said base by a mutual engagement of said first and second retaining features as said dispenser is inserted into one of said at least one base compartment in said base, wherein said mutual engagement of said first and second retaining features prevents tipping of the cutlery dispenser after said installation of the cutlery dispenser in said base.

18. The cutlery dispensing system of claim 17, wherein the first and second retaining features are configured to allow said cutlery dispenser to be slidingly inserted into the base horizontally during said installation, and to be slid partway out from the base to provide access to at least said dispenser first side for refilling the cutlery dispenser after said plurality of cutlery articles has been at least partially depleted.

19. The cutlery dispensing system of claim 17, wherein the base comprises a first compartment base unit that includes the at least one base compartment, said first compartment base unit comprising a unit attachment feature that enables a side of the first compartment base unit to be attached to a side of a second compartment base unit.

20. The cutlery dispensing system of claim 19, wherein the first and second compartment base units include different numbers of compartments.

* * * * *